United States Patent [19]

Saitoh et al.

[11] Patent Number: 4,585,720

[45] Date of Patent: Apr. 29, 1986

[54] PHOTOCONDUCTIVE MEMBER HAVING LIGHT RECEIVING LAYER OF A-(SI-GE) AND C

[75] Inventors: Keishi Saitoh, Ibaraki; Yukihiko Ohnuki, Kawasaki; Shigeru Ohno, Yokohama, all of Japan

[73] Assignee: Canon Kabushiki Kaisha, Tokyo, Japan

[21] Appl. No.: 649,713

[22] Filed: Sep. 12, 1984

[30] Foreign Application Priority Data

| | | | |
|---|---|---|---|
| Sep. 14, 1983 | [JP] | Japan | 58-170013 |
| Sep. 21, 1983 | [JP] | Japan | 58-174643 |
| Dec. 28, 1983 | [JP] | Japan | 58-245309 |
| Dec. 28, 1983 | [JP] | Japan | 58-245313 |
| Dec. 29, 1983 | [JP] | Japan | 58-247254 |
| Dec. 29, 1983 | [JP] | Japan | 58-247258 |

[51] Int. Cl.[4] ..... G03G 5/085

[52] U.S. Cl. ..... 430/57; 430/84; 430/95

[58] Field of Search ..... 430/57, 84, 95

[56] References Cited

U.S. PATENT DOCUMENTS

| | | | |
|---|---|---|---|
| 4,451,546 | 5/1984 | Kawamura et al. | 430/74 |
| 4,465,750 | 8/1984 | Ogawa et al. | 430/57 |

*Primary Examiner*—John L. Goodrow

*Attorney, Agent, or Firm*—Fitzpatrick, Cella, Harper & Scinto

[57] ABSTRACT

A photoconductive member comprises a substrate, a layer composed of an amorphous material comprising Si and Ge, said layer having a layer region (C) containing carbon atoms. The layer region (C) has a region (X) where the concentration of carbon atoms increases in the direction of layer thickness toward the upper surface of said layer.

An amorphous layer of silicon containing at least one of nitrogen and oxygen may overlie said layer.

97 Claims, 29 Drawing Figures

PHOTOCONDUCTIVE MEMBER HAVING LIGHT RECEIVING LAYER OF A-(SI-GE) AND C

BACKGROUND OF THE INVENTION

1. Field of the Invention

This invention relates to a photoconductive member having sensitivity to electromagnetic waves such as light [herein used in a broad sense, including ultraviolet rays, visible light, infrared rays, X-rays gamma-rays, and the like].

2. Description of the Prior Art

Photoconductive materials, which constitute photoconductive layers in solid state image pick-up devices, image forming members for electrophotography in the field of image formation, or manuscript reading devices and the like, are required to have a high sensitivity, a high SN ratio [photocurrent ($I_p$)/dark current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid harmless characteristic is very important.

From the standpoint as mentioned above, amorphous silicon [hereinafter referred to as a-Si] has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectric transducing reading device.

However, under the present situation, the photoconductive members of the prior art having photoconductive layers constituted of a-Si are further required to be improved in a balance of overall characteristics including electrical, optical ahd photoconductive characteristics such as dark resistance value, photosensitivity and response to light, etc., and environmental characteristics during use such as humidity resistance, and further stability with the lapse of time.

For instance, when the above photoconductive member is applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed.

Further, a-Si has a relatively smaller coefficient of absorption of the light on the longer wavelength side in the visible light region as compared with that on the shorter wavelength side. Accordingly, in matching to the semiconductor laser practically applied at the present time, the light on the longer wavelength side cannot effectively be utilized, when employing a halogen lamp or a fluorescent lamp as the light source. Thus, various points remain to be improved.

On the other hand, when the light irradiated is not sufficiently absorbed in the photoconductive layer, but the amount of the light reaching the substrate is increased, interference due to multiple reflection may occur in the photoconductive layer to become a cause for "unfocused" image, in the case when the substrate itself has a high reflectance against the light transmitted through the photoconductive layer.

This effect will be increased, if the irradiated spot is made smaller for the purpose of enhancing resolution, thus posing a great problem in the case of using a semiconductor laser as the light source.

Further, a-Si materials to be used for constituting the photoconductive layer may contain as constituent atoms hydrogen atoms or halogen atoms such as fluorine atoms, chlorine atoms, etc. for improving their electrical, photoconductive characteristics, boron atoms, phosphorous atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

That is, for example, in many cases, the life of the photocarriers generated by light irradiation in the photoconductive layer formed is insufficient, or at the dark portion, the charges injected from the substrate side cannot sufficiently impeded.

Furthermore, in the case that the layer thickness exceeds ten and more $\mu$, there often appear, with the lapse of time, such phenomena as floating or peeling of the layer from the substrate surface or cracking in the layer, when the layer is taken out of a vacuum deposition chamber for forming the layer and left standing in the air. Such phenomena often appear especially in the case of drum-like substrates used in the field of electrophotography, and thus there still remain problems to be solved with respect to a longer stability.

Accordingly, together with an attempt to improve the characteristics of a-Si material itself, it is also required to overcome all the problems as mentioned above in designing of the photoconductive member at the same time.

SUMMARY OF THE INVENTION

The present invention is based results of extensive studies made comprehensively from the standpoints of applicability and utility of a-Si as a photoconductive member for image forming members for electrophotography, solid state image pick-up devices, reading devices, etc. It has now been found that a photoconductive member having a photoconductive light receiving layer, made of an amorphous material containing at least one of hydrogen atoms (H) and halogen atoms (X) in a matrix of silicon atoms (Si) and germanium atoms (Ge), or in silicon atoms or in germanium atoms such as so-called hydrogenated amorphous silicon, halogenated amorphous silicon, halogen-containing hydrogenated amorphous silicon [hereinafter generally referred to as a-Si(H,X)], hydrogenated germanium, halogenated germanium, halogen-containing hydrogenated germanium [hereinafter generally referred to as a-Ge(H,X)], hydrogenated amorphous silicon germanium, halogenated amorphous silicon germanium, or halogen-containing hydrogenated amorphous silicon germanium [hereinafter generally referred to as a-SiGe(H,X)], said photoconductive member being prepared with a design to have a specific structure, as will be hereinafter described, not only exhibits practically extremely excellent characteristics but also surpasses the photoconductive members of the prior art in substantially all respects, and especially have markedly excellent characteristics as a photoconductive member for electrophotography and also excellent absorption spectrum characteristics on the longer wavelength side.

A primary object of the present invention is to provide a photoconductive member having constantly stable electrical, optical and photoconductive characteristics which is of all-environment type with virtually no dependence on the service environments, and which is markedly excellent in photosensitive characteristics on the longer wavelength side and light fatigue resistance and also excellent in durability without any deterioration when repeated used, and with no or substantially no residual potential.

Another object of the present invention is to provide a photoconductive member which has a high photosensitivity throughout the whole visible light region, and a particularly excellent matching to a semiconductor laser and also at rapid response to light.

Other object of the present invention is to provide a photoconductive member having a good adhesion between a substrate and a layer formed on the substrate or between overlaid layers, a dense and stable structural constitution and a high layer quality.

Still other object of the present invention is to provide a photoconductive member which has a sufficient charge retentivity during the charging treatment for formation of electrostatic images, when used as an image forming member for electrophotography, to such a extent that the conventional electrophotographic method is very effectively applicable, and which has a distinguished electrophotographic characteristic which is not substantially lowered even in a humid atmosphere.

Further object of the present invention is to provide a photoconductive member for electrophotography, which can easily provide an image of high quality, that is, a high density, a clear halftone, a high resolution and being free from "unfocused" image Still further object of the present invention is to provide a photoconductive member having a high photosensitivity, a high SN ratio characteristic, and a good electrical contact with the substrate.

According to one aspect of the present invention, there is provided a photoconductive member which comprises a substrate for a photoconductive member and a light receiving member constituted of an amorphous material comprising silicon atoms and germanium atoms and exhibiting photoconductivity, the light receiving layer having a layer region (C) containing carbon atoms, and the layer region (C) having a region (X) where the distribution concentration line C(C) in the direction of layer thickness of carbon atoms increases continuously toward the upper surface of the light receiving layer.

According to another aspect of the present invention, there is provided a photoconductive member which comprises a substrate for the photoconductive member and a light receiving layer having a layer constitution comprising a first layer region (G), made of an amorphous material containing germanium atoms and, if necessary, at least one of silicon atoms, hydrogen atoms, and halogen atoms (X) [hereinafter referred to as "a-Ge(Si,H,X)"] and a photoconductive second layer region (S), made of an amorphous material containing silicon atoms and, if necessary, at least one of hydrogen atoms and halogen atoms (X) [hereinafter referred to as "a-Si(H,X)"], the first layer region and the second layer region being provided successively in this order from the substrate side, the light receiving layer having a layer region (N) containing nitrogen atoms and a region (X) with a smooth content curve of nitrogen atoms distributed in the layer thickness direction in the layer region (N), the content curve continuously increasing toward the upper surface of the light receiving layer.

According to a further aspect of the present invention, there is provided a photoconductive member which comprises a substrate for a photoconductive member and a light receiving layer constituted of a light layer overlying the substrate, comprising an amorphous material containing silicon atoms and germanium atoms and exhibiting photoconductivity and a second layer overlying the first layer and comprising an amorphous material containing silicon atoms as the matrix and at least one of nitrogen atoms and oxygen atoms, the first layer having a layer region (C) containing carbon atoms, and the layer region (C) having a region (X) where the distribution concentration line C(C) in the direction of layer thickness of carbon atoms increases continuously from the substrate side toward the upper surface side of the light receiving layer.

According to still another aspect of the present invention, there is provided a photoconductive member which comprises a substrate for a photoconductive member and a light receiving layer constituted of a first layer having a first layer region (G) overlying the substrate and comprising an amorphous material containing germanium atoms and a second layer region (S) overlying the first layer region (G), comprising an amorphous material containing silicon atoms and exhibiting photoconductivity, and a second layer overlying the first layer and comprising an amorphous material containing silicon atoms as the matrix and at least one of nitrogen atoms and oxygen atoms, the first layer having a layer region (C) containing carbon atoms, and the layer region (C) having a region (X) where the distribution concentration line C(C) in the direction of layer thickness of carbon atoms increases continuously from the substrate side toward the upper surface side of the light receiving layer.

The photoconductive member of the present invention so designed as to have the layer structure as the above mentioned can solve all of the abovementioned problems, and shows very distinguished electrical, optical and photoconductive characteristics and also distinguished dielectric strength and service environmental characteristics.

Particularly when applied to an image-forming member for the electrophotography, the present photoconductive member has no influence of residual potential on the image formation, stable electric characteristics, a higher sensitivity, a high SN ratio, a high light fatigue resistance, longer repeated use characteristics, a clear halftone, and a high resolution, and can produce high quality images stably and repeatedly.

Furthermore, the present photoconductive member can be used continuously and repeatedly at a high speed for a long time, since the light receiving layer itself formed on the substrate is tough and considerably distinguished in the adhesion to the substrate.

Still furthermore, the present photoconductive member has a high photosensitivity in the whole visible light region, a good matching particularly to semi-conductor laser and a high response to light.

DETAILED DESCRIPTION OF THE PREFERRED EMBODIMENTS

Figure 1:
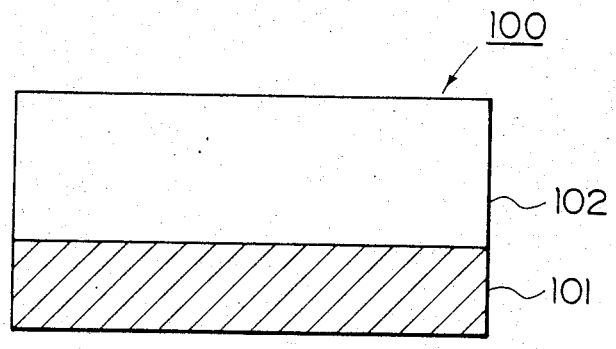
FIGS. 1 to 4 each show a schematic sectional view for illustration of the layer constitution of the photoconductive member according to the present invention.

Referring now to the drawings, the photoconductive members according to the present invention will be described in detail below.

FIG. 1 shows a schematic sectional view for illustration of the layer constitution of a first embodiment of the photoconductive member of the present invention.

The photoconductive member 100 as shown in FIG. 1 has a photoconductive light receiving layer 102 constituted of a-SiGe(H,X), on a substrate 101 for the photoconductive member, and the light receiving layer 102 has a layer region (C) containing carbon atoms.

The germanium atoms existing in the light receiving layer 102 may be uniformly distributed throughout the layer 102 or may be distributed, throughout the layer thickness direction but not uniformly in the content of germanium atoms in depth profile. In any case, however, it is necessary that the germanium atoms are distributed uniformly and contained throughout the interplanar direction, i.e. the direction in parallel to the substrate surface to make the characteristics uniform in the interplanar direction. The germanium atoms are particularly contained in the light receiving layer 102 that they should be contained throughout the layer thickness direction of the light receiving layer 102 and should be more distributed toward the substrate side (the side of interface between the light receiving layer 102 and the substrate 101) than the side opposite to the substrate 101-provided side (that is, the surface 104 side of light receiving layer 102), or they should take quite a reversed depth profile.

In the photoconductive member according to the present invention, it is desirable that the germanium atoms existing in said light receiving layer can take said depth profile in the layer thickness direction and a uniform distribution state in the interplanar direction in parallel to the substrate surface.

Figure 2:
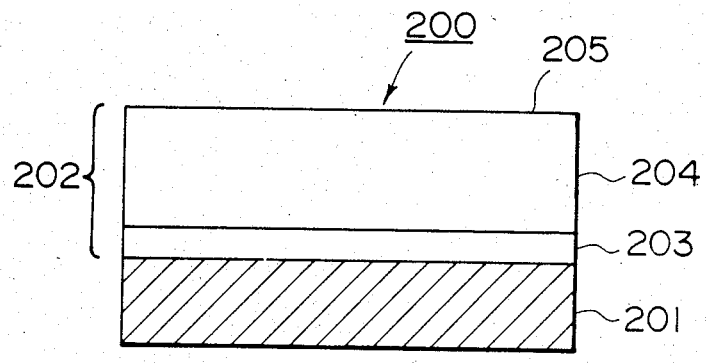

FIG. 2 shows a schematic sectional view for illustration of the layer constitution of a second embodiment of the photoconductive member of this invention.

The photoconductive member 200 as shown in FIG. 1 is constituted of a light receiving layer 202 formed on a substrate 201 for photoconductive member, said light receiving layer 202 having a free surface 205 on one end surface.

The light receiving layer 202 has a layer structure constituted of a first layer region (G) 203 consisting of "a-Ge(Si,H,X)", and a second layer region (S) 204 having photoconductivity consisting of a-Si(H,X) laminated successively from the substrate side 201.

The germanium atoms existing in the first layer region (G) 203 may be uniformly distributed throughout the first layer region (G) 203 may be distributed throughout the layer thickness direction but not uniformly in the content of germanium atoms in depth profile. In any case, however, it is necessary that the germanium atoms are distributed uniformly and contained throughout the interplanar direction, i.e. the direction in parallel to the substrate surface to make the characteristics uniform in the interplanar direction. The germanium atoms are particularly contained in the first layer region (G) that they should be contained throughout the layer thickness direction of the light receiving layer 102 and should be more distributed toward the substrate side than the side opposite to the substrate 101-provided side (that is, the surface 105 side of light receiving layer 102), or they should take quite a reversed depth profile.

In the photoconductive member according to the present invention, it is desirable that the germanium atoms existing in said first layer region (G) can take said depth profile in the layer thickness direction and a uniform distribution state in the interplanar direction in parallel to the substrate surface.

In the present invention, in the second layer region (S) provided on the first layer region (G), no germanium atom is contained, and by forming the light receiving layer to such a layer structure, it is possible to give a photoconductive member which is excellent in photosensitivity to the light over the entire wavelength region from relatively shorter wavelength to relatively longer wavelength including visible light region.

Also in a preferred embodiment, the distribution of germanium atoms in the first layer region (G) is such that germanium atoms are distributed continuously over all the layer region with the concentration C of germanium atoms in the layer thickness direction being reduced from the support side to the second layer region (S), affinity between the first layer region (G) and the second layer region (S) is excellent. Also, as described hereinafter, by increasing the concentration C of germanium atoms at the end portion on the substrate side extremely great, the light on the longer wave-length side which cannot substantially be absorbed by the second layer region (S) can be absorbed in the first layer region (G) substantially completely, when employing a semiconductor laser, whereby interference by reflection from the substrate surface can be prevented.

Also, in the photoconductive member of the present invention, when silicon atoms are contained in the first layer region (G) the respective light receiving materials constituting the first layer region (G) and the second layer region (S) have the common constituent of silicon atoms, and therefore chemical stability can be sufficiently ensured at the laminated interface.

Figure 3:
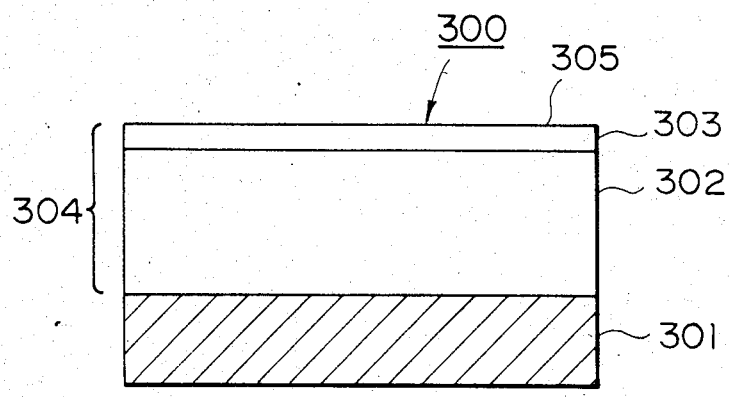

FIG. 3 shows a schematic illustration for explanation of the layer constitution of the photoconductive member according to the third embodiment of the present invention.

The photoconductive member 300 shown in FIG. 3 has a substrate 301 for the photoconductive member, a first layer (I) 302 provided on the substrate 301, and a second layer (II) 303 provided on the first layer (I) 302. The first layer (I) 302 is comprised of a-SiGe(H,X), and contains carbon atoms and has a photoconductivity. A light receiving layer 304 is comprised of the first layer (I) 302 and the second layer (II) 303. The germanium atoms may be uniformly distributed throughout the first layer (I) 302 or may be distributed throughout the layer thickness direction, but not uniformly in the content of germanium atoms in depth profile. In any case, however, it is necessary that the germanium atoms in the first layer (I) 302 are distributed uniformly and contained throughout the interplanar direction, i.e. the direction in parallel to the substrate surface to make the characteristics uniform in the interplanar direction.

The germanium atoms are particularly contained in the first layer (I) 302 that they should be contained throughout the layer thickness direction of the first layer (I) 302 and should be more distributed toward the substrate 301 side (the side of interface between the light receiving layer and the substrate 301) than the side opposite to the substrate 301-provided side (the free surface 305 side of light receiving layer 304), or they should take quite a reversed depth profile.

In the photoconductive member according to the present invention, it is desirable that the germanium atoms existing in said first layer (I) 302 can take said depth profile in the layer thickness direction and a uniform distribution state in the interplanar direction in parallel to the substrate 301 surface.

Figure 4:
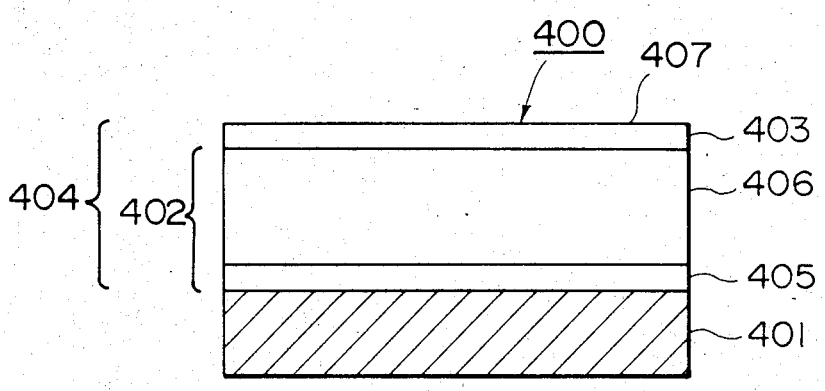

FIG. 4 shows a schematic illustration for explanation of the layer constitution of the photoconductive member according to the fourth embodiment of the present invention.

The photoconductive member 400 shown in FIG. 4 has a substrate 401 for the photoconductive member, a first layer (I) 402 provided on the substrate 401, and a second layer (II) 403 provided on the first layer (I) 402. A light receiving layer 404 is comprised of the first layer (I) 402 and the second layer (II) 403.

The first layer (I) 402 has the first layer region (G) 405 provided on the substrate comprising an amorphous material containing germanium atoms and, if desired at least one of silicon atoms, hydrogen atoms and halogen atoms [hereinafter referred to as "a-Ge(Si,H,X)"], and the second layer region (S) 406 exhibiting photoconductivity provided on the first layer region (G) 405 comprising an amorphous material containing silicon atoms and, if desired, at least one of hydrogen atoms and halogen atoms [hereinafter referred to as "a-Si(H,X)"]. The germanium atoms may be uniformly distributed throughout the first layer region (G) 405 or may be distributed throughout the layer thickness direction, but not uniformly in the content of germanium atoms in depth profile. In any case, however, it is necessary that the germanium atoms in the first layer region (G) 405 are distributed uniformly and contained throughout the interplanar direction, i.e. the direction in parallel to the substrate surface to make the characteristics uniform in the interplanar direction.

The germanium atoms are particularly contained in the first layer (I) 402 that they should be contained throughout the layer thickness direction of the first layer (I) 402 and should be more distributed toward the substrate 401 side (the side of interface between the light receiving layer and the substrate 401) than the side opposite to the substrate 401-provided side (the free surface 407 side of light receiving layer 404), or germanium atoms may be contained in the first layer region (G) 405 such that they take quite a reversed depth profile as compared with the above one.

In the photoconductive member according to the present invention, it is desirable that the germanium atoms existing in said first layer region (G) 405 can take said depth profile in the layer thickness direction and a uniform distribution state in the interplanar direction in parallel to the substrate 401 surface.

In the present invention, in the second layer region (S) 406 provided on the first layer region (G) 405, no germanium atom is contained, and by forming the first layer (I) 402 to such a layer structure, it is possible to give a photoconductive member which is excellent in photosensitivity to the light over the entire wavelength region from relatively shorter wavelength to relatively longer wavelength including visible light region.

Also in a preferred embodiment, the distribution of germanium atoms in the first layer region (G) 405 is such that germanium atoms are distributed continuously over all the layer region with the concentration C of germanium atoms in the layer thickness direction being reduced from the support 401 side to the second layer region (S) 406, affinity between the first layer region (G) 405 and the second layer region (S) 406 is excellent. Also, as described hereinafter, by increasing the concentration C of germanium atoms at the end portion on the substrate 401 side extremely great, the light on the longer wavelength side which cannot substantially be absorbed by the second layer region (S) 406 can be absorbed in the first layer region (G) 405 substantially completely, when employing a semi-conductor laser, whereby interference by reflection from the substrate 401 surface can be prevented.

FIGS. 5 through 13 each show typical examples of ununiform depth profile in the layer thickness direction of germanium atoms in the light receiving layer or first layer of the photoconductive member in the present invention.

Figure 5:
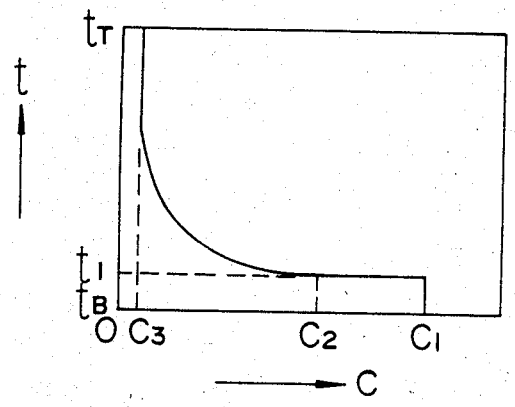
FIGS. 5 to 13 each show a schematic illustration of the depth profile of germanium atoms in the light receiving layer or the first layer.

In FIGS. 5 thorugh 13, the abscissa indicates the content C of germanium atoms and the ordinate the layer thickness of the photoconductive light receiving layer or the first layer, $t_B$ showing the position of the surface of the light receiving layer or the first layer on the substrate side and $t_T$ the position of the surface of the light receiving layer or the first layer on the side opposite to the substrate side. That is, layer formation of the light receiving layer or the first layer containing germanium atoms proceeds from the $t_B$ side toward the $t_T$ side.

In FIG. 5, there is shown a first typical embodiment of the depth profile of germanium atoms in the layer thickness direction in the light receiving layer or the first layer.

In the embodiment as shown in FIG. 5, from the interface position $t_B$ at which the surface, on which the light receiving layer or the first layer containing germanium atoms is to be formed, is in contact with the surface of said light receiving layer or the first layer to the position $t_1$, germanium atoms exist in the formed light receiving layer or the first layer, while keeping the content C of germanium atoms at a constant value of $C_1$, and the content gradually decreases from the content $C_2$ continuously from the position $t_1$ to the interface position $t_T$. At the interface position $t_T$, the content C of germanium atoms reaches $C_3$.

Figure 6:
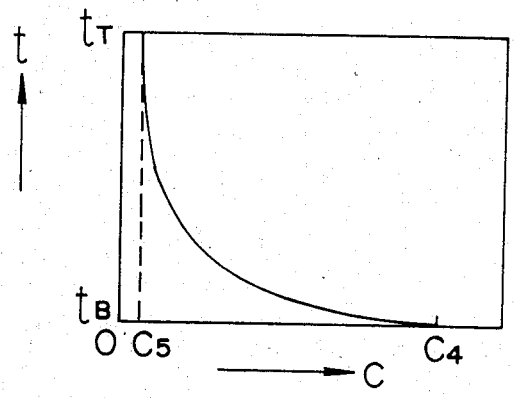

In an embodiment shown in FIG. 6, the content C of germanium atoms decreases gradually and continuously from the position $t_B$ to the position $t_T$ from the content $C_4$ until it reaches the content $C_5$ at the position $t_T$.

Figure 7:
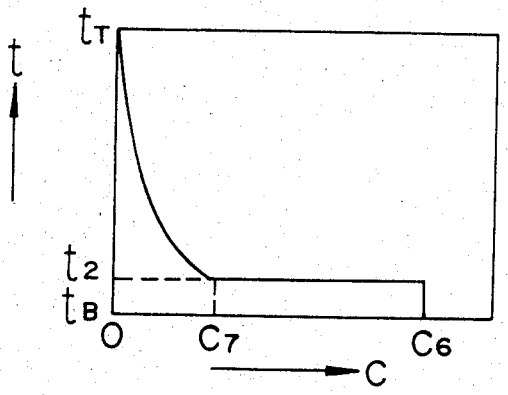

In case of FIG. 7, the content C of germanium atoms is kept at a constant $C_6$ from the position $t_B$ to the position $t_2$, gradually decreases continuously from the position $t_2$ to the position $t_T$, and the content C is substantially zero at the position $t_T$ (substantially zero herein means the content below the detectable limit).

Figure 8:
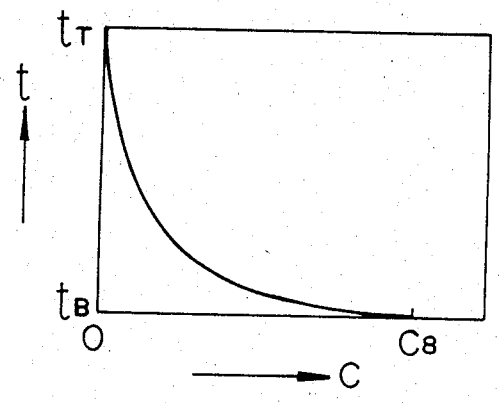

In case of FIG. 8, the content C of germanium atoms decreases gradually and continuously from the position $t_B$ to the position $t_T$ from the content $C_8$, until it reaches substantially zero at the position $t_T$.

Figure 9:
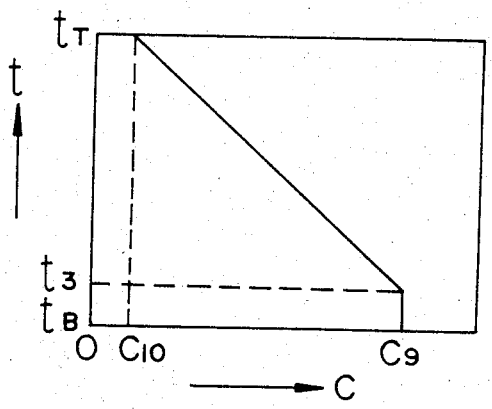

In the embodiment shown in FIG. 9, the content C of germanium atoms is kept at a constant $C_9$ between the position $t_B$ and the position $t_3$, and it reaches $C_{10}$ at the position $t_T$. Between the position $t_3$ and the position $t_T$, the content decreases as a first order function from the position $t_3$ to the position $t_T$.

Figure 10:
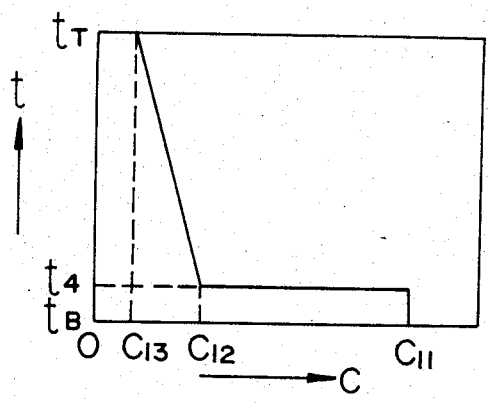

In an embodiment shown in FIG. 10, there is formed a depth profile such that the content C takes a constant $C_{11}$ from the position $t_B$ to the position $t_4$, and decreases as a first order function from the content $C_{12}$ to the content $C_{13}$ from the position $t_4$ to the position $t_T$.

Figure 11:
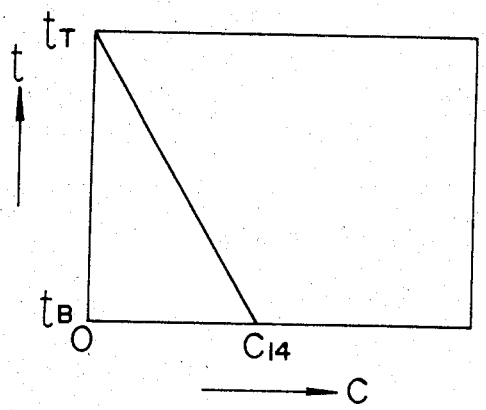

In an embodiment shown in FIG. 11, the content C of germanium atoms decreases as a first order function from the content $C_{14}$ to substantially zero from the position $t_B$ to the position $t_T$.

Figure 12:
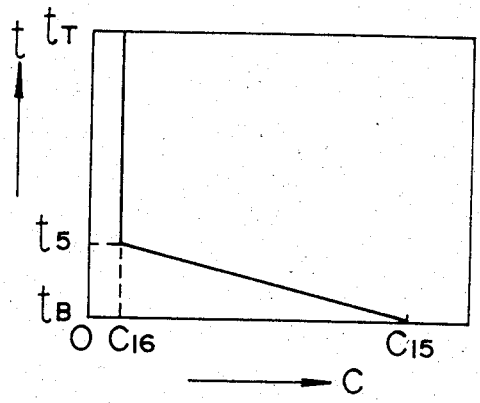

In FIG. 12, there is shown an embodiment, where the content C of germanium atoms decreases as a first order function from the content $C_{15}$ to $C_{16}$ from the position $t_B$ to $t_5$ and is kept at constant content $C_{16}$ between the position $t_5$ and $t_T$.

Figure 13:
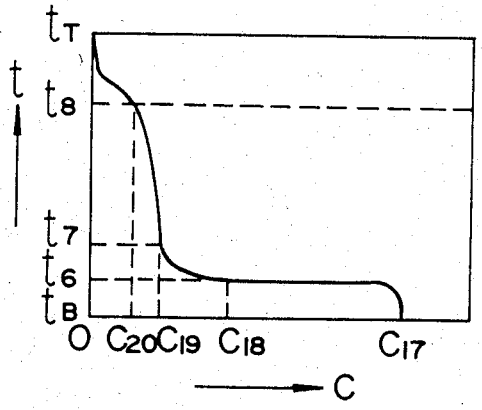

In an embodiment shown in FIG. 13, the content C of germanium atoms is kept at the content $C_{17}$ at the position $t_B$, whose content $C_{17}$ initially decreases gradually and abruptly near the position $t_6$, until it reaches the content $C_{18}$ at the position $t_6$.

Between the position $t_6$ and the position $t_7$, the content C initially decreases abruptly and thereafter gradually, until it reaches the content $C_{19}$ at the position $t_7$. Between the position $t_7$ and the position $t_8$, the content decreases very gradually to the content $C_{20}$ at the position $t_8$. Between the position $t_8$ and the position $t_T$, the content decreases along the curve having a shape as shown in the Figure from the content $C_{20}$ to substantially zero.

As described above about some typical examples of depth profiles of germanium atoms in the light receiving layer or the first layer in the layer thickness direction by referring to FIGS. 5 through 13, in the preferred embodiment of the present invention, the light receiving layer of the present invention has a depth profile so as to have a portion rich in content C of germanium atoms on the substrate side and a portion considerably poor in content C of germanium atoms on the interface $t_T$ side as compared with the substrate side.

The light receiving layer or the present invention for the photoconductive member in the present invention desirably has a localized, region (A) containing germanium atoms preferably in a relatively higher content on the substrate side or on the free surface side to the contrary as described above.

For example, the localized region (A), as explained in terms of the symbols shown in FIG. 5 through FIG. 13, may be desirably provided within the depth of $5\mu$ from the interface position $t_B$.

Said localized region (A) may be made to be identical with the whole layer region ($L_T$) up to the depth of $5\mu$ from the interface position $t_B$, or alternatively a part of the layer region ($L_T$).

Whether the localized region (A) is made a part or whole of the layer region ($L_T$) depends on the characteristics required for the light receiving layer or the first layer to be formed.

The localized region (A) may preferably be formed according to such a layer formation that the maximum value $C_{max}$ of the content of germanium atoms existing in the layer thickness direction may preferably be 1000 atomic ppm or more, more preferably 5000 atomic ppm or more, and most preferably $1\times10^4$ atomic ppm or more on basis of sum total with silicon atoms.

That is, according to the present invention, the light receiving layer or the first layer containing germanium atoms is formed so that the maximum value $C_{max}$ of the content may exist within a layer thickness of $5\mu$ from the substrate side (the layer region within the depth of $5\mu$ from $t_B$).

In the present invention, the content of germanium atoms in the light receiving layer or the first layer may be selected as desired so as to effectively achieve the objects of the present invention, and is preferably 1 to $9.5\times10^5$ atomic ppm, more preferably 100 to $8\times10^5$ atomic ppm, and most preferably 500 to $7\times10^5$ atomic ppm, on the basis of sum total with silicon atoms.

When the light receiving layer or the first layer is comprised of the first layer region (G) and the second layer region (S), the content of germanium atoms in the first layer region (G) may be selected as desired so as to effectively achieve the objects of the present invention, and is preferably 1 to $10\times10^5$ atomic ppm, more preferably 100 to $9.5\times10^5$ atomic ppm, and most preferably 500 to $8\times10^5$ atomic ppm, on the basis of sum total with silicon atoms.

In the present invention, the light receiving layer with desired characteristics can be formed as desired by designing the change rate curve of content C of germanium atoms as desired, when the germanium atoms are continuously distributed in the whole layer region and the content C of germanium atoms distributed in the layer thickness direction is made lower toward the free surface side of the light receiving layer or made higher toward the substrate side, or given an increasing change in the depth of germanium atoms in the light receiving layer or the first layer.

For example, when the content curve of germanium atoms in depth profile is changed so that the content C of germanium atoms in the light receiving layer or the first layer is made as high as possible on the substrate side and is made as low as possible on the free surface side of the light receiving layer, a higher photosensitization can be obtained in the whole region of wavelength ranging from the relatively short wavelength to the relatively long wavelength, including the visible light region, and also an interference of interferable light such as laser beam, can be effectively prevented.

When a semi-conductor laser is used, the long-wavelength light cannot be thoroughly absorbed on the laser-irradiated surface side of the light receiving layer or the first layer, but by increasing the content C of germanium atoms to an extreme at the end part on the substrate side of the light receiving layer or the first layer, such long-wavelength light can be substantially completely absorbed in the layer region at the end part on the substrate side of the light receiving layer or the first layer, and the interference by reflection from the substrate surface can be effectively prevented, as will be described later.

In the photoconductive member of the present invention, carbon atoms exist in the light receiving layer or the first layer to attain a higher photosensitization and a higher dark resistance, and also to attain an improvement in adhesion between the substrate and the light receiving layer or the first layer, and to prevent the charge injection from the free surface of the light receiving layer or the first layer. In the light receiving layer or the first layer, much more carbon atoms are made to exist particularly near the free surface side of the light receiving layer or the first layer, and, if necessary, near the substrate.

That is, carbon atoms are distributed in the layer region (C) such that the layer region (C) has a region (X) where the distribution concentration line C(C) in the direction of layer thickness of carbon atoms increases continuously toward the upper surface of the light receiving layer or the first layer. If desired, the layer region (C) may have a region (Y) below the region (X), and in the region (Y) the distribution concentration line C(C) increases continuously toward the substrate side.

Figure 14:
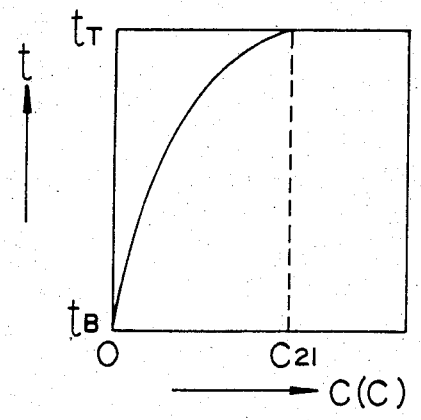
Figs. 14 through 16 each show a schematic illustration of the depth profile of carbon atoms in the light receiving layer.
Figure 15:
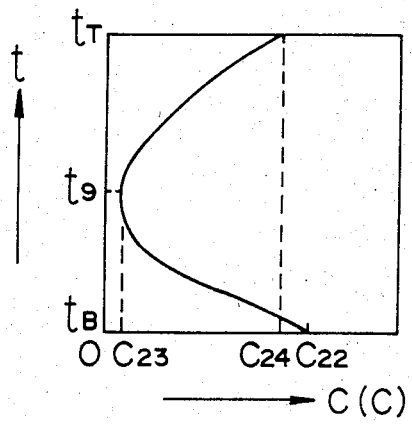
Figure 16:
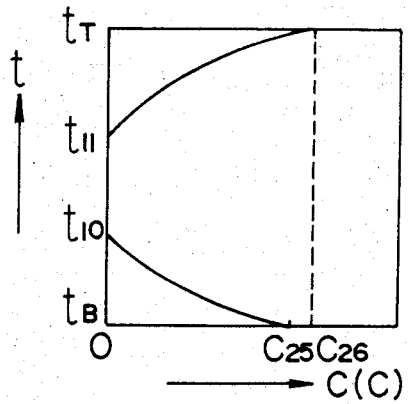

FIG. 14 through FIG. 16 each show a typical example of depth profile of carbon atoms throughout the light receiving layer or the first layer, where symbols used for the illustration have the same meanings as used for FIG. 5 through FIG. 13, unless otherwise mentioned. In an embodiment shown in FIG. 14, the content line C(C) of carbon atoms in depth profile continuously and monotonously increases from 0 to $C_{21}$ between the position $t_B$ and the position $t_T$.

In an embodiment shown in FIG. 15, the content line C(C) of carbon atoms in depth profile is $C_{22}$ at the position $t_B$, and continuously and monotonously decreases from the content $C_{22}$ till the position $t_q$ at which the content C(C) reaches $C_{23}$. Between the position $t_q$ and the position $t_T$, the content line C(C) of carbon atoms continuously and monotonously increases from the position $t_q$ until it reaches $C_{24}$ at the position $t_T$.

An embodiment of FIG. 16 is quite similar to the embodiment of FIG. 15, but differs therefrom only in that no carbon atoms are made to exist at the position $t_{10}$ and $t_{11}$.

Between the position $t_B$ and the position $t_{10}$, the content line C(C) continuously and monotonously decreases from $C_{25}$ at the position $t_B$ to 0 at the position $t_{10}$. Between the position $t_{11}$ and the position $t_T$, the content line C(C) continuously and monotonously increases from 0 at the position $t_{11}$ to $C_{26}$ at the position $t_B$.

In the photoconductive member of the present invention, for example, a higher photosensitization and a higher dark resistance of the light receiving layer or the first layer can be obtained at the same time by making more carbon atoms exist on the lower surface side and/or the upper surface side of the light receiving layer or the first layer, making less carbon atoms exist inward in the light receiving layer or the first layer, while continuously changing the depth profile content line C(C) of carbon atoms in the layer thickness direction, as shown in the typical examples of FIG. 14 through FIG. 16.

Furthermore, the interference due to the interferable light such as laser beam, etc. can be effectively prevented by continuously changing the depth profile of content line C(C) of carbon atoms, and as a result the refractive index can be changed gently in the layer thickness direction owing to the inclusion of carbon atoms.

In the present invention, the content of carbon atoms existing in the layer region (C) in the light receiving layer or the first layer can be selected as desired in view of the characteristics required for the layer region (C) itself, or when the layer region (C) is provided in direct contact with the substrate, the content can be selected as desired in view of organic relationships, such as relationship to characteristics at the contact interface with the substrate, etc.

Furthermore, when another layer region is provided in direct contact with the layer region (C), the content of carbon atoms can be selected as desired in view of relationships to characteristics of said another layer region or characteristics at the contact with said another layer region.

The amount of carbon atoms existing in the layer region (C) can be selected as desired in view of the characteristics required for the photoconductive member to be formed, and is preferably 0.001 to 50 atomic %, more preferably 0.002 to 40 atomic %, and most preferably 0.003 to 30 atomic %, on the basis of sum total of silicon atoms, germanium atoms, and carbon atoms [hereinafter referred to as "T(SiGeC)"] sum total with silicon atoms [hereinafter referred to as "T(SiC)"] or sum total with germanium atoms [hereinafter referred to as "T(GeC)"].

In the present invention, when the layer region (C) occupies the whole region of the light receiving layer or the first layer or when a ratio of the layer thickness $T_o$ of layer region (C) to the layer thickness T of the light receiving layer or the first layer is sufficiently large, though the layer region (C) does not occupy the entire region of the light receiving layer or the first layer, the upper limit to the content of carbon atoms existing in the layer region (C) is desirably much less than said value.

In the present invention, when a ratio of the layer thickness $T_o$ of layer region (C) to the layer thickness T of the light receiving layer or the first layer is at least 2/5, the upper limit to the content of carbon atoms existing in the layer region (C) is preferably 30 atomic % or less, more preferably 20 atomic % or less, and most preferably 10 atomic % or less, on the basis of T (SiGeC), T(SiC) and T(GeC).

In the present invention, the layer region (C) containing carbon atoms as a constituent of the light receiving layer or the first layer desirably has a localized region (B) containing the carbon atoms with a relative high content on the substrate side and/or the free surface side, as described above, where the adhesion between the substrate and the light receiving layer or the first layer can be more improved and the receiving potential can be increased.

Said localized region (B) is desirably provided within the depth of 5μ from the substrate surface or from the free surface.

In the present invention, said localized region (B) can be occupy the whole layer region ($L_T$) down to the depth of 5μ from the substrate surface or from the free surface, or can occupy a portion of the layer region ($L_T$).

Whether the localized region (B) occupies a portion or a whole portion of the layer region ($L_T$) depends on the characteristics required for the light receiving layer or the first layer to be formed.

The localized region (B) is desirably formed so that the maximum value $C_{max}$ of the content C of carbon atoms existing in depth profile in the layer thickness direction in the localized region (B) can be preferably 500 atomic ppm or more, more preferably 800 atomic ppm or more, and most preferably 1,000 atomic ppm or more.

That is, in the present invention, the layer region (C) containing the carbon atoms is desirably formed so that the maximum value $C_{max}$ of the content C in depth profile can reside within the depth of 5μ from the substrate surface or from the free surface.

In the photoconductive member of the present invention, the conductive characteristics of the light receiving layer or the first layer can be controlled as desired by providing the layer region (PN) containing a substance capable of controlling the conductive characteristics to the light receiving layer or the first layer.

Such substance may include the so called impurities in the semi-conductor field. In the present invention, p-type impurities capable of imparting p-type conductive characteristics to Si or Ge as a constituent for the light receiving layer or the first layer, and n-type impurities capable of imparting n-type conductive characteristics thereto, can be exemplified as the substance, more particularly, the p-type impurities may include atoms belonging to Group III of the Periodic table (Group III atoms), such as B (boron), A1 (aluminum), Ga (gallium), In (indium), T1 (thallium), etc., among which B and Ga are particularly preferably used.

The n-type impurities may include atoms belonging to Group V of the Periodic table (Group V atoms), such as P (phosphorus), As (arsenic), Sb (antimony), Bi (bismuth), etc., among which P and As are particularly preferably used.

In the present invention, the content of the substance existing in the layer receiving (PN) to control the conductive characteristics can be selected as desired in view of the conductive characteristics required for the light receiving layer or the first layer, or in view of organic relationships such as relationship to characteristics at the contact interface with the substrate on which the light receiving layer or the first layer is provided in direct contact therewith.

Furthermore, the content of the substance existing in the light receiving layer or the first layer to control the conductive characteristics can be selected as desired in view of relationships to the characteristics of other layer region to be provided in direct contact with said layer region or in view of relationships to the characteristics at the contact interface with said other layer region, when the substance is made to locally exist in the desired layer region of the light receiving layer or the first layer, particularly when the substance is made to exist in the layer region at the end part on the substrate side of the light receiving layer or the first layer.

In the present invention, it is desirable that the content of the substance existing in the layer region (PN) to control the conductive characteristics is preferably 0.01 to $5\times10^4$ atomic ppm, more preferably 0.5 to $1\times10^4$ atomic ppm, and most preferably 1 to $5\times10^3$ atomic ppm.

In the present invention, when the content of the substance existing in the layer region (PN) is preferably 30 atomic ppm or more, more preferably 50 atomic ppm or more, and most preferably 100 atomic ppm or more, it is desirably that said substance exist locally in a layer region of the light receiving layer or the first layer, particularly in the layer region (E) at the end part on the substrate side of the light receiving layer or the first layer.

By the inclusion of the substance capable of controlling the conductive characteristics in the layer region (E) at the end part on the substrate side of the light receiving layer or the first layer in said content or more, the injection of electrons into the light receiving layer from the substrate side can be effectively prevented when the free surface of the light receiving layer is subjected to the charging treatment to ⊕ polarity in the case that the substance is, said p-type impurity. On the other hand, in the case that the substance is said n-type impurity, injection of positive holes into the light receiving layer or the first layer from the substrate side can be effectively prevented, when the free surface of the light receiving layer or the first layer is subjected to the charging treatment to ⊖ polarity.

When a substance capable of controlling the conductive characteristics in one polarity exists in the layer region (E) at the end part in this manner, the remaining layer region of the light receiving layer or the first layer, that is, the layer region (Z), which is the part exclusive of the layer region (E) at the end part, can contain a substance capable of controlling the conductive characteristics in other polarity, or can contain a substance capable of controlling the conductive characteristics in the same polarity, in much less content than in the actual content of the layer region (E) at the end part.

In that case, the content of the substance existing in the layer region (Z) to control the conductive characteristics can be selected as desired in view of the polarity or the content of the substance existing in the layer region (E) at the end part, and is preferably 0.001 to 1,000 atomic ppm, more preferably 0.05 to 500 atomic ppm, and most preferably 0.1 to 200 atomic ppm.

In the present invention, when a substance capable of controlling the conductive characteristics in same polarity exists in the layer region (E) at the end part and in the layer region (Z), it is desirable that the content of the substance in the layer region (Z) is preferably 30 atomic ppm or less.

In the present invention, a layer region containing a substance capable of controlling the conductive characteristics in one polarity and a layer region containing another substance capable of controlling the conductive characteristics in other polarity can be provided in direct contact with each other in the light receiving layer or the first layer, so that the so called depletion layer can be provided at the contact region. That is, the so called p-n junction is formed by providing a layer region containing said p-type impurity and a layer region containing said n-type impurity in direct contact with each other in the light receiving layer or the first layer so as to provide a depletion layer.

In the present invention, the light receiving layer or the first layer, made of a-SiGe(H,X) may be formed according to the vacuum deposition method utilizing discharging phenomenon, such as glow discharge method, sputtering method or ion-plating method. For example, for forming the light receiving layer or the first layer, made of a-SiGe(H,X) according to the glow discharge method, the basic procedure comprises introducing a starting gas for Si supply capable of supplying silicon atoms (Si) and a starting gas for Ge supply capable of supplying germanium atoms (Ge), and, if necessary, a starting gas for introduction of hydrogen atoms (H) and/or a starting gas for introduction of halogen atoms (X) into a deposition chamber which can be internally brought to a reduced pressure, and exciting glow discharge in said deposition chamber, thereby forming a layer made of a-SiGe(H,X) on the surface of a substrate placed at a predetermined position. For non-uniformly distributing the germanium atoms, a layer made of a-SiGe(H,X) may be formed while controlling the depth profile of germanium atoms according to a desired change rate curve. Alternatively, in the formation according to the sputtering method, a target made of Si or two sheets of targets of said target and a target made of Ge, or a target of a mixture of Si and Ge is sputtered in an atmosphere of an inert gas such as Ar, Ge, etc. or a gas mixture based on these gases by introducing a starting gas for Ge supply, as diluted with a dilution gas such as He, Ar, etc., if desired, and a gas for introduction of hydrogen atoms (H) and/or a gas for introduction of halogen atoms (X), if desired, into a deposition chamber for sputtering, thereby forming a plasma atmosphere of a desired gas. To make non-uniform distribution of the germanium atoms, sputtering of said target is effected, while controlling the gas flow rates of the starting gas for supply of Ge according to a desired change rate curve.

In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) and vaporized, and the flying vaporized product is permitted to pass through a desired gas plasma atmosphere, otherwise following the same procedure as in the case of sputtering.

In the present invention, the first layer region (G), made of a-Ge(Si,H,X), may be formed according to the vacuum deposition method utilizing discharging phenomenon, such as glow discharge method, sputtering method or ion-plating method. For example, for forming the first layer region (G) made of a-SiGe(H,X) according to the glow discharge method, the basic procedure comprises introducing a starting gas for Ge supply capable of supplying germanium atoms (Ge), and, if necessary, a starting gas for Si supply capable of supplying silicon atoms (Si) and a starting gas for introduction of hydrogen atoms (H) and/or a starting gas for introduction of halogen atoms (X) into a deposition chamber which can be internally brought to a reduced pressure, and exciting glow discharge in said deposition chamber, thereby forming a layer made of a-Ge(Si,H,X) on the surface of a substrate placed at a predetermined position. For non-uniformly distributing the germanium atoms, a layer made of a-Ge(Si,H,X) may be formed while controlling the depth profile of germanium atoms according to a desired change rate curve. Alternatively, in the formation according to the sputtering method, a target made of Si or two sheets of targets of said target and a target made of Ge, or a target of a mixture of Si and Ge is sputtered in an atmosphere of an inert gas such as Ar, He, etc. or a gas mixture based on these gases by introducing a starting gas for Ge supply, as diluted with a dilution gas such as He, Ar, etc., if desired, and a gas for introduction of hydrogen atoms (H) and/or a gas for introduction of halogen atoms (X), if desired, into a deposition chamber for sputtering, thereby forming a plasma atmosphere of a desired gas. To make non-uniform distribution of the germanium atoms, sputtering of said target is effected, while controlling the gas flow rates of the starting gas for supply of Ge according to a desired change rate curve.

The second layer region (S) comprising a-Si(H,X) may be formed by using a member selected from the above-mentioned starting materials (I) for forming the first layer region (G) excluding the starting materials which can be used as starting gases for supplying Ge [starting materials (II) for forming the second layer region (S)]and employing the same processes and conditions as those for forming the first layer region (G).

That is, the second layer region (S) made of a-Si(H,X), may be formed according to the vacuum deposition method utilizing discharging phenomenon, such as glow discharge method, sputtering method or ion-plating method. For example, for forming the second layer region (S) made of a-Si(H,X) according to the glow discharge method, the basic procedure comprises introducing a starting gas for Si supply capable of supplying silicon atoms (Si), and, if necessary, a starting gas for introduction of hydrogen atoms (H) and/or a starting gas for introduction of halogen atoms (X) into a deposition chamber which can be internally brought to a reduced pressure, and exciting glow discharge in said deposition chamber, thereby forming a layer made of a-Si(H,X) on the surface of a substrate placed at a predetermined position. Alternatively, in the formation according to the sputtering method, a target made of Si is sputtered in an atmosphere of an inert gas such as Ar, He, etc. or a gas mixture based on these gases and a gas for introduction of hydrogen atoms (H) and/or a gas for introduction of halogen atoms (X) into a deposition chamber for sputtering.

The starting gas for supplying Si to be used in the present invention may include gaseous or gasifiable silicon hydrides (silanes) such as $SiH_4$, $Si_2H_6$, $Si_3H_8$, $Si_4H_{10}$, etc. as effective materials. In particular, $SiH_4$ and $Si_2H_6$ are preferred with respect to each handling during the layer formation and efficiency for supplying Si. The starting gas for supplying Ge may include gaseous or gasifiable germanium hydrides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. as effective materials. In particular, $GeH_4$, $Ge_2H_6$ and $Ge_3H_8$ are preferred with respect to easy handling during the layer formation and efficiency for supplying Ge.

In the present invention, the halogen atoms (X), which can be contained, if necessary, in the light receiving layer or the first layer, may include, for example, fluorine, chlorine, bromine, and iodine, among which fluorine and chlorine are particularly preferable.

Effective starting gases for introduction of halogen atoms to be used in the present invention may include a large number of halogen compounds, as exemplified preferably by gaseous or gasifiable halogen compounds such as halogen gases, halides, interhalogen compounds, halogen-substituted silane derivatives, and the like.

Further, gaseous or gasifiable silicon hydride compounds containing halogen atoms, that is, the compounds containing silicon atoms and halogen atoms as constituent elements can be mentioned as effective ones in the present invention.

Typical examples of halogen compounds preferably used in the present invention may include halogen gases such as fluorine, chlorine, bromine or iodine, interhalogen compounds such as BrF, ClF, $ClF_3$, $BrF_5$, $BrF_3$, $IF_3$, $IF_7$, ICl, IBr, etc.

The silicon compounds containing halogen atoms, namely, so called silane derivatives substituted with halogen atoms, may be preferably exemplified by silicon halides such as $SiF_4$, $Si_2F_6$, $SiCl_4$, $SiBr_4$, and the like.

When the characteristic photoconductive member of the present invention is formed according to the glow discharge method by employment of such a silicon compound containing halogen atoms, it is possible to form the light receiving layer or the first layer made of a-SiGe containing halogen atoms on a desired substrate without using a silicon hydride gas as the starting gas for Si supply together with the starting gas for Ge supply.

In the case of forming the light receiving layer or the first layer containing halogen atoms according to the glow discharge method, the basic procedure comprises introducing, for example, a silicon halide as the starting gas for Si supply, germanium hydride as the starting gas for Ge supply and a gas such as Ar, $H_2$, He, etc. in a predetermined mixing ratio into a deposition chamber for forming the light receiving layer or the first layer and exciting the glow discharge to form a plasma atmosphere of these gases, whereby the light receiving layer or the first layer can be formed on a desired substrate. On order to control the ratio of hydrogen atoms to be introduced more easily, a hydrogen gas or a gas of a silicon compound containing hydrogen atoms may also be mixed with these gases in a desired amount and used to form the layer.

Also, each gas is not restricted to a single species, but a plurality of species may be available in any desired ratio.

In either case of the sputtering method and the ion-plating method, introduction of halogen atoms into the layer to be formed may be performed by introducing the gas of said halogen compound or said silicon compound containing halogen atoms into a deposition chamber and forming a plasma atmosphere of said gas.

To introduce hydrogen atoms, on the other hand, a starting gas for introduction of hydrogen atoms, for example, $H_2$ or gases such as silanes and/or germanium hydride as mentioned above, may be introduced into a deposition chamber for sputtering, followed by formation of the plasma atmosphere of said gases.

In the present invention, as the starting gas for introduction of halogen atoms, the halogen compounds or halogen-containing silicon compounds as mentioned above can effectively be used. In addition, it is also possible to use effectively as the starting material for formation of the light receiving layer or the first layer gaseous or gasifiable substances, including halides containing hydrogen atom as one of the constituents, e.g. hydrogen halide such as HF, HCl, HBr, HI, etc.; halogen-substituted silicon hydrides such as $SiH_2F_2$, $SiH_2I_2$, $SiH_2Cl_2$, $SiHCl_3$, $SiH_2Br_2$, $SiHBr_3$, etc.; germanium hydride-halides such as $GeHF_3$, $GeH_2F_3$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing hydrogen atoms can preferably be used as the starting material for introduction of halogen atoms, because hydrogen atoms, which are very effective for controlling electrical or photoelectric characteristics, can be introduced into the layer simultaneously with introduction of halogen atoms during formation of the light receiving layer or the first layer.

To introduce hydrogen atoms structurally into the light receiving layer or the first layer, $H_2$ or a silicon hydride such as $SiH_4$, $Si_2H_6$, $Si_3H_8$, $Si_4H_{10}$, etc. together with germanium or a germanium compound for supplying Ge, or germanium hydride such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. and together with silicon or a silicon compound for supplying Si can be introduced into a deposition chamber, followed by excitation of discharging, in addition to those as mentioned above.

According to a preferred embodiment of the present invention, the amount of hydrogen atoms (H) or the amount of halogen atoms (X) or the sum total of the amounts of hydrogen atoms and halogen atoms (H+X) existing in the light receiving layer or the first layer of the photoconductive member is, for the light receiving layer or the first layer comprising a-SiGe(H,X), preferably 0.01 to 40 atomic %, more preferably 0.05 to 30 atomic %, and most preferably 0.1 to 25 atomic %.

When the light receiving layer or the first layer is composed of the first layer region (G) comprising a-Ge(Si,H,X) and the second layer region (S) comprising a-Si(H,X), it is desirable that the amount of hydrogen atoms (H) or the amount of halogen atoms (X) or the sum total of the amounts of hydrogen atoms and halogen atoms (H+X) existing in the first layer region (G) is preferably 0.01 to 40 atomic %, more preferably 0.05 to 30 atomic %, and most preferably 0.1 t0 25 atomic %, and the amount of hydrogen atoms (H) or the amount of halogen atoms (X) or the sum total of the amounts of hydrogen atoms and halogen atoms (H+X) existing in the second layer region (S) is preferably 1 to 40 atomic %, more preferably 5 to 30 atomic %, and most preferably 5 to 25 atomic %.

To control the content of hydrogen atoms (H) and/or halogen atoms (X) existing in the light receiving layer or the first layer, for example, the substrate temperature and/or the introduction rate into the deposition system of the starting materials for adding hydrogen atoms (H) or halogen atoms (X) to the layer, discharging power, etc. may be controlled.

The thickness of the light receiving layer or the first layer is one of important factors for effectively accomplishing the objects of the present invention, and must be carefully selected in designing the photoconductive member to thoroughly give the desired characteristics to the photoconductive member.

In the present invention, when the light receiving layer or the first layer comprises the first layer region (G) and the second layer region (S), the thickness $T_B$ of the first layer region (G) is preferably 30 Å A to 50μ, more preferably 40 Å to 40μ, and most preferably 50 Å A to 30μ.

The thickness T of the second layer region (S) is preferably 0.5 to 90μ, more preferably 1 to 80μ, and most preferably 2 to 50μ.

Sum total of the thickness $T_B$ of the first layer region (G) and the thickness T of the second layer region (S), i.e. $(T_B+T)$ is selected as desired, in designing the photoconductive member in view of mutual organic relationships between the characteristics required for both layer regions and the characteristics required for the whole light receiving layer or the whole first layer.

In the photoconductive member in the present invention, the numerical range for $(T_B+T)$ is preferably 1 to 100μ, more preferably 1 to 80μ, and most preferably 2 to 50μ.

In a more preferable embodiment of the present invention, the thickness $T_B$ and thickness T is selected as desired so as to satisfy a relationship of preferably $T_B/T \leqq 1$, more preferably $T_B/T \leqq 0.9$ and most preferably $T_B/T \leqq 0.8$.

In the present invention, when the light receiving layer or the first layer comprises the first layer region (G) and the second layer region (S) and when the content of germanium atoms existing in the first layer region (G) is $1\times10^5$ atomic ppm or more, the thickness $T_B$ of the first layer region (G) is desirably as small as possible, and is preferably 30μ or less, more preferably 25μ or less, and most preferably 20μ or less.

The thickness of the light receiving layer or the first layer in the photoconductive layer of the present invention can be selected as desired so that the photocarrier generated in the light receiving layer or the first layer can be efficiently transported, and is preferably 1 to 100μ, more preferably 1 to 80μ, and most preferably 2 to 50μ.

In the present invention, the layer region (C) containing carbon atoms can be provided in the light receiving layer or the first layer by using the starting material for introducing the carbon atoms together with the starting material for forming said light receiving layer or the first layer and adding the carbon atoms while controlling their content in the layer, while the light receiving layer or the first layer is formed.

When the glow discharge method is used to form the layer region (C), the starting material for introducing carbon atoms is added to the starting material selected, as desired from those for forming the light receiving layer or the first layer, as mentioned above. As the starting material for introducing carbon atoms, most of gaseous substances or gasified substances of gasifiable ones, which contain at least carbon atoms as the constituent atoms, can be used.

For example, a starting gas containing silicon atoms (Si) as the constituent atoms, a starting gas containing germanium atoms (Ge) as the constituent atoms, or a starting gas containing silicon atoms (Si) as the constituent atoms and a starting gas containing germanium atoms (Ge) as the constituent atoms; and a starting gas containing carbon atoms (C) as the constituent atoms and, if necessary, a starting gas containing hydrogen atoms (H) and/or halogen atoms (X) as the constituent atoms can be used by mixing in a desired mixing ratio, or a starting gas containing silicon atoms (Si) as constituent atoms and a starting gas containing carbon atoms (C) and hydrogen atoms (H) as the constituent atoms can be also used by mixing in a desired mixing ratio, or a starting gas containing silicon atoms (Si) as the constituent atoms and a starting gas containing silicon atoms (Si), carbon atoms (C) and hydrogen atoms (H) as three species of the constituent atoms can be also used by mixing.

Apart from this, a starting gas containing carbon atoms (C) as the constituent atoms can be used by mixing with a starting gas containing silicon atoms (Si) or germanium atoms (Ge) and hydrogen atoms (H) as the constituent atoms.

The starting gas for introduction of carbon atoms (C) may include compounds containing C and H as the constituent atoms such as saturated hydrocarbons containing 1 to 5 carbon atoms, ethylenic hydrocarbons having 2 to 5 carbon atoms, acetylenic hydrocarbons having 2 to 4 carbon atoms, etc.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$).

Apart from these, a starting gas containing Si, C and H as the constituent atoms may include alkyl silicide such as $Si(CH_3)_4$, $Si(C_2H_5)_4$, and the like.

In the present invention, the layer region (C) can further contain oxygen atoms and/or nitrogen atoms, besides the carbon atoms, to further promote the effect obtained by the carbon atoms.

The starting gas for introducing oxygen atoms into the layer region (C) includes, for example, oxygen ($O_2$), ozone ($O_3$), nitrogen monooxide (NO), nitrogen dioxide ($N0_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane ($H_3SiOSiH_3$), trisiloxane ($H_3SiOSiH_2OSiH_3$), and the like.

As the starting material effectively used as the starting gas for introduction of nitrogen atoms (N) during formation of the layer region (C), it is possible to use compounds containing N as the constituent atoms or compounds containing N and H as the constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$), and so on. Alternatively, with the advantage of introducing halogen atoms (X) in addition to nitrogen atoms (N), nitrogen halide compounds such as nitrogen trifluoride ($F_3N$), dinitrogen tetrafluoride ($F_4N_2$), and the like may be also used.

To form the layer region (C) according to the sputtering method, Si wafer or Ge wafer and C wafer of single crystal or polycrystal, or a wafer containing Si and/or Ge and C as a mixture is used as a target for sputtering in various gas atmospheres during formation of the light receiving layer or the first layer.

For example, when a Si wafer is used as the target, a starting gas for introducing carbon atoms and, if necessary, hydrogen atoms and/or halogen atoms is introduced, as diluted with a dilution gas if necessary, into a deposition chamber for sputtering, and a gas plasma of these gases is formed to sputter said Si wafer.

Apart from this, the sputtering of separate targets of Si and C or a single target of Si and C as a mixture can be carried out in an atmosphere of a dilution gas or in a gas atmosphere containing at least hydrogen atoms (H) and/or halogen atoms (X) as the constituent atoms as a gas for sputtering. As the starting gas for introducing carbon atoms, a starting gas for introducing carbon atoms shown in said example of starting gases for the glow discharge method can be used effectively also for the sputtering.

In the present invention, when the layer region (C) containing carbon atoms is provided in the light receiving layer or the first layer, the layer region (C) having a desired depth profile in the layer thickness direction is formed by changing the content C of carbon atoms existing in the layer region (C) in the layer thickness direction.

According to the glow discharge method the content C is changed by introducing into a deposition chamber a gas of the starting material for introducing carbon atoms, while appropriately changing the gas flow rate according to a desired change rate curve.

This can be done, for example, by gradually changing the opening of a given needle valve provided in the gas line by the ordinary means, for example, manually or by an outside driving motor, or the like. In that case, the change rate for the flow rate is not necessarily linear, but the flow rate can be controlled according to a predetermined change rate curve by means of, for example, a microcomputer, etc. to obtain the desired content curve.

When the layer region (C) is formed according to the sputtering method by changing the content C of carbon atoms in the layer thickness direction, thereby obtaining a desired depth profile of carbon atoms in the layer thickness direction, the desired depth profile can be obtained firstly by using a gaseous starting material for introducing carbon atoms as in the case of the glow discharging method, and appropriately changing the gas flow rate as desired during introduction of the gas into a deposition chamber.

Secondly, when a target for sputtering, for example, a target of Si and C as a mixture, is used, the desired depth profile can be obtained by changing a mixing ratio of Si to C in the layer thickness direction of the target in advance.

The substance capable of controlling the conductive characteristics, for example, the group III atoms or the group V atoms, can be structurally introduced into the light receiving layer or the first layer by introducing a gaseous starting material for introducing the group III atoms or a gaseous starting material for introducing the group V atoms into a deposition chamber together with other starting materials for forming the light receiving layer or the first layer during formation of the layer. As the starting material for introduction of the group III atoms, it is desirable to use those which are gaseous at room temperature under atmospheric pressure or can readily be gasified at least under layer forming conditions. Typical examples of such starting materials for introduction of the group III atoms may include, particularly the compounds for introduction of boron atoms, boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Furthermore, it is also possible to use $AlCl_3$, $GeCl_3$, $Ge(CH_3)_3$, $InCl_3$, $TlCl_3$, and the like.

The starting materials which can effectively be used in the present invention for introduction of the group V atoms may include, for introduction of phosphorus atoms, phosphorus hydride such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$, and the like. Furthermore, it is also possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, and the like effectively as the starting material for introduction of the group V atoms.

The layer thickness of the layer region which constitutes the light receiving layer or the first layer and contains a substance capable of controlling the conductive characteristics and which is provided particularly toward the substrate side in the present invention can be selected as desired in view of the characteristics required for said layer region and other layer region formed on said layer region also to constitute the light receiving layer or the first layer. It is desired that its lower limit is preferably 30Å or more, more preferably 40Å or more, and most preferably 50Å or more.

When the content of a substance existing in said layer region to control the conductive characteristics is 30 atomic ppm or more, it is desired that the upper limit to the thickness of said layer region is preferably 10μ or less, more preferably 8μ or less, and most preferably 5μ or less.

According to the present invention, when the light receiving layer or the first layer formed on the substrate of the photoconductive member comprises a first layer comprising a-SiGe(H,X) as explained above and containing carbon atoms, or a first layer composed of the first layer region (G) comprising a-Ge(Si,H,X) and the second layer region (S) comprising a-Si(H,X) provided successively from the substrate side and containing carbon atoms, and a second layer laminated on the first layer, the second layer has a free surface and is provided for the purpose of improving mainly humidity resistance, continuous repeated use characteristics, dielectric strength, use environmental characteristics and durability to achieve the objects of the present invention.

The second layer is constituted of an amorphous material composed of silicon atoms as a matrix and containing at least one of nitrogen atoms and oxygen atoms. In the present invention, the respective amorphous materials constituting the first layer and the second layer have the common constituent of silicon atoms, and therefore chemical stability can be sufficiently ensured at the laminated interface between both layers. As a material constituting the second layer, for example, there may be mentioned preferably an amorphous material comprising silicon atoms (Si), nitrogen atoms (N), and, if desired, hydrogen atoms (H) and/or halogen atoms [hereinafter referred to as "a-$(Si_xN_{1-x})_y(H,X)_{1-y}$" where $0<x, y<1$].

When the second layer is composed of a-$(Si_xN_{1-x})_y(H,X)_{1-y}$, second layer (II) 103 may be formed according to the glow discharge method, the sputtering method, the electron beam method, etc. These preparation methods may be suitably selected in view of various factors such as the preparation conditions, the extent of the load for capital intestment for installations, the production scale, the desirable characteristics required for the photoconductive member to be prepared, etc. With the advantages of relatively easy control of the preparation conditions for preparing photoconductive members having desired characteristics and easy introduction of silicon atoms, nitrogen atoms and halogen atoms into the second layer to be prepared, the glow discharge method or the sputtering method is preferably employed.

Further, in the present invention, the glow discharge method and the sputtering method may be used in combination in the same system to form the second layer.

For formation of the second layer according to the glow discharge method, starting gases for formation of a-$(Si_xN_{1-x})_y(H,X)_{1-y}$, which may, if necessary, be mixed with a dilution gas in a predetermined mixing ratio, may be introduced into a deposition chamber for vacuum deposition in which a substrate is placed, and glow discharge is excited in said deposition chamber to form gas plasma, thereby depositing a-$(Si_xN_{1-x})_y(H,X)_{1-y}$ on the first layer already formed on the substrate.

In the present invention, the starting gases for formation of a-$(Si_xN_{1-x})_y(H,X)_{1-y}$ may be exemplified by most of substances containing at least one of silicon atoms, nitrogen atoms, hydrogen atoms and halogen atoms as constituent atoms which are gaseous or gasified substances of readily gasifiable ones.

When employing a starting gas containing silicon atoms as constituent atoms as one of silicon atoms, nitrogen atoms, hydrogen atoms and halogen atoms, a mixture of a starting gas containing silicon atoms as constituent atom, a starting gas containing nitrogen atoms as constituent atom and optionally a starting gas containing hydrogen atom as constituent atom or/and a starting gas containing halogen atom as constituent atom at a desired mixing ratio, or a mixture of a starting gas containing silicon atoms as constituent atom and a starting gas containing nitrogen atoms and hydrogen atoms or/and a starting gas containing nitrogen atoms and halogen atoms as constituent atoms also at a desired ratio, or a mixture of a starting gas containing silicon atoms as constituent atom and a starting gas containing three constituent atoms of silicon atoms, nitrogen atoms and hydrogen atoms or a starting gas containing three constituent atoms of silicon atoms, nitrogen atoms and halogen atoms may be used.

Alternatively, it is also possible to use a mixture of a starting gas containing silicon atoms and hydrogen atoms as constituent atoms with a starting gas containing nitrogen atoms as constituent atom or a mixture of a starting gas containing silicon atoms and halogen atoms as constituent atoms and a starting gas containing nitrogen atoms as constituent atom.

In the present invention, the halogen atoms, which can be contained, if necessary, in the second layer, may include, for example, fluorine, chlorine, bromine, and iodine, among which fluorine and chlorine are particularly preferable.

In the present invention, the starting gas as which can be effectively used for formation of second layer may include those which are gaseous under conditions of room temperature and atmospheric pressure or can be readily gasified.

Formation of the second layer constituted of these amorphous materials may be performed according to the glow discharge method, the sputtering method, the ion-implantation method, the ion-plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of nitrogen atoms, and, if desired, hydrogen atom and halogen atoms with silicon atoms into the second layer to be prepared, there may preferably be employed the glow discharge method or the sputtering method.

Further, in the present invention, the glow discharge method and the sputtering method may be used in combination in the same device system to form the second layer For forming the second layer made of a-Si(H,X) according to the glow discharge method, the basic procedure comprises introducing a starting gas for Si supply capable of supplying silicon atoms and a starting gas for N supply capable of supplying nitrogen atoms, and, if necessary, a starting gas for introduction of hydrogen atoms and/or a starting gas for introduction of halogen atoms into a deposition chamber which can be internally brought to a reduced pressure, and exciting glow discharge in said deposition chamber, thereby forming the second layer made of a-Si(H,X) on the first layer placed at a predetermined position.

Formation of the second layer according to the sputtering method may be practiced as follows.

In the first place, when a target constituted of silicon atoms is subjected to sputtering in an atmosphere of an inert gas such as Ar, He, etc. or a gas mixture based on these gases, a starting gas for introduction of nitrogen atoms may be introduced, optionally together with starting gases for introduction of hydrogen atoms and/or halogen atoms, into a vacuum deposition chamber for carrying out sputtering.

In the second place, nitrogen atoms can be introduced into the second layer formed by the use of a target constituted of $Si_3N_4$, or two sheets of a target constituted of silicon atoms and a target constituted of $Si_3N_4$, or a target constituted of silicon atoms and $Si_3N_4$. In this case, if the starting gas for introduction of nitrogen atoms as mentioned above is used in combination, the amount of nitrogen atoms to be incorporated in the second layer can easily be controlled as desired by controlling the flow rate thereof.

The amount of nitrogen atoms to be incorporated into the second layer can be controlled as desired by controlling the flow rate of the starting gas for introduction of nitrogen atoms, adjusting the ratio of nitrogen atoms in the target for introduction of nitrogen atoms during preparation of the target, or performing both of these.

The starting gas for supplying silicon atoms to be used in the present invention may include gaseous or gasifiable hydrogenated silicons (silanes) such as $SiH_4$, $Si_2H_6$, $Si_3H_8$, $Si_4H_{10}$, and others as effective materials. In particular, $SiH_4$ and $Si_2H_6$ are preferred with respect to each handling during layer formation and efficiency for supplying silicon atoms.

By the use of these starting materials, hydrogen atoms can also be incorporated together with silicon atoms in the second layer formed by adequate choice of the layer forming conditions.

As the starting materials effectively used for supplying silicon atoms, in addition to the hydrogenated silicons as mentioned above, there may be included silicon compounds containing halogen atoms, namely the so called silane derivatives substituted with halogen atoms, including silicon halogenide such as $SiF_4$, $Si_2F_6$, $SiCl_4$, $SiBr_4$, etc., as preferable ones.

Further, halides containing hydrogen atoms as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_2Br_2$, $SiHBr_3$, etc. may also be mentioned as the effective starting materials for supplying silicon atoms for formation of the second layer.

Also, in the case of employing a silicon compound containing halogen atoms, halogen atoms can be introduced together with silicon atoms in the second layer formed by suitable choice of the layer forming conditions as mentioned above.

Among the starting materials described above, silicon halogenide compounds containing hydrogen atoms are used as preferable starting material for introduction of halogen atoms in the present invention since, during the formation of the second layer, hydrogen atoms, which are extremely effective for controlling electrical or photoelectric characteristics, can be incorporated together with halogen atoms into the layer.

Effective starting materials to be used as the starting gases for introduction of halogen atoms in the formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc. and hydrogen halides such as HF, HCl HBr, HI, etc.

The starting material effectively used as the starting gas for introduction of nitrogen atoms to be used during formation of the second layer, it is possible to use compounds containing nitrogen atoms as constituent atom or compounds containing nitrogen atoms and hydrogen atoms as constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$), and so on. Alternatively, for the advantage of introducing halogen atoms in addition to nitrogen atoms, there may be also employed nitrogen halide compounds, as the starting material, such as nitrogen trifluoride ($F_3N$), dinitrogen tetrafluoride ($F_4N_2$) and the like.

In the present invention, as the diluting gas to be used in formation of the second layer by the glow discharge method or the sputtering method, there may be included the so called rare gases such as He, Ne, and Ar as preferable ones.

The second layer in the present invention should be carefully formed so that the required characteristics may be given exactly as desired.

That is, the above material containing silicon atoms and nitrogen atoms, optionally together with hydrogen atoms and/or halogen atoms as constituent atoms can take various forms from crystalline to amorphous and show electrical properties from conductive through semi-conductive to insulating and photoconductive properties from photoconductive to non-photoconductive depending on the preparation conditions. Therefore, in the present invention, the preparation conditions are strictly selected as desired so that there may be formed a-$(Si_xN_{1-x})_y(H,X)_{1-y}$ having desired characteristics depending on the purpose.

For example, when the second layer is to be provided primarily for the purpose of improvement of dielectric strength, a-$(Si_xN_{1-x})_y(H,X)_{1-y}$ is prepared as an amorphous material having marked electric insulating behaviours under the use environment.

Alternatively, when the primary purpose for provision of the second layer is improvement of continuous repeated use characteristics or environmental use characteristics, the degree, of the above electric insulating property may be alleviated to some extent and a-$(Si_xN_{1-x})_y(H,X)_{1-y}$ may be prepared as an amorphous material having sensitivity to some extent to the light irradiated.

In forming the second layer (II) 103 constituted of a-$(Si_xN_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that a-$(Si_xN_{1-x})_y(H,X)_{1-y}$ having intended characteristics may be prepared as desired. As the substrate temperature in forming the second layer for accomplishing effectively the objects in the present invention, there may be selected suitably the optimum temperature range in confirmity with the method for forming the second layer in carrying out formation of the second layer, preferably 20° to 400° C., more preferably 50° to 350° C., most preferably 100° to 300° C.

For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to these layer forming methods, the discharging power during layer formation is one of important factors influencing the characteristics of a-$(Si_xN_{1-x})_y(H,X)_{1-y}$ to be prepared, similarly as the aforesaid substrate temperature.

The discharging power condition for preparing effectively a-$(Si_xN_{1-x})_y(H,X)_{1-y}$ having characteristics for accomplishing the objects of the present invention with good productivity may preferably be 1.0 to 300 W, more preferably 2.0 to 250 W, most preferably 5.0 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature and discharging power for preparation of the second layer. However, these factors for layer formation should not be determined separately independently of each other, but it is desirable that the optimum values of respective layer forming factors should be determined based on mutual organic relationships so that the second layer constituted of a-$(Si_xN_{1-x})_y(H,X)_{1-y}$ having desired characteristics may be formed.

The content of nitrogen atoms in the second layer in the photoconductive member of the present invention are important factors for obtaining the desired characteristics to accomplish the objects of the present invention, similarly as the conditions for preparation of the second layer. The content of nitrogen atoms in the second layer according to the present invention are determined as desired depending on the amorphous material constituting the second layer and its characteristics.

More specifically, the amorphous material represented by the above formula a-$(Si_xN_{1-x})_y(H,X)_{1-y}$ may be broadly classified into an amorphous material constituted of silicon atoms and nitrogen atoms (hereinafter written as "a-$Si_aN_{1-a}$", where $0<a<1$), an amorphous material constituted of silicon atoms, nitrogen atoms and hydrogen atoms [hereinafter written as a-$(Si_bN_{1-b})_cH_{1-c}$, where $0<b, c<1$] and an amorphous material constituted of silicon atoms, nitrogen atoms, halogen atoms and optionally hydrogen atoms [hereinafter written as "a-$(Si_dN_{1-d})_e(H,X)_{1-e}$", where $0<d, e<1$].

In the present invention, when the second layer is to be constituted of a-$Si_aN_{1-a}$, the content of nitrogen atoms in the second layer may generally be $1\times10^{-3}$ to 60 atomic %, more preferably 1 to 50 atomic %, most preferably 10 to 45 atomic %, namely in terms of representation by a in the above a-$Si_aN_{1-a}$, a being preferably 0.4 to 0.99999, more preferably 0.5 to 0.99, most preferably 0.55 to 0.9.

In the present invention, when the second layer is to be constituted of a-$(Si_bN_{1-b})_cH_{1-c}$, the content of nitrogen atoms in the second layer may preferably be $1\times10^{-3}$ to 55 atomic %, more preferably 1 to 55 atomic %, most preferably 10 to 55 atomic %, the content of hydrogen atoms preferably 1 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bN_{1-b})_cH_{1-c}$, b should preferably be 0.45 to 0.99999, more preferably 0.45 to 0.99, most preferably 0.45 to 0.9, and c preferably 0.6 to 0.99, more preferably 0.65 to 0.98, most preferably 0.7 to 0.95.

When the second layer to be constituted of a-$(Si_dN_{1-d})_e(H,X)_{1-e}$, the content of nitrogen atoms in the second layer may preferably be $1\times10^{-3}$ to 60 atomic %, more preferably 1 to 60 atomic %, most preferably 10 to 55 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical aspect. The content of hydrogen atoms optionally contained may preferably be 19 atomic % or less, more preferably 13 atomic % or less.

That is, in terms of representation by d and e in the above a-$(Si_dN_{1-d})_e(H,X)_{1-e}$, d should preferably be 0.4 to 0.99999, more preferably 0.4 to 0.99, most preferably 0.45 to 0.9, and e preferably 0.8 to 0.99999, more preferably 0.82 to 0.99, most preferably 0.85 to 0.98.

The range of the numerical value of the layer thickness of the second layer is one of the important factors to effectively accomplish the objects of the present invention. The layer thickness of the second layer should desirably be determined depending on the intended purpose so as to effectively accomplish the objects of the present invention. The layer thickness is also required to be determined as desired suitably with due considerations about the relationships with the content of nitrogen atoms, the relationship with the layer thickness of the first layer, as well as other organic relationships with the characteristics required for respective layer regions. In addition, the layer thickness is also desirable to have considerations from economical point of view such as productivity or capability of mass production.

The second layer in the present invention is desired to have a layer thickness preferably of 0.003 to 30μ, more preferably 0.004 to 20μ, most preferably 0.005 to 10μ.

Next, as an another preferable material constituting the second layer, there may include an amorphous material containing silicon atoms and oxygen atoms, optionally together with hydrogen atoms and/or halogen atoms [hereinafter written as "a-$(Si_xO_{1-x})_y(H,X)_{1-y}$", wherein $0<x, y<1$].

Formation of the second layer (II) 103 constituted of a-$(Si_xO_{1-x})_y(H,X)_{1-y}$ may be performed according to the glow discharge method, the sputtering method, the ion-implantation method, the ion-plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of oxygen atoms and halogen atoms with silicon atoms into the second amorphous layer to be prepared, there may preferably be employed the glow discharge method or the sputtering method.

Further, in the present invention, the glow discharge method and the sputtering method may be used in combination in the same device system to form the second layer.

For formation of the second layer according to the glow discharge method, starting gases for formation of a-$(Si_xO_{1-x})_y(H,X)_{1-y}$, which may optionally be mixed with a diluting gas at a predetermined mixing ratio, may be introduced into a deposition chamber for vacuum deposition in which a substrate is placed, and glow discharge is excited in said deposition chamber to form the gases introduced into a gas plasma, thereby depositing a-$(Si_xO_{1-x})_y(H,X)_{1-y}$ on the first layer(I) already formed on the substrate.

In the present invention, as starting gases for formation of a-$(Si_xO_{1-x})_y(H,X)_{1-y}$, there may be employed most of substances containing at least one of silicon atoms, oxygen atoms, hydrogen atoms, and halogen atoms as constituent atoms which are gaseous or gasified substances of gasifiable ones.

For example, it is possible to use a mixture of a starting gas containing silicon atoms as constituent atom, a starting gas containing oxygen atoms as constituent atom, and optionally a starting gas containing hydrogen atoms as constituent atom and/or a starting gas containing halogen atoms as constituent atom at a desired mixing ratio, or a mixture of a starting gas containing silicon atoms as constituent atom and a starting gas containing oxygen atoms and hydrogen atoms as constituent atoms and/or a starting gas containing oxygen atoms and halogen atoms as constituent atoms also at a desired ratio, or a mixture of a starting gas containing silicon atoms as constituent atom and a starting gas containing three constituent atoms of silicon atoms, oxygen atoms and halogen atoms or a starting gas containing three constituent atoms of silicon atoms, oxygen atoms and halogen atoms.

Alternatively, it is also possible to use a mixture of a starting gas containing silicon atoms and hydrogen atoms as constituent atoms with a starting gas containing oxygen atoms as constituent atom or a mixture of a starting gas containing silicon atoms and halogen atoms as constituent atoms and a starting gas containing oxygen atoms as constituent atom.

In the present invention, suitable halogen atoms (X) contained in the second layer are fluorine, chlorine, bromine, and iodine, particularly preferable fluorine and chlorine.

In the present invention, the starting gas which can be effectively used for formation of the second layer may include those which are gaseous under conditions of room temperature and atmospheric pressure or can be readily gasified.

Formation of the second layer according to the sputtering method may be practiced as follows.

In the first place, when a target constituted of silicon atoms is subjected to sputtering in an atmosphere of an inert gas such as Ar, He, etc. or a gas mixture based on these gases, a starting gas for introduction of oxygen atoms may be introduced, optionally together with starting gases for introduction of hydrogen atoms and/or halogen atoms, into a vacuum deposition chamber for carrying out sputtering.

In the second place, oxygen atoms can be introduced into the second layer formed by the use of a target constituted of $SiO_2$, or two sheets of a target constituted of silicon atoms and a target constituted of $SiO_2$, or a target constituted of silicon atoms and $SiO_2$. In this case, if the starting gas for introduction of oxygen atoms as mentioned above is used in combination, the amount of oxygen atoms to be incorporated in the second layer can easily be controlled as desired by controlling the flow rate thereof.

The amount of oxygen atoms to be incorporated into the second layer can be controlled as desired by controlling the flow rate of the starting gas for introduction of oxygen atoms, adjusting the ratio of oxygen atoms in the target for introduction of oxygen atoms during preparation of the target, or performing both of these.

The starting gas for supplying silicon atoms to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to each handling during layer formation and efficiency for supplying silicon atoms.

By the use of these starting materials, hydrogen atoms can also be incorporated together with silicon atoms in the second layer formed by adequate choice of the layer forming conditions.

As the starting materials effectively used for supplying silicon atoms, in addition to the hydrogenated silicons as mentioned above, there may be included silicon compounds containing halogen atoms, namely the so called silane derivatives substituted with halogen atoms, including silicon halogenide such as $SiF_4$, $Si_2F_6$, $SiCl_4$, $SiBr_4$, etc., as preferable ones. Further, halides containing hydrogen atoms as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_2Br_2$, $SiHBr_3$, etc. may also be mentioned as the effective starting materials for supplying silicon atoms for formation of the second layer.

Also, in the case of employing a silicon compound containing halogen atoms, halogen atoms can be introduced together with silicon atoms in the second layer formed by suitable choice of the layer forming conditions as mentioned above.

Among the starting materials described above, silicon halogenide compounds containing hydrogen atoms are used as preferable starting material for introduction of halogen atoms in the present invention since, during the formation of the second layer, hydrogen atoms, which are extremely effective for controlling electrical or photoelectric characteristics, can be incorporated together with halogen atoms into the layer.

Effective starting materials to be used as the starting gases for introduction of halogen atoms in formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc. and hydrogen halides such as HF, HCl, HBr, HI, etc.

As the starting material effectively used as the starting gas for introduction of oxygen atoms (0) to be used during the formation of the second layer (II), there may be used compounds containing oxygen atoms as constituent atoms or compounds containing nitrogen atoms and oxygen atoms as constituent atoms, such as oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms, oxygen atoms and hydrogen atoms as constituent atoms such as disiloxane ($H_3SiOSiH_3$), trisiloxane ($H_3SiOSiH_2OSiH_3$), and the like.

In the present invention, as the diluting gas to be used in formation of the second layer by the glow discharge method or the sputtering method, there may be included the so called rare gases such as He, Ne and Ar as preferable ones.

The second layer in the present invention should be carefully formed so that the required characteristics may be given exactly as desired.

That is, the above material containing silicon atoms and oxygen atoms, optionally together with hydrogen atoms and/or halogen atoms as constituent atoms can take various forms from crystalline to amorphous and show electrical properties from conductive through semi-conductive to insulating and photoconductive properties from photoconductive to non-photoconductive depending on the preparation conditions. Therefore, in the present invention, the preparation conditions are strictly selected as desired so that there may be formed a-$(Si_xO_{1-x})_y(H,X)_{1-y}$ having desired characteristics depending on the purpose. For example, when the second layer is to be provided primarily for the purpose of improvement of dielectric strength, a-$(Si_xO_{1-x})_y(H,X)_{1-y}$ is prepared as an amorphous material having marked electric insulating behaviour under the use environment.

Alternatively, when the primary purpose for provision of the second layer is improvement of continuous repeated use characteristics or environmental use characteristics, the degree of the above electric insulating property may be alleviated to some extent and a-$(Si_xO_{1-x})_y(H,X)_{1-y}$ may be prepared as an amorphous material having sensitivity to some extent to the light irradiated.

In forming the second layer constituted of a-$(Si_xO_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that a-$(Si_xO_{1-x})_y(H,X)_{1-y}$ having intended characteristics may be prepared as desired. As the substrate temperature in forming the second layer for accomplishing effectively the objects in the present invention, there may be selected suitably the optimum temperature range in conformity with the method for forming the second layer in carrying out formation of the second layer, preferably 20° to 400° C., more preferably 50° to 350° C., most preferably 100° to 300° C.

For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to these layer forming methods, the discharging power during layer formation is one of important factors influencing the characteristics of a-$(Si_xO_{1-x})_yX_{1-y}$ to be prepared, similarly to the aforesaid substrate temperature.

The discharging power condition for preparing effectively a-$(Si_xO_{1-x})_yX_{1-y}$ having characteristics for accomplishing the objects of the present invention with good productivity may preferably be 10 to 300 W, more preferably 20 to 250 W, most preferably 50 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second layer. However, these factors for layer formation should not be determined separately independently of each other, but it is desirable that the optimum values of respective layer forming factors should be determined based on mutual organic relationships so that the second layer constituted of a-$(Si_xO_{1-x})_y(H,X)_{1-y}$ having desired characteristics may be formed.

The content of oxygen atoms in the second layer in the photoconductive member of the present invention are important factors for obtaining the desired characteristics to accomplish the objects of the present invention, similarly to the conditions for preparation of the second layer. The content of oxygen atoms contained in the second layer in the present invention are determined as desired depending on the amorphous material constituting the second layer and its characteristics.

More specifically, the amorphous material represented by the above formula a-$(Si_xO_{1-x})_y(H,X)_{1-y}$ may be broadly classified into an amorphous material constituted of silicon atoms and oxygen atoms (hereinafter written as "a-$Si_aO_{1-a}$", where $0<a<1$), an amorphous material constituted of silicon atoms, oxygen atoms and hydrogen atoms [hereinafter written as a-$(Si_bO_{1-b})_cH_{1-c}$, where $0<b, c<1$] and an amorphous material constituted of silicon atoms, oxygen atoms, halogen atoms and optionally hydrogen atoms [hereinafter written as "a-$(Si_dO_{1-d})_e(H,X)_{1-e}$", where $0<d, e<1$].

In the present invention, when the second layer is to be constituted of a-$Si_aO_{1-a}$, the content of oxygen atoms in the second layer 103 may preferably be such that a in the above a-$Si_aO_{1-a}$ be preferably 0.33 to 0.99999, more preferably 0.5 to 0.99, most preferably 0.6 to 0.9.

In the present invention, when the second layer (II) is to be constituted of a-$(Si_bO_{1-b})_cH_{1-c}$, the content of oxygen atoms in the second layer (II) may preferably be such that b in the above a-$(Si_bO_{1-b})_cH_{1-c}$ be preferably 0.33 to 0.99999, more preferably 0.5 to 0.99, most preferably 0.6 to 0.9, and c preferably 0.6 to 0.99, more preferably 0.65 to 0.98, most preferably 0.7 to 0.95.

When the second layer is to be constituted of a-$(Si_dO_{1-d})_e(H,X)_{1-e}$, the content of oxygen atoms in the second layer may preferably be such that d in the above a-$(Si_dO_{1-d})_e(H,X)_{1-e}$ be preferably 0.33 to 0.99999, more preferably 0.5 to 0.99, most preferably 0.6 to 0.9, and e preferably 0.8 to 0.99, more preferably 0.82 to 0.99, most preferably 0.85 to 0.98.

Hydrogen atoms based on the sum of hydrogen atoms and halogen atoms may preferably be 90 atomic % or less, more preferably 80 atomic % or less, most preferably 70 atomic % or less.

The range of the layer thickness of the second layer is one of the important factors to effectively accomplish the objects of the present invention.

The layer thickness of the second layer should desirably be determined depending on the intended purpose so as to effectively accomplish the objects of the present invention.

The layer thickness of the second layer is also required to be determined as desired suitably with due considerations about the relationships with the contents of oxygen atoms, the relationship with the layer thickness of the first layer, as well as other organic relationships with the characteristics required for respective layer regions.

In addition, the layer thickness is also desirable to have considerations from economical point of view such as productivity or capability of bulk production.

The second layer (II) 103 in the present invention is desired to have a layer thickness preferably of 0.003 to 30μ, more preferably 0.004 to 20μ, most preferably 0.005 to 10μ.

In the present invention, nitrogen atoms together with oxygen atoms may be contained in the second layer to heighten further the effect of oxygen. As the starting material effectively used as the starting gas for introduction of nitrogen atoms to be used during formation of the second layer, it is possible to use compounds containing nitrogen atoms as constituent atom or compounds containing nitrogen atoms and hydrogen atoms as constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), dinitrogen tetrafluoride ($F_4N_2$) and the like.

The substrate to be used in the present invention may be either electroconductive material or insulating material. As the electroconductive material, there may be mentioned metals such as NiCr, stainless steel, Al, Cr, Mo, Au, Nb, Ta, V, Ti, Pt, Pd, etc. or alloys thereof.

As the insulating material, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The substrate may have a thickness, which is conventionally determined so that a photoconductive member as desired may be formed. When the photoconductive member is required to have a flexibility, the substrate is made as thin as possible, so far as the function of a substrate can be sufficiently exhibited. However, in such a case, the thickness is preferably 10μ or more from the points of fabrication and handling of the substrate as well as its mechanical strength.

Next, an example of the process for producing the photoconductive member of this invention is to be briefly described.

Figure 17:
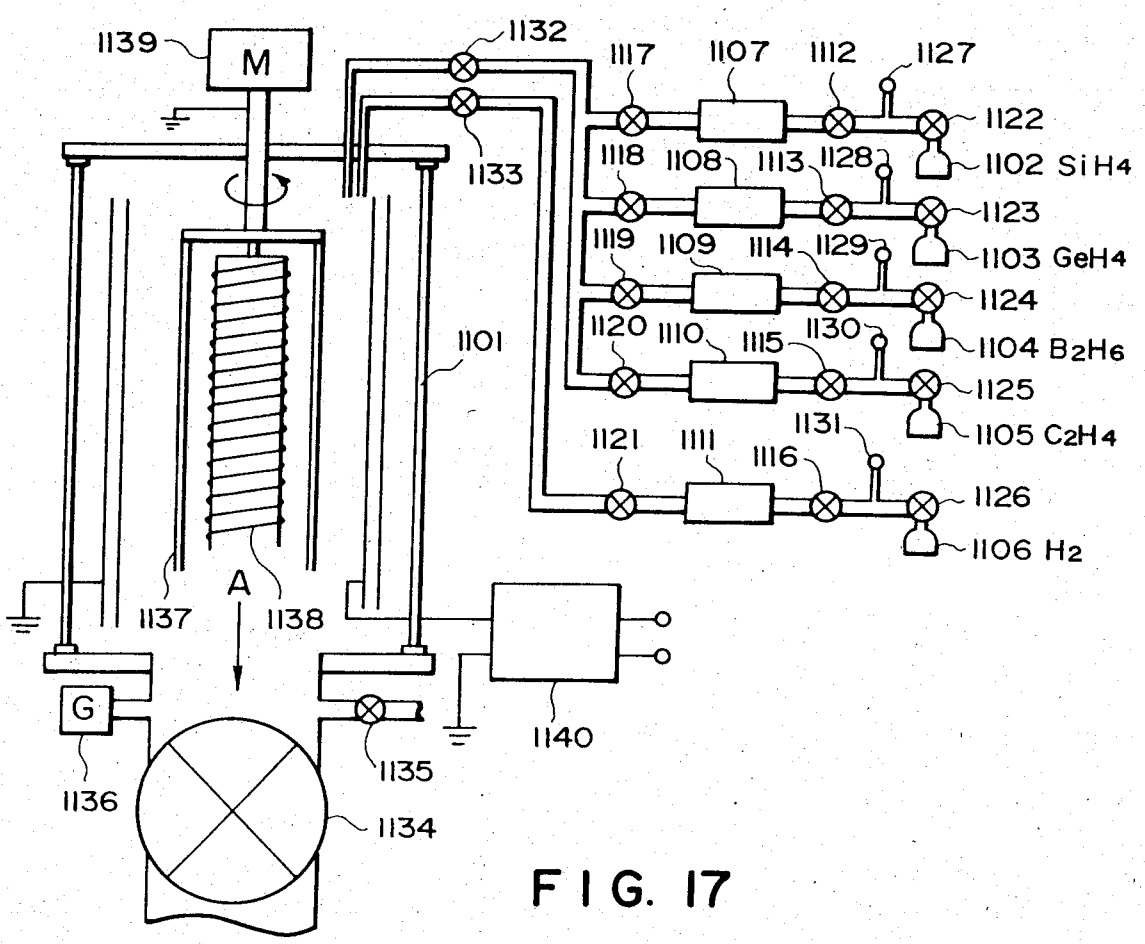
FIG. 17 is a schematic view of an apparatus used in the present invention.

FIG. 17 shows one example a device for producing a photoconductive member.

In the gas bombs 1102 to 1106, there are hermetically contained starting gases for formation of the photosensitive member of the present invention. For example, 1102 is a bomb containing $SiH_4$ gas diluted with He (purity: 99.999%, hereinafter abbreviated as $SiH_4$/He), 1103 is a bomb containing $GeH_4$ gas diluted with He (purity: 99.999%, hereinafter abbreviated as $GeH_4$/He), 1104 is a bomb containing $B_2H_6$ gas diluted with He (purity: 99.99%, hereinafter abbreviated as $B_2H_6$/He), 1105 is a bomb containing $C_2H_4$ gas (purity: 99.999%) and 1106 is a bomb containing $H_2$ gas (purity: 99.999%).

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132, 1133 and the outflow valves 1117–1121 are closed.

Referring now to an example of forming a light receiving layer on the cylindrical substrate 1137, $SiH_4$/He gas from the gas bomb 1102, $GeH_4$/He gas from the gas bomb 1103, and $C_2H_4$ gas from the gas bomb 1105 are permitted to flow into the massflow controllers 1107, 1108 and 1110 respectively, by opening the valves 1122, 1123 and 1125 and controlling the pressures at the outlet pressure gauges 1127, 1128 and 1130 to 1 $Kg/cm^2$ and opening gradually the inflow valves 1112, 1113 and 1115 respectively. Subsequently, the outflow valves 1117, 1118, 1120 and the auxiliary valve 1132 are gradually opened to permit respective gases to flow into the reaction chamber 1101. The outflow valves 1117, 1118 and 1120 are controlled so that the flow rate ratio of $SiH_4$/He, $GeH_4$/He, and $C_2H_4$ gas may have a desired value and opening of the main valve 1134 is also controlled while watching the reading on the vacuum indicator 1136 so that the pressure in the reaction chamber may reach a desired value.

After confirming that the temperature of the substrate 1137 is set at about 50°–about 400° C. by heater 1138, power source 1140 is set at a desired power to excite glow discharge in the reaction chamber 1101, and at the same time the flow rates of the $C_2H_4$ gas and the $GeH_4$/He gas are controlled according to a predetermined change rate curve by gradually changing the opening of the valve 1118 manually or by an outside driving motor, or by other means, thereby controlling the contents of carbon atoms and germanium atoms existing in the layer thus formed. In this manner, the light receiving layer constituted of a-SiGe(H,X) is formed.

Alternatively, when the light receiving layer is constituted of the first layer region (G) and the second layer region (S), $SiH_4$/He gas from the gas cylinder 1102, $GeH_4$/He gas from the gas cylinder 1103, $C_2H_4$ gas from the gas cylinder 1105 are led into mass-flow controllers 1107, 1108, and 1110, respectively, by opening the valves 1122, 1123 and 1125 and controlling the pressures at outlet pressure gauges 1127, 1128 and 1130 to 1 $Kg/cm^2$ respectively and gradually opening the inflow valves 1112, 1113 and 1115, respectively. Successively, the outflow valves 1117, 1118 and 1120 and the auxiliary valve 1132 are gradually opened to lead respective gases into the reaction chamber 1101. The outflow valves 1117, 1118 and 1120 are so controlled that the flow rate ratio of the $SiH_4$/He gas, the $GeH_4$/He gas and the $C_2H_4$ gas may have a desired value and opening of the main valve 1134 is also adjusted while watching the vacuum indicator 1136 so that the pressure in the reaction chamber 1101 may reach a desired value. After confirming that the temperature of the substrate 1137 is set at 50°–400° C. by heater 1138, power source 1140 is set at a desired power to excite glow discharge in the reaction chamber 1101, and at the same time the flow rates of the $C_2H_4$ gas and the $GeH_4$/He gas are controlled according to a predetermined change rate curve by gradually changing the opening of the valve 1118 and 1120 manually or by an outside driving motor, or by other means, thereby controlling the contents of carbon atoms and germanium atoms existing in the layer thus formed.

As described above, the first layer region layer is formed to a desired layer thickness on the substrate 1137 by maintaining the glow discharge for a desired period of time. At the stage when the layer region (G) is formed to a desired thickness, and then following the same conditions and the procedure except for completely closing the outflow valve 1118 and changing the discharging conditions, if desired, glow discharging is maintained for a desired period of time, whereby the second layer region (S) containing substantially no germanium atom can be formed on the first layer region (G).

For incorporating a substance (C) for controlling the conductivity into the light receiving layer, the first layer region (G) and the second layer region (S), gases such as $B_2H_6$, $PH_3$, etc. may be added to the gases to be introduced into the deposition chamber 1101 during formation of the first layer region (G) and the second layer region (S).

When a second layer is formed on the first layer as prepared above to form a light receiving layer in combination, formation of the second layer may be conducted according to the same valve operation as in formation of the first layer.

During this operation, $NH_3$ gas bomb or NO gas bomb is newly provided or substituted for the bomb not employed, and the respective gases of $SiH_4$ gas, $NH_3$ gas or $SiH_4$ gas, NO gas may be diluted optionally with a diluting gas such as He, and the second layer can be formed by exciting glow discharge following the desired conditions.

For incorporation of halogen atoms in the second layer, for example, $SiF_4$ gas and $NH_3$ gas or $SiF_4$ gas and NO gas, or a gas mixture further added with $SiH_4$ gas, may be used to form the second layer according to the same procedure as described above.

During formation of the respective layers, outflow valves other than those for necessary gases should of course be closed. Also, during formation of respective layers, in order to avoid remaining of the gas employed for formation of the preceding layer in the reaction chamber 1101 and the gas pipelines from the outflow valves 1117–1121 to the reaction chamber 1101 the operation of evacuating the system to high vacuum by closing the outflow valves 1117–1121, opening the auxiliary valves 1132, 1133 and opening fully the main valve 1134 is conducted, if necesary.

The amount of nitrogen atoms or oxygen atoms in the second layer can be controlled as desired by, for example, in the case of glow discharge, changing the flow rate ratio of $SiH_4$ gas to $NH_3$ gas or $SiH_4$ gas to NO gas to be introduced into the reaction chamber 1101 as desired, or in the case of layer formation by sputtering, changing the sputtering area of silicon wafer to silicon nitride plate or silicon wafer to $SiO_2$ plate, or molding a target with the use of a mixture of silicon powder with silicon nitride powder or $SiO_2$ powder with various mixing ratios. The content of halogen atoms (X) contained in the second layer can be controlled by controlling the flow rate of the starting gas for introduction of halogen atoms such as $SiF_4$ gas when introduced into the reaction chamber 1101.

Also, for uniformization of the layer formation, it is desirable to rotate the substrate 1137 by means of a motor 1139 at a constant speed during layer formation.

The present invention is described in more detail by referring to the following Examples.

EXAMPLE 1

By using the preparation device shown in FIG. 17, samples of image forming members for electrophotography (Sample Nos. 11-1A to 13-3A, Table A-2) were prepared on a cylindrical aluminum substrate under the condition shown in Table A-1.

Figure 18:
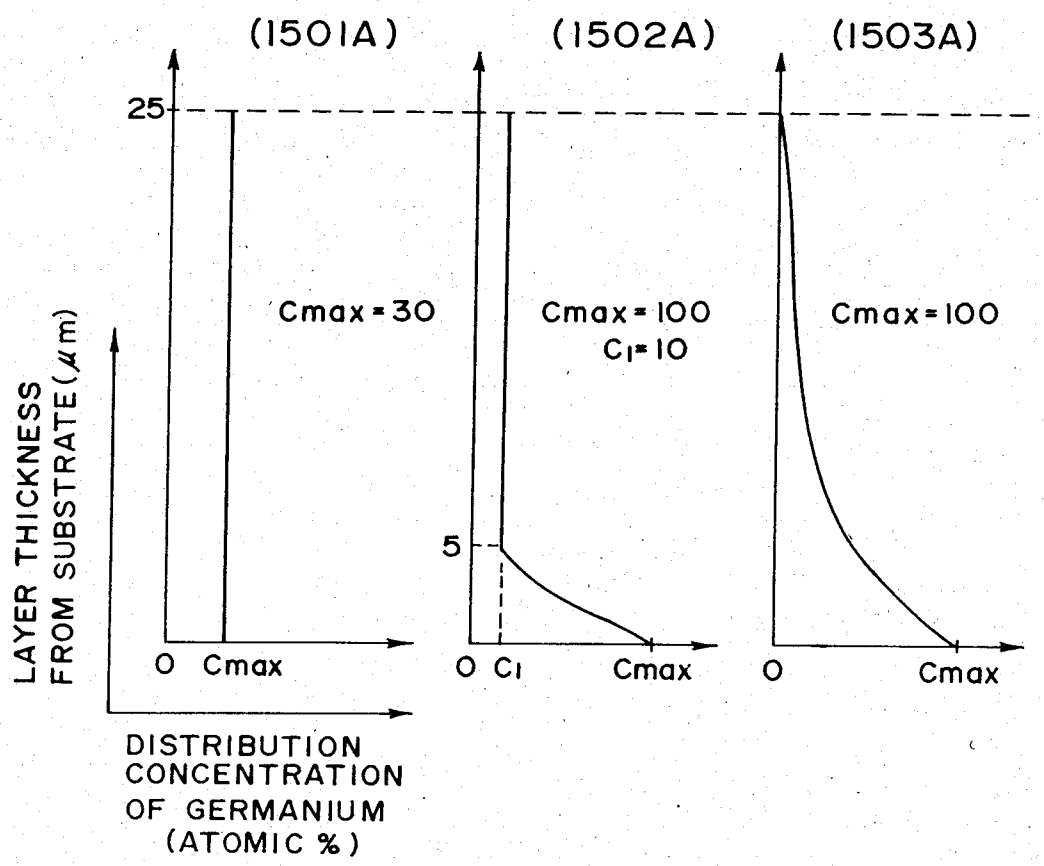
FIGS. 18 through 29 each show a schematic illustration of the depth profile of the respective atoms in Examples of the present invention.
Figure 19:
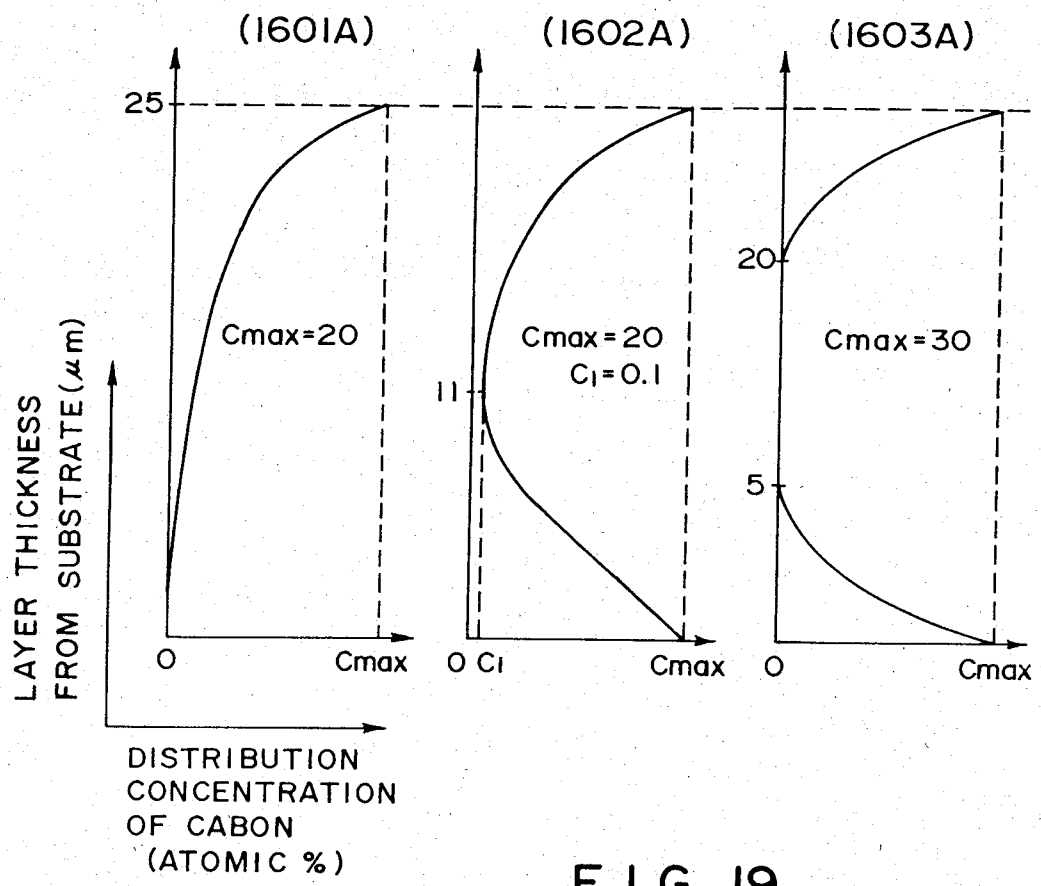

The concentration distributions of germanium atoms and carbon atoms in the sample are shown in FIG. 18, and FIG. 19, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 2

By using the preparation device shown in FIG. 17, samples of image forming members for electrophotography (Sample Nos. 21-1A to 23-3A, Table A-4) were prepared on a cylindrical aluminum substrate under the conditions shown in Table A-3.

The concentration distributions of germanium atoms and carbon atoms in the sample are shown in FIG. 18, and FIG. 19, respectively.

Each sample was subjected to image quality evaluation test in the same manner as in Example 1. Every sample tested gave a transferred toner image of high quality, and did not show deterioration in the image quality after 200,000 times of repetitive use under the operation condition of 38° C. and 80% RH.

The common conditions of the layer formation in the above Examples are as below:

Substrate temperature: approximately 200° C. for the layer containing germanium

Discharge frequency: 13.56 MHz

Inner pressure of reaction chamber during reaction: 0.3 Torr

EXAMPLE 3

By using the preparation device shown in FIG. 17, samples of image forming members for electrophotography (Sample Nos. 11-1B to 17-3B, Table B-2) were prepared on a cylindrical aluminum substrate under the condition shown in Table B-1.

Figure 20:
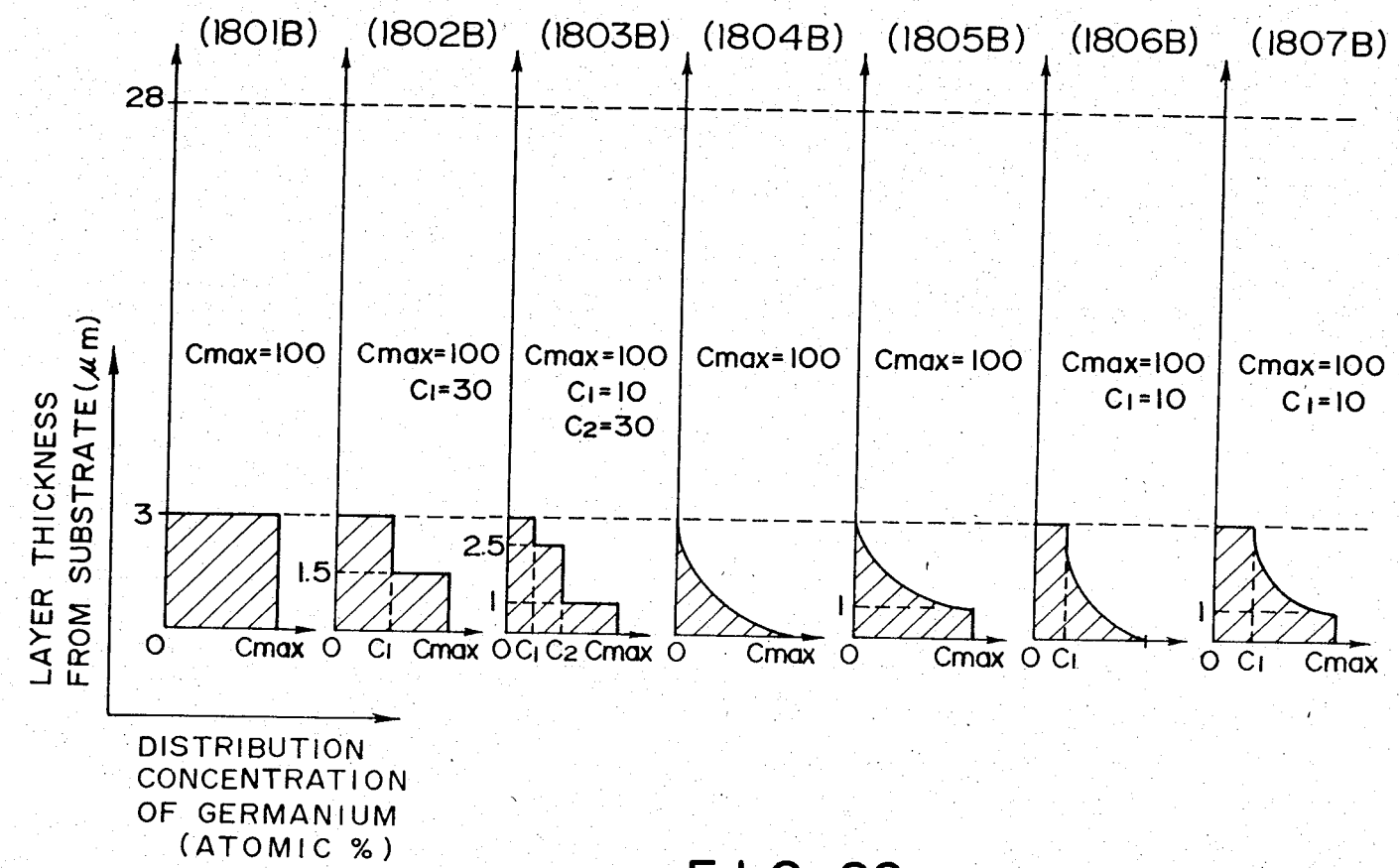
Figure 21:
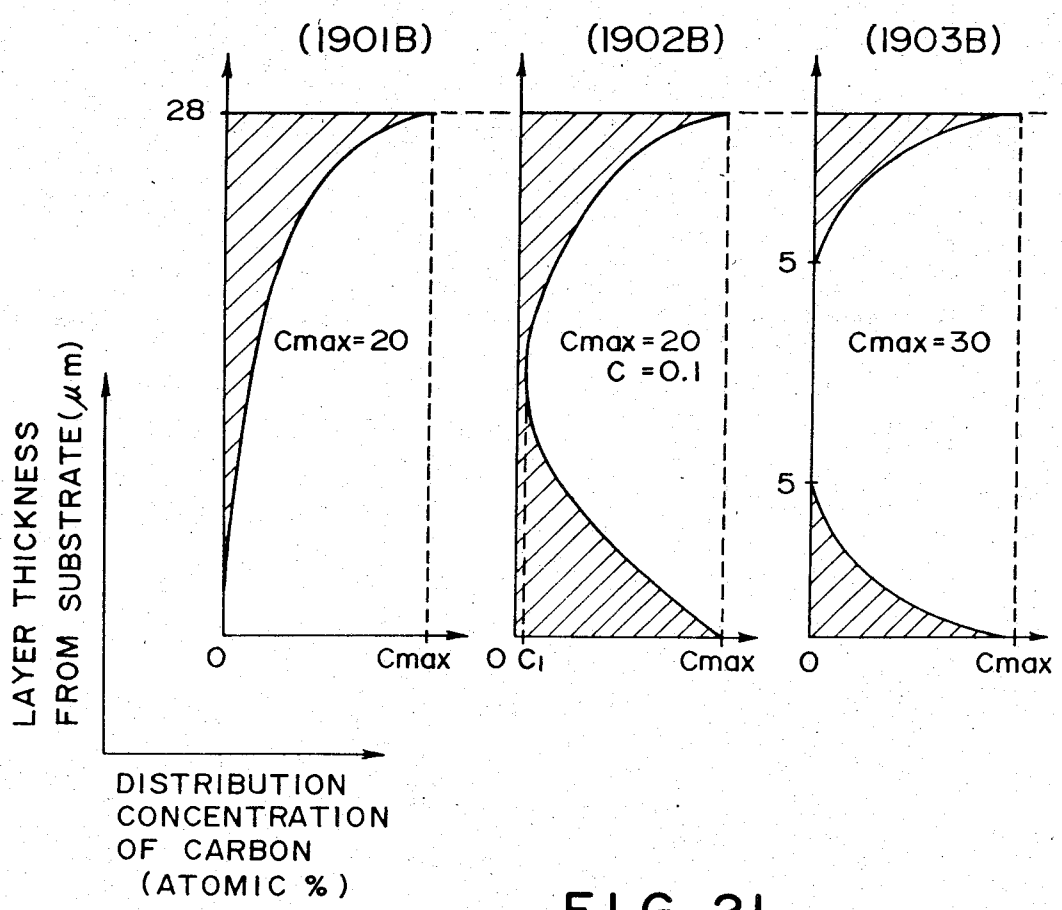

The concentration distributions of germanium atoms and carbon atoms in the sample are shown in FIG. 20, and FIG. 21, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 4

By using the preparation device shown in FIG. 17, samples of image forming members for electrophotography (Sample Nos. 21-1B to 27-3B, Table B-4) were prepared on a cylindrical aluminum substrate under the conditions shown in Table B-3.

The concentration distributions of germanium atoms and carbon atoms C(C) in the sample are shown in FIG. 20, and FIG. 21, respectively.

Each sample was subjected to image quality evaluation test in the same manner as in Example 3. Every sample tested gave a transferred toner image of high quality, and did not show deterioration in the image quality after 200,000 times of repetition use under the operation condition of 38° C. and 80% RH.

The common conditions of the layer formation in the above Examples are as below:

Substrate temperature: approximately 200° C. for the layer containing germanium atoms approximately 250° C. for the layer not containing germanium atoms Discharge frequency: 13.56 MHz Inner pressure of reaction chamber during reaction: 0.3 Torr

EXAMPLE 5

By using the preparation device shown in FIG. 17, samples of image forming members for electrophotography (Sample Nos. 11-1C to 13-3C, Table C-2) were prepared on a cylindrical aluminum substrate under the condition shown in Table C-1.

Figure 22:
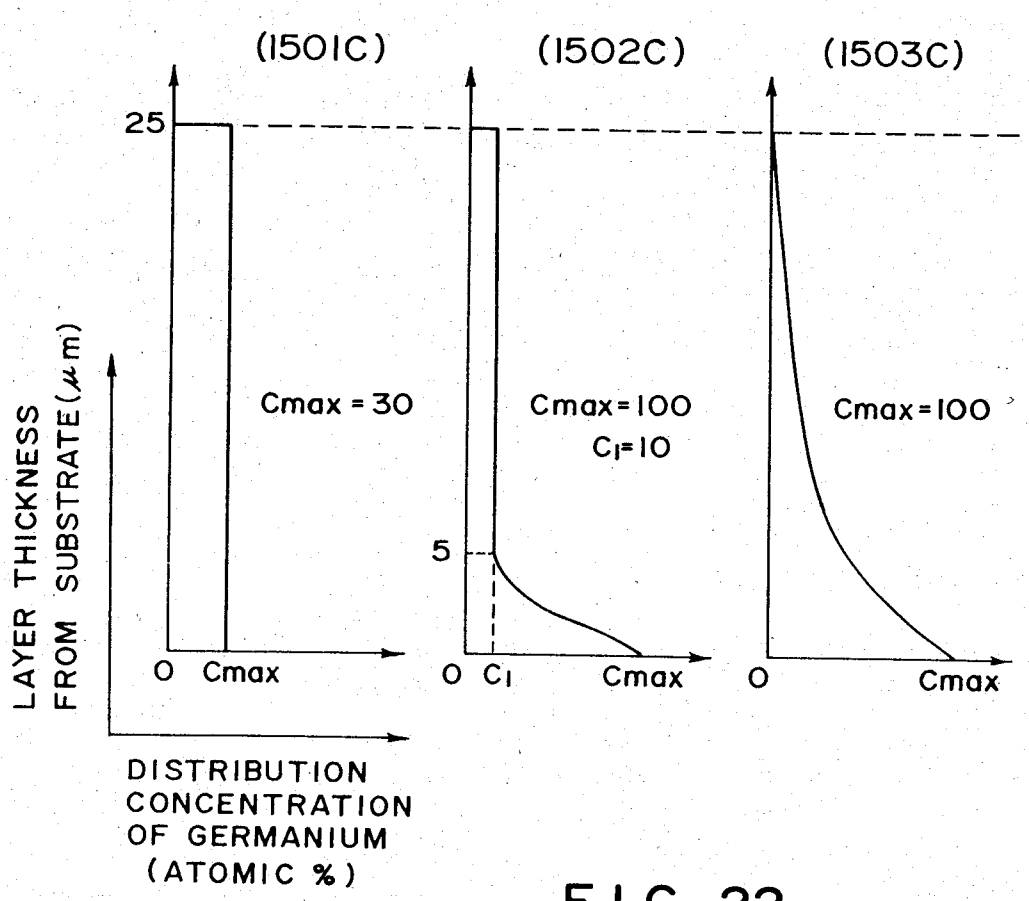
Figure 23:
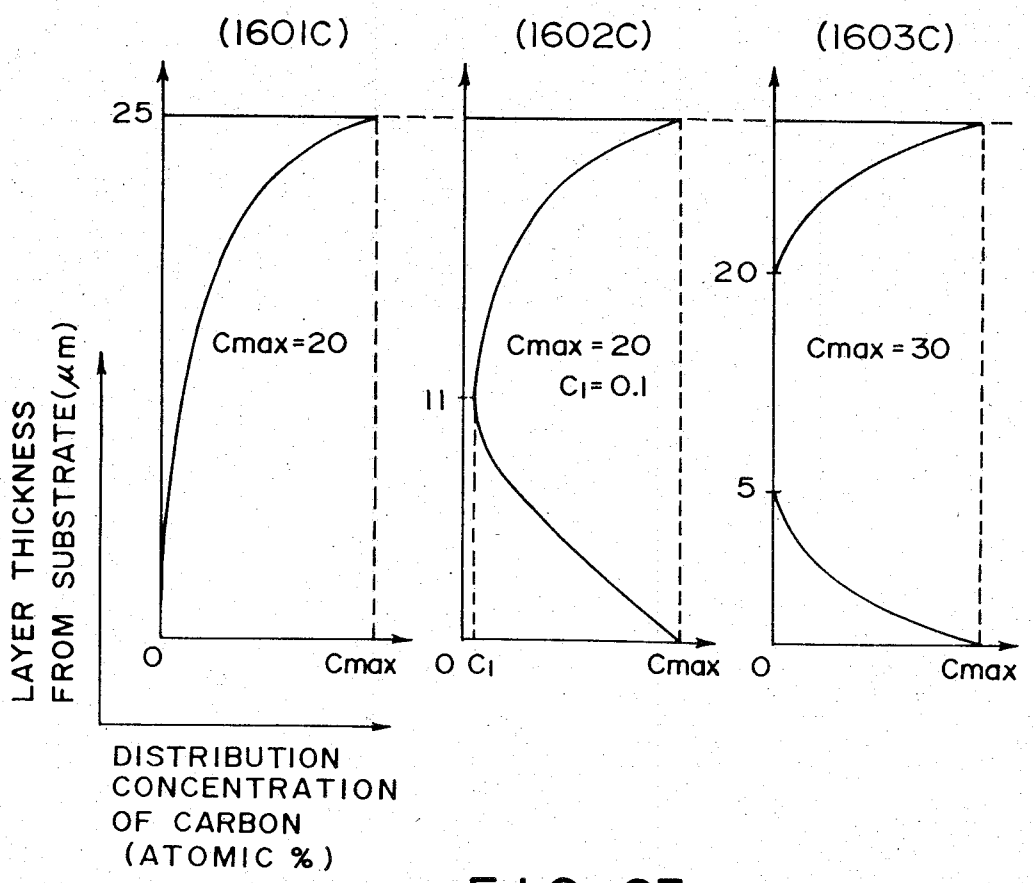

The concentration distributions of germanium atoms and carbon atoms in the sample are shown in FIG. 22, and FIG. 23, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 6

By using the preparation device shown in FIG. 17, samples of image forming members for electrophotography (Sample Nos. 21-1C to 23-3C, Table C-4) were prepared on a cylindrical aluminum substrate respectively under the conditions shown in Table C-3.

In Table C-3, the first layer in the layer (I) was formed on the aluminum substrate and the second layer was formed on the first layer.

The concentration distributions of germanium atoms and carbon atoms in the sample are shown in FIG. 22, and FIG. 23, respectively.

Each sample was subjected to image quality evaluation test in the same manner as in Example 5. Every sample tested gave a transferred toner image of high quality, and did not show deterioration in the image quality after 200,000 times of repetitive use under the operation condition of 38° C. and 80% RH.

EXAMPLE 7

Samples of an image forming member for electrophotography (Sample Nos. 11-1-1C–11-1-8C, 12-1-1C–12-1-8C, 13-1-1C–13-1-8C: 24 samples) were prepared under the same conditions and in the same manner as for Sample 11-1C, 12-1C, and 13-1C in Example 5 except that the layer (II) was prepared under the conditions shown in Table C-5.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table C-6.

EXAMPLE 8

Image forming members were prepared in the same manner as for Sample No. 11-1C in Example 5 except that the ratio of the content of silicon atoms and nitrogen atoms in the layer (II) was modified by changing the target area ratio of silicon wafer to silicon nitride in forming layer (II).

Each of the image forming member thus obtained was tested for the quality of the image formed after the 50,000 repetitions of image forming, developing, and cleaning processes as described in Example 5. The results are shown in Table C-7.

EXAMPLE 9

Each of the image forming members was prepared in the same manner as for the Sample No. 12-1C in Example 5 except that the content ratio of silicon atoms to nitrogen atoms in the layer (II) was modified by changing the flow rate ratio of $SiH_4$ gas to $NH_3$ gas in forming the layer (II).

The image forming members thus obtained were evaluated for the image quality after 50,000 repetitions of the copying process including image transfer according to the procedure described in Example 5. The results are shown in Table C-8.

EXAMPLE 10

Each of the image forming members was prepared in the same manner as for the Sample No. 13-1C in Example 5 except that the content ratio of silicon atoms to nitrogen atoms in the layer (II) was modified by changing the flow rate ratio of $SiH_4$ gas, $SiF_4$ gas, and $NH_3$ gas on forming the layer (II).

Each of the image forming members thus obtained was evaluated for the image quality after 50,000 repetitions of the image-forming developing, and cleaning process according to procedure described in Example 5. The results are shown in Table C-9.

EXAMPLE 11

Each of the image forming members was prepared in the same manner as for the Sample No. 11-1C in Example 5 except that the layer thickness of the layer (II) was changed. After the repetition of image forming, developing, and cleaning process as described in Example 5, the results shown in Table C-10 were obtained.

The common conditions of the layer formation in the above Examples are as below:

Substrate temperature: approximately 200° C. for the layer containing germanium

Discharge frequency: 13.56 MHz

Inner pressure of reaction chamber during reaction: 0.3 Torr.

EXAMPLE 12

By using the preparation device shown in FIG. 17, samples of image forming members for electrophotography (Sample Nos. 11-1D to 17-3D, Table D-2) were prepared on a cylindrical aluminum substrate under the condition shown in Table D-1.

Figure 24:
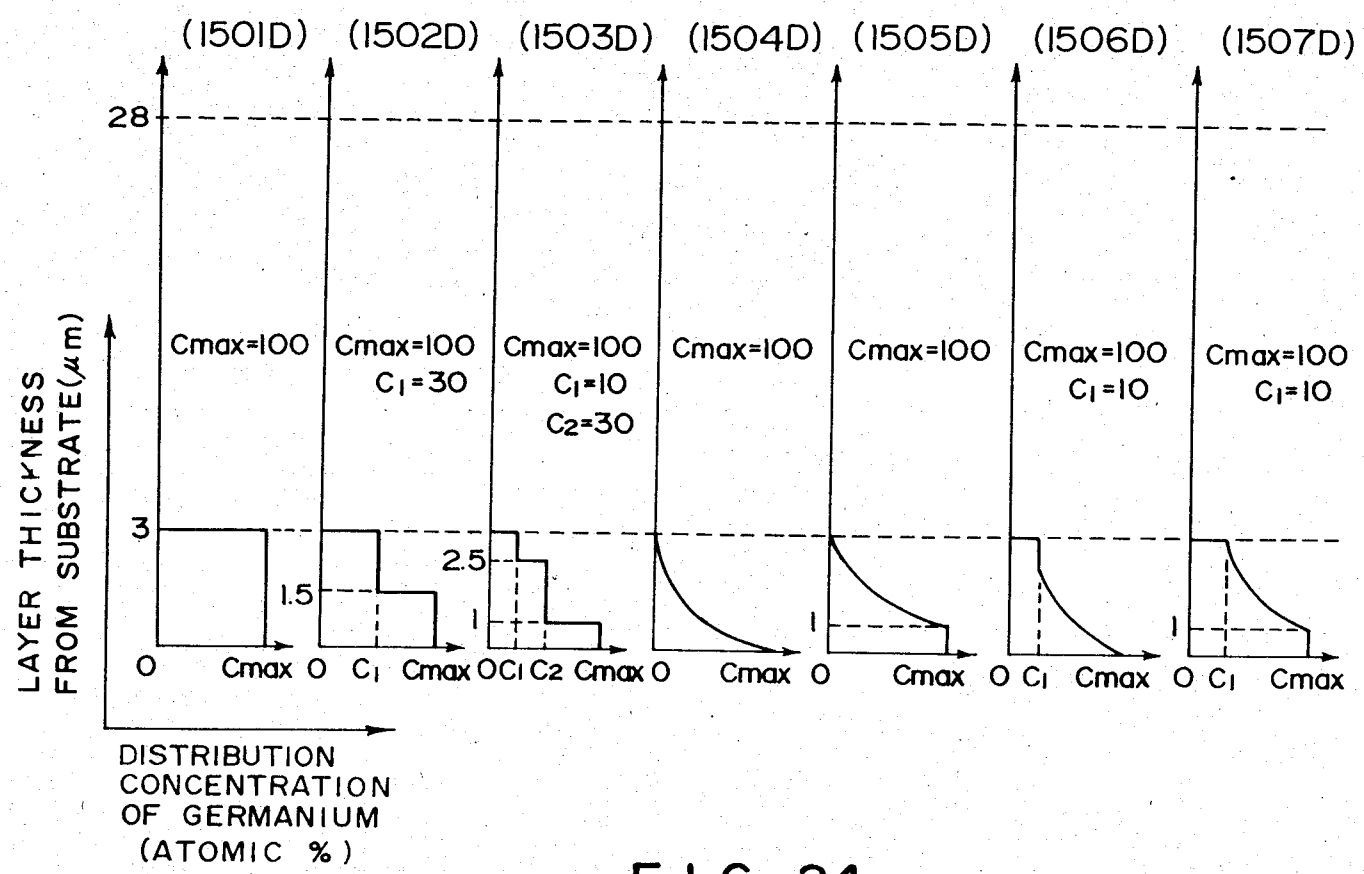
Figure 25:
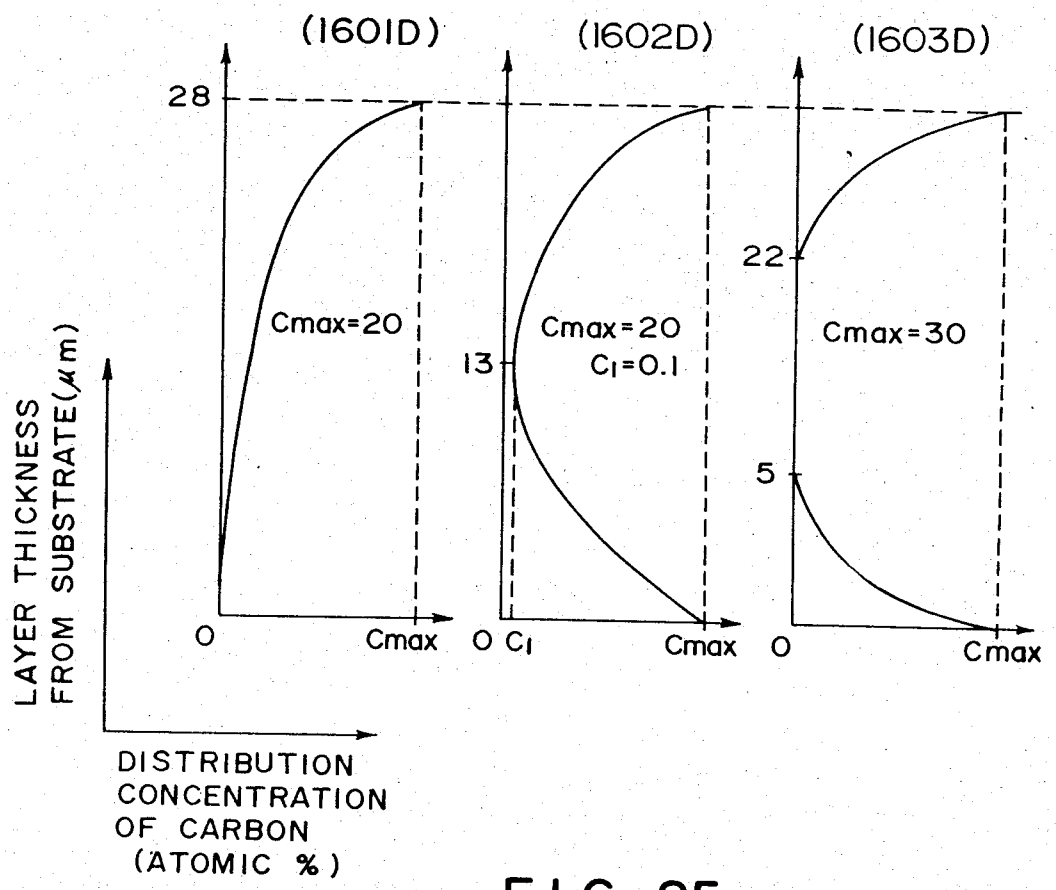

The concentration distributions of germanium atoms and carbon atoms in the sample are shown in FIG. 24, and FIG. 25, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 13

By using the preparation device shown in FIG. 17, samples of image forming members for electrophotography (Sample Nos. 21-1D to 27-3D, Table D-4) were prepared on a cylindrical aluminum substrate under the conditions shown in Table D-3.

The concentration distributions of germanium atoms and carbon atoms in the sample are shown in FIG. 24, and FIG. 25, respectively.

Each sample was subjected to image quality evaluation test in the same manner as in Example 12. Every sample tested gave a transferred toner image of high quality, and did not show deterioration in the image quality after 200,000 times of repetitive use under the operation condition of 38° C. and 80% RH.

EXAMPLE 14

Samples of an image forming member for electrophotography (Sample Nos. 11-1-1D–11-1-8D, 12-1-1D–12-1-8D, 13-1-1D–13-1-8D: 24 samples) were prepared under the same conditions and in the same manner as for Sample 11-1D, 12-1D, and 13-1D in Example 12 except that the layer (II) was prepared under the conditions shown in Table D-5.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table D-6.

EXAMPLE 15

Image forming members were prepared in the same manner as for Sample No. 11-1 D in Example 12 except that the ratio of the content of silicon atoms and nitrogen atoms in the layer (II) was modified by changing the target area ratio of silicon wafer to silicon nitride wafer in forming layer (II).

Each of the image forming member thus obtained was tested for the quality of the image formed after the 50,000 repetitions of image forming, developing, and cleaning processes as described in Example 12. The results are shown in Table D-7.

EXAMPLE 16

Each of the image forming members was prepared in the same manner as for the Sample No. 12-1D in Example 12 except that the content ratio of silicon atoms to nitrogen atoms in the layer (II) was modified by changing the flow rate ratio of $SiH_4$ gas to $NH_3$ gas in forming the layer (II).

The image forming members thus obtained were evaluated for the image quality after 50,000 repetitions of the copying process including image transfer according to the procedure described in Example 12. The results are shown in Table D-8.

EXAMPLE 17

Each of the image forming members was prepared in the same manner as for the Sample No. 13-1D in Example 12 except that the content ratio of silicon atoms to nitrogen atoms in the layer (II) was modified by changing the flow rate ratio of $SiH_4$ gas, $SiF_4$ gas, and $NH_3$ gas on forming the layer (II).

Each of the image forming members thus obtained was evaluated for the image quality after 50,000 repetitions of the image-forming, developing, and cleaning process according to procedure described in Example 12. The results are shown in Table D-9.

EXAMPLE 18

Each of the image forming members was prepared in the same manner as for the Sample No. 11-1D in Example 12 except that the layer thickness of the layer (II) was changed. After the repetition of image forming, developing, and cleaning process as described in Example 5, the results shown in Table D-10 were obtained.

The common conditions of the layer formation in the above Examples are as below:

Substrate temperature: approximately 200° C. for the layer containing germanium approximately 250° C. for the layer not containing germanium Discharge frequency: 13.56 MHz Inner pressure of reaction chamber during reaction: 0.3 Torr.

EXAMPLE 19

By using the preparation device shown in FIG. 17, samples of image forming members for electrophotography (Sample Nos. 11-1E to 13-3E, Table E-2) were prepared on a cylindrical aluminum substrate under the condition shown in Table E-1.

Figure 26:
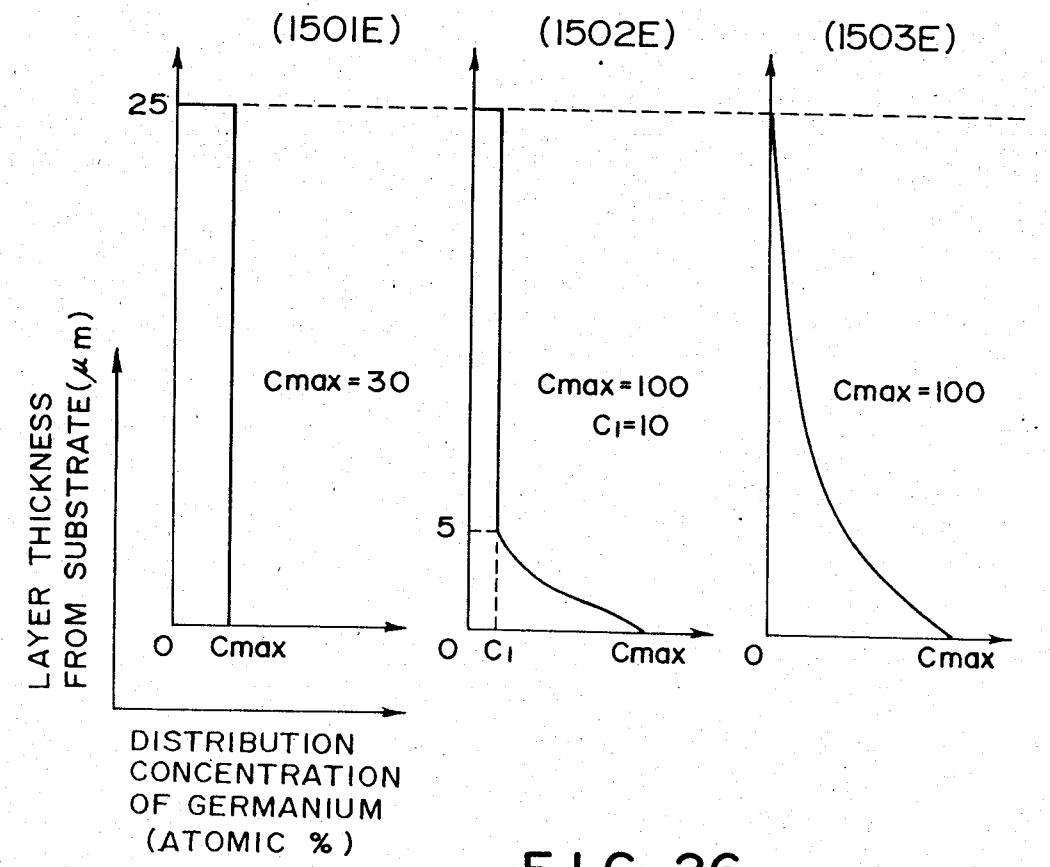
Figure 27:
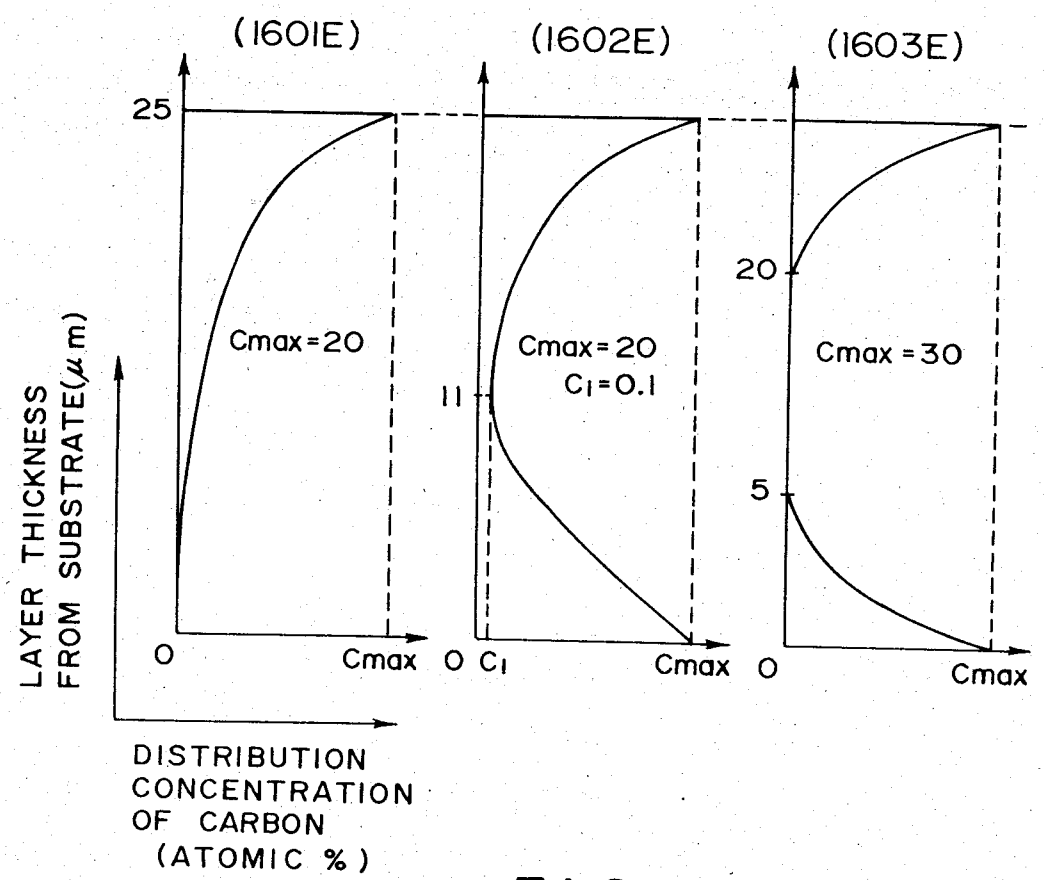

The concentration distributions of germanium atoms and carbon atoms in the sample are shown in FIG. 26, and FIG. 27, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 20

By using the preparation device shown in FIG. 17, samples of image forming members for electrophotography (Sample Nos. 21-1E to 23-3E, Table E-4) were prepared on a cylindrical aluminum substrate under the conditions shown in Table E-3.

The concentration distributions of germanium atoms and carbon atoms in the sample are shown in FIG. 26, and FIG. 27, respectively.

Each sample was subjected to image quality evaluation test in the same manner as in Example 19. Every sample tested gave a transferred toner image of high quality, and did not show deterioration in the image quality after 200,000 times of repetitive use under the operation condition of 38° C. and 80% RH.

EXAMPLE 21

Samples of an image forming member for electrophotography (Sample Nos. 11-1-1E–11-1-8E, 12-1-1E–12-1-8E, 13-1-1E–13-1-8E : 24 samples) were prepared under the same conditions and in the same manner as for Sample 11-1E, 12-1E, and 13-1E in Example 19 except that the layer (II) was prepared under the conditions shown in Table E-5.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table E-6.

EXAMPLE 22

Image forming members were prepared in the same manner as for Sample No. 11-1E in Example 19 except that the ratio of the content of silicon atoms and oxygen atoms in the layer (II) was modified by changing the target area ratio of silicon wafer to $SiO_2$ in forming layer (II).

Each of the image forming member thus obtained was tested for the quality of the image formed after the 50,000 repetitions of image forming, developing, and cleaning processes as described in Example 19. The results are shown in Table E-7.

EXAMPLE 23

Each of the image forming members was prepared in the same manner as for the Sample No. 12-1E in Example 19 except that the content ratio of silicon atoms to oxygen atoms in the layer (II) was modified by changing the flow rate ratio of $SiH_4$ gas to NO gas in forming the layer (II).

The image forming members thus obtained were evaluated for the image quality after 50,000 repetitions of the copying process including image transfer according to the procedure described in Example 19. The results are shown in Table E-8.

EXAMPLE 24

Each of the image forming members was prepared in the same manner as for the Sample No. 13-1E in Example 19 except that the content ratio of silicon atoms to oxygen atoms in the layer (II) was modified by changing the flow rate ratio of $SiH_4$ gas, $SiF_4$ gas, and NO gas on forming the layer (II).

Each of the image forming members thus obtained was evaluated for the image quality after 50,000 repetitions of the image-forming developing, and cleaning process according to procedure described in Example 19. The results are shown in Table E-9.

EXAMPLE 25

Each of the image forming members was prepared in the same manner as for the Sample No. 11-1E in Example 19 except that the layer thickness of the layer (II) was changed. After the repetition of image forming, developing, and cleaning process as described in Example 19, the results shown in Table E-10 were obtained.

The common conditions of the layer formation in the above Examples are as below:

Substrate temperature: approximately 200° C. for the layer containing germanium

Discharge frequency: 13.56 MHz

Inner pressure of reaction chamber during reaction: 0.3 Torr.

EXAMPLE 26

By using the preparation device shown in FIG. 17, samples of image forming members for electrophotography (Sample Nos. 11-1F to 17-3F, Table F-2) were prepared on a cylindrical aluminum substrate under the condition shown in Table F-1.

Figure 28:
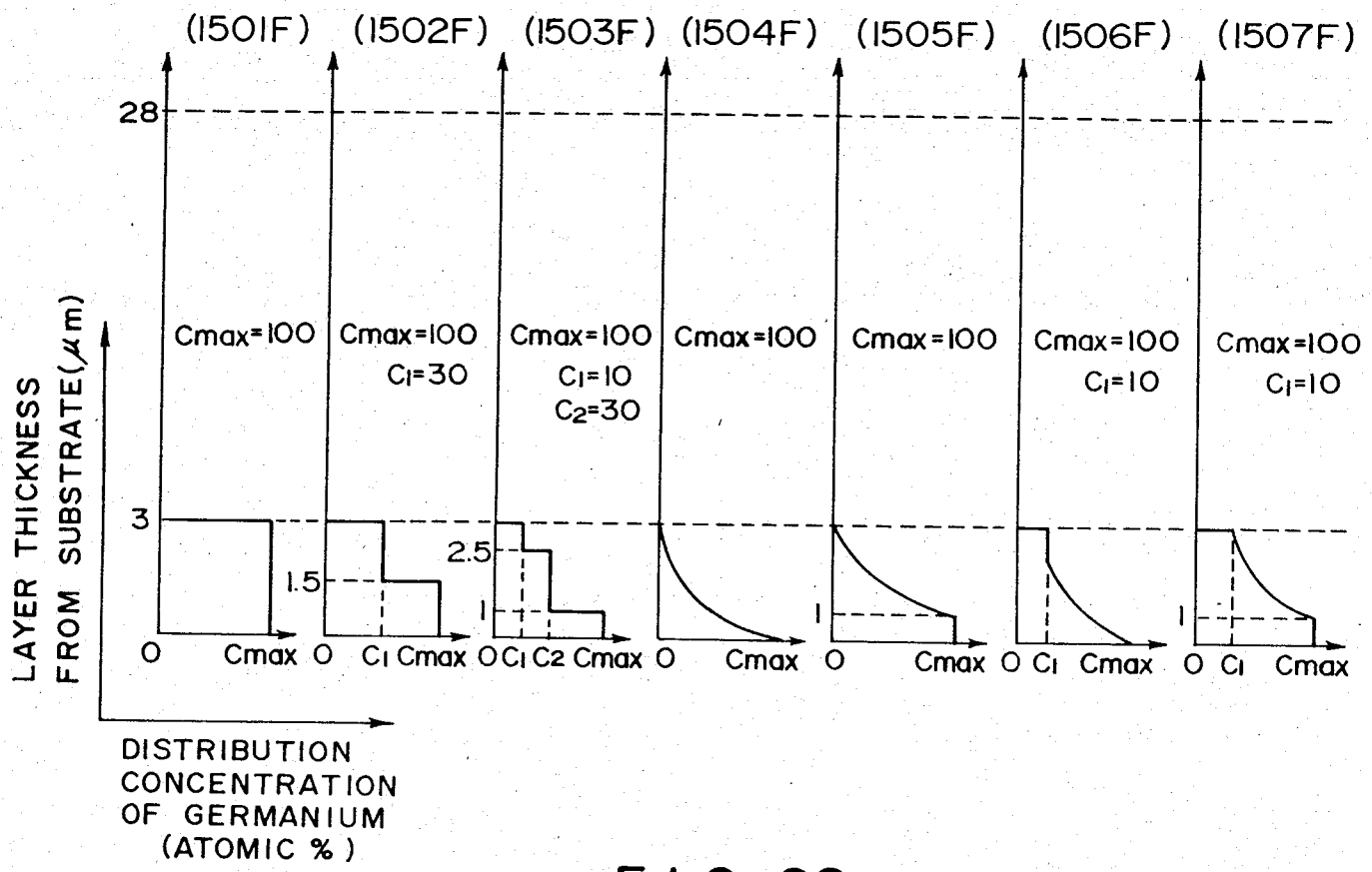
Figure 29:
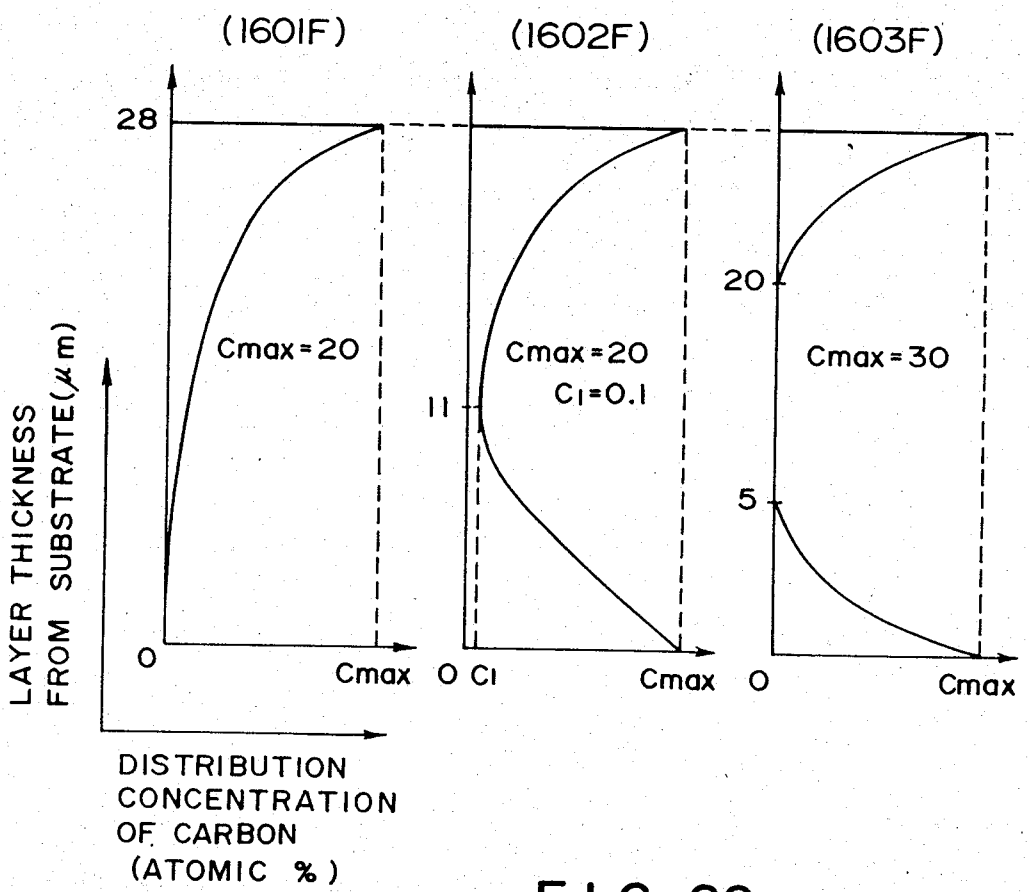

The concentration distributions of germanium atoms and carbon atoms in the sample are shown in FIG. 28, and FIG. 29, respectively.

The sample thus prepared was set on an experimental charge-exposure device, and corona charging was effected at +5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto transfer paper by corona charging of +5.0 KV, giving a clear image of high density with excellent resolution and sufficient gradation reproducibility.

The evaluation of quality of the transferred toner image was repeated in the same manner as described above except that a semi-conductor laser of GaAs type of 810 nm (10 mW) was used in place of the tungsten lamp. The sample all gave a clear image having an excellent resolution and satisfactory gradation reproducibility.

EXAMPLE 27

By using the preparation device shown in FIG. 17, samples of image forming members for electrophotography (Sample Nos. 21-1F to 27-3F, Table F-4) were prepared on a cylindrical aluminum substrate under the conditions shown in Table F-3.

The concentration distributions of germanium atoms and carbon atoms in the sample are shown in FIG. 28, and FIG. 29, respectively.

Each sample was subjected to image quality evaluation test in the same manner as in Example 26. Every sample tested gave a transferred toner image of high quality, and did not show deterioration in the image quality after 200,000 times of repetitive use under the operation condition of 38° C. and 80% RH.

EXAMPLE 28

Samples of an image forming member for electrophotography (Sample Nos. 11-1-1F–11-1-8F, 12-1-1F–12-1-8F, 13-1-1F–13-1-8F: 24 samples) were prepared under the same conditions and in the same manner as for Sample 11-1F, 12-1F, and 13-1F in Example 26 except that the layer (II) was prepared under the conditions shown in Table F-5.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table F-6.

EXAMPLE 29

Image forming members were prepared in the same manner as for Sample No. 11-1F in Example 26 except that the ratio of the content of silicon atoms and oxygen atoms in the layer (II) was modified by changing the target area ratio of silicon wafer to $SiO_2$ wafer in forming layer (II).

Each of the image forming member thus obtained was tested for the quality of the image formed after the 50,000 repetitions of image forming, developing, and cleaning processes as described in Example 26. The results are shown in Table F-7.

EXAMPLE 30

Each of the image forming members was prepared in the same manner as for the Sample No. 12-1F in Example 26 except that the content ratio of silicon atoms to oxygen atoms in the layer (II) was modified by changing the flow rate ratio of $SiH_4$ gas to NO gas in forming the layer (II).

The image forming members thus obtained were evaluated for the image quality after 50,000 repetitions of the copying process including image transfer according to the procedure described in Example 26. The results are shown in Table F-8.

EXAMPLE 31

Each of the image forming members was prepared in the same manner as for the Sample No. 13-1F in Example 26 except that the content ratio of silicon atoms to oxygen atoms in the layer (II) was modified by changing the flow rate ratio of $SiH_4$ gas, $SiF_4$ gas, and NO gas on forming the layer (II).

Each of the image forming members thus obtained was evaluated for the image quality after 50,000 repetitions of the image-forming, developing, and cleaning process according to procedure described in Example 26. The results are shown in Table F-9.

EXAMPLE 32

Each of the image forming members was prepared in the same manner as for the Sample No. 11-1F in Example 26 except that the layer thickness of the layer (II) was changed. After the repetition of image forming, developing, and cleaning process as described in Example 26, the results shown in Table F-10 were obtained.

The conditions of the layer formation in the above Examples are as below:

Substrate temperature: approximately 200° C. for the layer containing germanium approximately 250° C. for the layer not containing germanium Discharge frequency: 13.56 MHz Inner pressure of reaction chamber during reaction: 0.3 Torr.

TABLE A-1

| Layer constitution | Gases employed | Flow rate (SCCM) | Flow rate ratio | Discharging power (W/cm²) | Layer formation rate (Å/sec) | Layer thickness (μ) |
|---|---|---|---|---|---|---|
| Light receiving layer | $SiF_4/He = 0.5$<br>$GeF_4/He = 0.5$<br>$C_2H_4$<br>$H_2$ | $SiF_4 + GeF_4 = 200$ | $\frac{(SiF_4 + GeF_4)}{(H_2 + SiF_4 + GeF_4)} = 7/10$ | 0.18 | 15 | 25 |

TABLE A-2

| Depth profile of Ge | | | | |
|---|---|---|---|---|
| Depth profile of C | Sample No. | 1501A | 1502A | 1503A |
| 1601A | | 11-1A | 12-1A | 13-1A |
| 1602A | | 11-2A | 12-2A | 13-2A |
| 1603A | | 11-3A | 12-3A | 13-3A |

TABLE A-3

| Layer Constitution | Gases employed | Flow rate (SCCM) | Flow rate ratio | Discharging power (W/cm²) | Layer formation rate (Å/sec) | Layer thickness (μ) |
|---|---|---|---|---|---|---|
| Layer (I) | $SiF_4/He = 0.5$<br>$GeF_4/He = 0.5$<br>$C_2H_4$<br>$H_2$<br>$B_2H_6/He = 10^{-3}$ | $SiF_4 + GeF_4 = 200$ | $\frac{(SiF_4 + GeF_4)}{(H_2 + SiF_4 + GeF_4)} = 7/10$<br>$\frac{B_2H_6}{(SiF_4 + GeF_4)} = 2 \times 10^{-3}$ | 0.18 | 15 | 5 |
| Layer (II) | $SiF_4/He = 0.5$<br>$GeF_4/He = 0.5$<br>$C_2H_4$<br>$H_2$ | $SiF_4 + GeF_4 = 200$ | $\frac{(SiF_4 + GeF_4)}{(H_2 + SiF_4 + GeF_4)} = 7/10$ | 0.18 | 15 | 20 |

TABLE A-4

| Depth profile of Ge | | | | |
|---|---|---|---|---|
| Depth profile of C | Sample No. | 1501A | 1502A | 1503A |
| 1601A | | 21-1A | 22-1A | 23-1A |
| 1602A | | 21-2A | 22-2A | 23-2A |
| 1603A | | 21-3A | 22-3A | 23-3A |

TABLE B-1

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiH_4/He = 0.5$<br>$GeH_4/He = 0.5$<br>$C_2H_4$ | $SiH_4 + GeH_4 = 200$ | — | 0.18 | 15 | 3 |
| Layer (II) | $SiH_4/He = 0.5$<br>$C_2H_4$ | $SiH_4 = 200$ | — | 0.18 | 15 | 25 |

TABLE B-2

| Depth profile of Ge | | | | | | | | |
|---|---|---|---|---|---|---|---|---|
| Depth profile of C | Sample No. | 1801B | 1802B | 1803B | 1804B | 1805B | 1806B | 1807B |
| 1901B | | 11-1B | 12-1B | 13-1B | 14-1B | 15-1B | 16-1B | 17-1B |
| 1902B | | 11-2B | 12-2B | 13-2B | 14-2B | 15-2B | 16-2B | 17-2B |
| 1903B | | 11-3B | 12-3B | 13-3B | 14-3B | 15-3B | 16-3B | 17-3B |

TABLE B-3

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiH_4/He = 0.5$<br>$GeH_4/He = 0.5$<br>$C_2H_4$<br>$B_2H_6/He = 10^{-3}$ | $SiH_4 + GeH_4 = 200$ | — | 0.18 | 15 | 3 |
| Layer (II) | $SiH_4/He = 0.5$<br>$C_2H_4$ | $SiH_4 = 200$ | — | 0.18 | 15 | 25 |

TABLE B-4

| Depth profile of Ge | | | | | | | | |
|---|---|---|---|---|---|---|---|---|
| Depth profile of C | Sample No. | 1801B | 1802B | 1803B | 1804B | 1805B | 1806B | 1807B |
| 1901B | | 21-1B | 22-1B | 23-1B | 24-1B | 25-1B | 26-1B | 27-1B |
| 1902B | | 21-2B | 22-2B | 23-2B | 24-2B | 25-2B | 26-2B | 27-2B |
| 1903B | | 21-3B | 22-3B | 23-3B | 24-3B | 25-3B | 26-3B | 27-3B |

TABLE C-1

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiF_4/He = 0.5$<br>$GeF_4/He = 0.5$ | $SiF_4 + GeF_4 = 200$ | $\frac{GeF_4}{(H_2 + SiF_4 + GeF_4)} = *$ | 0.18 | 15 | 25 |
| | $C_2H_4$<br>$H_2$ | | $\frac{C_2H_4}{SiF_4 + GeF_4} = **$ | | | |
| Layer (II) | $SiH_4/He = 0.5$<br>$NH_3$ | $SiH_4 = 100$ | $SiH_4/NH_3 = 3/7$ | 0.18 | 10 | 0.5 |

* **Flow rate ratio was changed with regard to each sample according to the flow rate ratio change rate curve previously designed by controlling automatically the opening of the corresponding valve.

TABLE C-2

| Depth profile of Ge | | | | |
|---|---|---|---|---|
| Depth profile of C | Sample No. | 1501C | 1502C | 1503C |
| 1601C | | 11-1C | 12-1C | 13-1C |
| 1602C | | 11-2C | 12-2C | 13-2C |

TABLE C-2-continued

| Depth profile of Ge | | | | |
|---|---|---|---|---|
| Depth profile of C | Sample No. | 1501C | 1502C | 1503C |
| 1603C | | 11-3C | 12-3C | 13-3C |

TABLE C-3

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiF_4/He = 0.5$<br>$GeF_4/He = 0.5$<br>$C_2H_4$<br>$H_2$<br>$B_2H_6/He = 1 \times 10^{-3}$ | $SiF_4 + GeF_4 = 200$ | $\frac{GeF_4}{(H_2 + SiF_4 + GeF_4)} = *$<br>$\frac{B_2H_6}{(SiF_4 + GeF_4)} = 2 \times 10^{-3}$ | 0.18 | 15 | 5 |
| | Second layer | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = *$ | 0.18 | 15 | 20 |
| Layer (II) | | $SiH_4/He = 0.5$<br>$NH_3$ | $SiH_4 = 100$ | $SiH_4/NH_3 = 3/7$ | 0.18 | 10 | 0.5 |

*Flow rate ratio was changed with regard to each sample according to the flow rate ratio change rate curve previously designed by controlling automatically the opening of the corresponding valve.

TABLE C-4

| Depth profile of Ge | | | | |
|---|---|---|---|---|
| Depth profile of C | Sample No. | 1501C | 1502C | 1503C |
| 1601C | | 21-1C | 22-1C | 23-1C |
| 1602C | | 21-2C | 22-2C | 23-2C |
| 1603C | | 21-3C | 22-3C | 23-3C |

TABLE C-5

| Conditions | Gases employed | Flow rate (SCCM) | Flow rate ratio or Area ratio | Discharging power ($W/cm^2$) | Layer thickness (μ) |
|---|---|---|---|---|---|
| 5-1C | Ar | 200 | Si wafer:Silicon nitride = 1:30 | 0.3 | 0.5 |
| 5-2C | Ar | 200 | Si wafer:Silicon nitride = 1:60 | 0.3 | 0.3 |
| 5-3C | Ar | 200 | Si wafer:Silicon nitride = 6:4 | 0.3 | 1.0 |
| 5-4C | $SiH_4/He = 1$<br>$NH_3$ | $SiH_4 = 15$ | $SiH_4:NH_3 = 1:100$ | 0.18 | 0.3 |
| 5-5C | $SiH_4/He = 0.5$<br>$NH_3$ | $SiH_4 = 100$ | $SiH_4:NH_3 = 1:30$ | 0.18 | 1.5 |
| 5-6C | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 5-7C | $SiH_4/He = 0.5$<br>$SiF_4/He = 0.5$<br>$NH_3$ | $SiH_4 + SiF_4 = 15$ | $SiH_4:SiF_4:NH_3 = 2:1:90$ | 0.18 | 0.3 |
| 5-8C | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE C-6

| Layer (II) forming conditions | Sample No./Evaluation | | |
|---|---|---|---|
| 5-1C | 11-1-1C<br>○ ○ | 12-1-1C<br>○ ○ | 13-1-1C<br>○ ○ |
| 5-2C | 11-1-2C<br>○ ○ | 12-1-2C<br>○ ○ | 13-1-2C<br>○ ○ |
| 5-3C | 11-1-3C<br>○ ○ | 12-1-3C<br>○ ○ | 13-1-3C<br>○ ○ |

TABLE C-6-continued

| | | | |
|---|---|---|---|
| 5-4C | 11-1-4C<br>◎ ◎ | 12-1-4C<br>◎ ◎ | 13-1-4C<br>◎ ◎ |
| 5-5C | 11-1-5C<br>◎ ◎ | 12-1-5C<br>◎ ◎ | 13-1-5C<br>◎ ◎ |
| 5-6C | 11-1-6C<br>◎ ◎ | 12-1-6C<br>◎ ◎ | 13-1-6C<br>◎ ◎ |
| 5-7C | 11-1-7C<br>○ ○ | 12-1-7C<br>○ ○ | 13-1-7C<br>○ ○ |
| 5-8C | 11-1-8C<br>○ ○ | 12-1-8C<br>○ ○ | 13-1-8C<br>○ ○ |

| Sample No. | Overall image quality evaluation | Durability evaluation |
|---|---|---|

Evaluation standards:
◎ . . . Excellent
○ . . . Good

TABLE C-7

| Sample No. | 1301C | 1302C | 1303C | 1304C | 1305C | 1306C | 1307C |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality | Δ | ◎ | ◎ | ○ | ○ | Δ | X |

TABLE C-7-continued

| Sample No. | 1301C | 1302C | 1303C | 1304C | 1305C | 1306C | 1307C |
|---|---|---|---|---|---|---|---|
| evaluation | | | | | | | |

◎ : Very good
○ : Good
Δ: Sufficiently practically usable
X: Image defect formed

TABLE C-8

| Sample No. | 1401C | 1402C | 1403C | 1404C | 1405C | 1406C | 1407C | 1408C |
|---|---|---|---|---|---|---|---|---|
| $SiH_4$:$NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6:5 |
| Image quality evaluation | Δ | ◎ | ◎ | ◎ | ○ | Δ | Δ | X |

◎: Very good
○ : Good
Δ: Sufficiently practically usable
X: Image defect formed

TABLE C-9

| Sample No. | 1501C | 1502C | 1503C | 1504C | 1505C | 1506C | 1507C | 1508C |
|---|---|---|---|---|---|---|---|---|
| $SiH_4$:$SiF_4$:$NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○ : Good
Δ: Sufficiently practically usable
X: Image defect formed

TABLE C-10

| Sample No. | Thickness of layer (II) (μ) | Results |
|---|---|---|
| 1601C | 0.001 | Image defect liable to be formed |
| 1602C | 0.02 | No image defect formed up to successive copying for 20,000 times |

TABLE C-10-continued

| Sample No. | Thickness of layer (II) (μ) | Results |
|---|---|---|
| 1603C | 0.05 | Stable up to successive copying for 50,000 times |
| 1604C | 1 | Stable up to successive copying for 200,000 times |

TABLE D-1

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer region (G) | $SiH_4$/He = 0.5<br>$GeH_4$/He = 0.5 | $SiH_4 + GeH_4$ = 200 | $\frac{GeH_4}{SiH_4 + GeH_4}$ = * | 0.18 | 15 | 3 |
| | | $C_2H_4$ | | $\frac{C_2H_4}{SiH_4 + C_2H_4}$ = ** | | | |
| | Second layer region (S) | $SiH_4$/He = 0.5<br>$C_2H_4$ | $SiH_4$ = 200 | $\frac{C_2H_4}{SiH_4 + C_2H_4}$ = ** | 0.18 | 15 | 25 |
| Layer (II) | | $SiH_4$/He = 0.5<br>$NH_3$ | $SiH_4$ = 100 | $SiH_4/NH_3$ = 3/7 | 0.18 | 10 | 0.5 |

(*), (**) . . . Flow rate ratio was changed with regard to each sample according to the flow rate ratio change rate curve previously designed by controlling automatically the opening of the corresponding valve.

TABLE D-2

| Depth profile of Ge | | | | | | | | |
|---|---|---|---|---|---|---|---|---|
| Depth profile of C | Sample No. | 1501D | 1502D | 1503D | 1504D | 1505D | 1506D | 1507D |
| 1601D | | 11-1D | 12-1D | 13-1D | 14-1D | 15-1D | 16-1D | 17-1D |
| 1602D | | 11-2D | 12-2D | 13-2D | 14-2D | 15-2D | 16-2D | 17-2D |

TABLE D-2-continued

| Depth profile of Ge | | | | | | | | |
|---|---|---|---|---|---|---|---|---|
| Depth profile of C | Sample No. | 1501D | 1502D | 1503D | 1504D | 1505D | 1506D | 1507D |
| 1603D | | 11-3D | 12-3D | 13-3D | 14-3D | 15-3D | 16-3D | 17-3D |

TABLE D-3

| | Layer Constitution | Gases employed | Flow rate (SCCM) | Flow rate ratio | Discharging power (W/cm$^2$) | Layer formation rate (Å/sec) | Layer thickness (μ) |
|---|---|---|---|---|---|---|---|
| Layer (I) | First layer region (G) | $SiH_4/He = 0.5$<br>$GeH_4/He = 0.5$ | $SiH_4 + GeH_4 = 200$ | $\frac{GeH_4}{SiH_4 + GeH_4} = *$ | 0.18 | 15 | 3 |
| | | $C_2H_4$<br>$B_2H_6/He = 10$ | | $\frac{C_2H_4}{SiH_4 + C_2H_4} = **$<br>$\frac{B_2H_6}{SiH_4 + GeH_4} = 3 \times 10^{-3}$ | | | |
| | Second layer region (S) | $SiH_4/He = 0.5$<br>$C_2H_4$ | $SiH_4 = 200$ | $\frac{C_2H_4}{SiH_4 + C_2H_4} = **$ | 0.18 | 15 | 25 |
| | Layer (II) | $SiH_4/He = 0.5$<br>$NH_3$ | $SiH_4 = 100$ | $SiH_4/NH_3 = 3/7$ | 0.18 | 10 | 0.5 |

(*), (**) . . . Flow rate ratio was changed with regard to each sample according to the flow rate ratio change rate curve previously designed by controlling automatically the opening of the corresponding valve.

TABLE D-4

| Depth profile of Ge | | | | | | | | |
|---|---|---|---|---|---|---|---|---|
| Depth profile of C | Sample No. | 1501D | 1502D | 1503D | 1504D | 1505D | 1506D | 1507D |
| 1601D | | 21-1D | 22-1D | 23-1D | 24-1D | 25-1D | 26-1D | 27-1D |
| 1602D | | 21-2D | 22-2D | 23-2D | 24-2D | 25-2D | 26-2D | 27-2D |
| 1603D | | 21-3D | 22-3D | 23-3D | 24-3D | 25-3D | 26-3D | 27-3D |

TABLE D-5

| Conditions | Gases employed | Flow rate (SCCM) | Flow rate ratio or Area ratio | Discharging power (W/cm$^2$) | Layer thickness (μ) |
|---|---|---|---|---|---|
| 5-1D | Ar | 200 | Si wafer:Silicon nitride = 1:30 | 0.3 | 0.5 |
| 5-2D | Ar | 200 | Si wafer:Silicon nitride = 1:60 | 0.3 | 0.3 |
| 5-3D | Ar | 200 | Si wafer:Silicon nitride = 6:4 | 0.3 | 1.0 |
| 5-4D | $SiH_4/He = 1$<br>$NH_3$ | $SiH_4 = 15$ | $SiH_4:NH_3 = 1:100$ | 0.18 | 0.3 |
| 5-5D | $SiH_4/He = 0.5$<br>$NH_3$ | $SiH_4 = 100$ | $SiH_4:NH_3 = 1:30$ | 0.18 | 1.5 |
| 5-6D | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 5-7D | $SiH_4/He = 0.5$<br>$SiF_4/He = 0.5$<br>$NH_3$ | $SiH_4 + SiF_4 = 15$ | $SiH_4:SiF_4:NH_3 = 2:1:90$ | 0.18 | 0.3 |
| 5-8D | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE D-6

| Layer (II) forming conditions | Sample No./Evaluation | | |
|---|---|---|---|
| 5-1D | 11-1-1D<br>○ ○ | 12-1-1D<br>○ ○ | 13-1-1D<br>○ ○ |
| 5-2D | 11-1-2D<br>○ ○ | 12-1-2D<br>○ ○ | 13-1-2D<br>○ ○ |
| 5-3D | 11-1-3D<br>○ ○ | 12-1-3D<br>○ ○ | 13-1-3D<br>○ ○ |
| 5-4D | 11-1-4D<br>◎ ◎ | 12-1-4D<br>◎ ◎ | 13-1-4D<br>◎ ◎ |
| 5-5D | 11-1-5D<br>◎ ◎ | 12-1-5D<br>◎ ◎ | 13-1-5D<br>◎ ◎ |

TABLE D-6-continued

| | | | |
|---|---|---|---|
| 5-6D | 11-1-6D<br>◎ ◎ | 12-1-6D<br>◎ ◎ | 13-1-6D<br>◎ ◎ |
| 5-7D | 11-1-7D<br>○ ○ | 12-1-7D<br>○ ○ | 13-1-7D<br>○ ○ |
| 5-8D | 11-1-8D<br>○ ○ | 12-1-8D<br>○ ○ | 13-1-8D<br>○ ○ |

Sample No.

Overall image quality — Durability evaluation

TABLE D-6-continued

| evaluation |
|---|
| Evaluation standards: |
| ◎ . . . Excellent |
| ○ . . . Good |

TABLE D-7

| Sample No. | 1301D | 1302D | 1303D | 1304D | 1305D | 1306D | 1307D |
|---|---|---|---|---|---|---|---|
| $Si:Si_3N_4$ Target (Area ratio) ($NH_3$/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎ Very good
○ Good
Δ: Sufficiently practically usable
X: Image defect formed

TABLE D-8

| Sample No. | 1401D | 1402D | 1403D | 1404D | 1405D | 1406D | 1407D | 1408D |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:H (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ◎ | ◎ | ◎ | ○ | Δ | Δ | X |

◎: Very good
○: Good
Δ: Sufficiently practically usable
X: Image defect formed

TABLE D-9

| Sample No. | 1501D | 1502D | 1503D | 1504D | 1505D | 1506D | 1507D | 1508D |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○: Good
Δ: Sufficiently practically usable
X: Image defect formed

TABLE D-10

| Sample No. | Thickness of layer (II) (μ) | Results |
|---|---|---|
| 1601D | 0.001 | Image defect liable to be formed |
| 1602D | 0.02 | No image defect formed up to successive copying for 20,000 times |
| 1603D | 0.05 | Stable up to successive copying for 50,000 times |

TABLE D-10-continued

| Sample No. | Thickness of layer (II) (μ) | Results |
|---|---|---|
| 1604D | 1 | Stable up to successive copying for 200,000 times |

TABLE E-1

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiF_4/He = 0.5$ $GeF_4/He = 0.5$ $C_2H_4$ $H_2$ | $SiF_4 + GeF_4 = 200$ | $\frac{GeF_4}{(H_2 + SiF_4 + GeF_4)} = *$ $\frac{C_2H_4}{SiF_4 + GeF_4} = **$ | 0.18 | 15 | 25 |
| Layer (II) | $SiH_4/He = 0.5$ NO | $SiH_4 = 100$ | $SiH_4/NO = 3/7$ | 0.18 | 10 | 0.5 |

*, ** Flow rate ratio was changed with regard to each sample according to the flow rate ratio change rate curve previously designed by controlling automatically the opening of the corresponding valve.

TABLE E-2

| Depth profile of Ge | | | | |
|---|---|---|---|---|
| Depth profile of C | Sample No. | 1501E | 1502E | 1503E |
| 1601E | | 11-1E | 12-1E | 13-1E |
| 1602E | | 11-2E | 12-2E | 13-2E |
| 1603E | | 11-3E | 12-3E | 13-3E |

TABLE E-3

| Layer Constitution | | Gases employed | Flow rate (SCCM) | Flow rate ratio | Discharging power ($W/cm^2$) | Layer formation rate (Å/sec) | Layer thickness ($\mu$) |
|---|---|---|---|---|---|---|---|
| Layer (I) | First layer | $SiF_4/He = 0.5$<br>$GeF_4/He = 0.5$<br>$C_2H_4$<br>$B_2H_6/He = 1 \times 10^{-3}$ | $SiF_4 + GeF_4 = 200$ | $\frac{GeF_4}{(H_2 + SiF_4 + GeF_4)} = *$<br>$\frac{B_2H_6}{(SiF_4 + GeF_4)} = 2 \times 10^{-3}$ | 0.18 | 15 | 5 |
| | Second layer | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = *$ | 0.18 | 15 | 20 |
| Layer (II) | | $SiH_4/He = 0.5$<br>NO | $SiH_4 = 100$ | $SiH_4/NO = 3/7$ | 0.18 | 10 | 0.5 |

* Flow rate ratio was changed with regard to each sample according to the flow rate ratio change rate curve previously designed by controlling automatically the opening of the corresponding valve.

TABLE E-4

| Depth profile of Ge | | | | |
|---|---|---|---|---|
| Depth profile of C | Sample No. | 1501E | 1502E | 1503E |
| 1601E | | 21-1E | 22-1E | 23-1E |
| 1602E | | 21-2E | 22-2E | 23-2E |
| 1603E | | 21-3E | 22-3E | 23-3E |

TABLE E-5

| Conditions | Gases employed | Flow rate (SCCM) | Flow rate ratio or Area ratio | Discharging power ($W/cm^2$) | Layer thickness ($\mu$) |
|---|---|---|---|---|---|
| 5-1E | Ar | 200 | Si wafer:$SiO_2$ = 1:30 | 0.3 | 0.5 |
| 5-2E | Ar | 200 | Si wafer:$SiO_2$ = 1:60 | 0.3 | 0.3 |
| 5-3E | Ar | 200 | Si wafer:$SiO_2$ = 6:4 | 0.3 | 1.0 |
| 5-4E | $SiH_4/He = 1$<br>NO | $SiH_4 = 15$ | $SiH_4$:NO = 5:1 | 0.18 | 0.3 |
| 5-5E | $SiH_4/He = 0.5$<br>NO | $SiH_4 = 100$ | $SiH_4$:NO = 1:1 | 0.18 | 1.5 |
| 5-6E | $SiH_4/He = 0.5$<br>$SiF_4/He = 0.5$<br>NO | $SiH_4 + SiF_4 = 150$ | $SiH_4$:$SiF_4$:NO = 1:1:1 | 0.18 | 0.5 |
| 5-7E | $SiH_4/He = 0.5$<br>$SiF_4/He = 0.5$<br>NO | $SiH_4 + SiF_4 = 15$ | $SiH_4$:$SiF_4$:NO = 2:1:4 | 0.18 | 0.3 |
| 5-8E | $SiH_4/He = 0.5$<br>$SiF_4/He = 0.5$<br>NO | $SiH_4 + SiF_4 = 150$ | $SiH_4$:$SiF_4$:NO = 1:1:3 | 0.18 | 1.5 |

TABLE E-6

| Layer (II) forming conditions | Sample No./Evaluation | | |
|---|---|---|---|
| 5-1E | 11-1-1E<br>○ ○ | 12-1-1E<br>○ ○ | 13-1-1E<br>○ ○ |
| 5-2E | 11-1-2E<br>○ ○ | 12-1-2E<br>○ ○ | 13-1-2E<br>○ ○ |
| 5-3E | 11-1-3E<br>○ ○ | 12-1-3E<br>○ ○ | 13-1-3E<br>○ ○ |

TABLE E-6-continued

| | | | |
|---|---|---|---|
| 5-4E | 11-1-4E<br>◎ | 12-1-4E<br>◎ ◎ | 13-1-4E<br>◎ ◎ |
| 5-5E | 11-1-5E<br>◎ ◎ | 12-1-5E<br>◎ ◎ | 13-1-5E<br>◎ ◎ |
| 5-6E | 11-1-6E<br>◎ ◎ | 12-1-6E<br>◎ ◎ | 13-1-6E<br>◎ ◎ |
| 5-7E | 11-1-7E<br>○ ○ | 12-1-7E<br>○ ○ | 13-1-7E<br>○ ○ |
| 5-8E | 11-1-8E<br>○ ○ | 12-1-8E<br>○ ○ | 13-1-8E<br>○ ○ |

| Sample No. | Overall image quality evaluation | Durability evaluation |
|---|---|---|

Evaluation standards:
◎. . . Excellent
○ . . . Good

TABLE E-7

| Sample No. | 1301E | 1302E | 1303E | 1304E | 1305E | 1306E | 1307E |
|---|---|---|---|---|---|---|---|
| $Si:SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image | Δ | ◎ | ◎ | ○ | ○ | Δ | X |

TABLE E-7-continued

| Sample No. | 1301E | 1302E | 1303E | 1304E | 1305E | 1306E | 1307E |
|---|---|---|---|---|---|---|---|
| quality evaluation | | | | | | | |

◎: Very good
○ : Good
Δ: Sufficiently practically usable
X: Image defect formed

TABLE E-8

| Sample No. | 1401E | 1402E | 1403E | 1404E | 1405E | 1406E | 1407E |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999: 0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

◎: Very good
○ : Good
Δ: Sufficiently practically usable
X: Image defect formed

TABLE E-9

| Sample No. | 1501E | 1502E | 1503E | 1504E | 1505E | 1506E | 1507E |
|---|---|---|---|---|---|---|---|
| $SiH_4$:$SiF_4$:NO (Flow rate ratio) | 500:400: 0.1 | 50:50:1 | 5:5:2 | 5:5:10 | 1:1:4 | 3:3:20 | 1:1:2000 |
| Si:O (Content ratio) | 9.9998: 0.0002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○: Good
Δ: Sufficiently practically usable
X: Image defect formed

TABLE E-10

| Sample No. | Thickness layer (II) (μ) | Results |
|---|---|---|
| 1601E | 0.001 | Image defect liable to be formed |
| 1602E | 0.02 | No image defect formed up to successive copying for 20,000 times |

TABLE E-10-continued

| Sample No. | Thickness layer (II) (μ) | Results |
|---|---|---|
| 1603E | 0.05 | Stable up to successive copying for 50,000 times |
| 1604E | 1 | Stable up to successive copying for 200,000 times |

TABLE F-1

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer(I) | First layer region (G) | $SiH_4/He = 0.5$ $GeH_4/He = 0.5$ | $SiH_4 + GeH_4 = 200$ | $\frac{GeH_4}{SiH_4 + GeH_4} = *$ | 0.18 | 15 | 3 |
| | | $C_2H_4$ | | $\frac{C_2H_4}{SiH_4 + C_2H_4} = **$ | | | |
| | Second layer region (S) | $SiH_4/He = 0.5$ $C_2H_4$ | $SiH_4 = 200$ | $\frac{C_2H_4}{SiH_4 + C_2H_4} = **$ | 0.18 | 15 | 25 |
| Layer(II) | NO | $SiH_4/He = 0.5$ | $SiH_4 = 100$ | $SiH_4/NO = 3/7$ | 0.18 | 10 | 0.5 |

*,**Flow rate ratio was changed with regard to each sample according to the flow rate ratio change rate curve previously designed by controlling automatically the opening of the corresponding valve.

TABLE F-2

| Depth profile of Ge / Depth profile of C | Sample No. | 1501F | 1502F | 1503F | 1504F | 1505F | 1506F | 1507F |
|---|---|---|---|---|---|---|---|---|
| 1601F | | 11-1F | 12-1F | 13-1F | 14-1F | 15-1F | 16-1F | 17-1F |
| 1602F | | 11-2F | 12-2F | 13-2F | 14-2F | 15-2F | 16-2F | 17-2F |
| 1603F | | 11-3F | 12-3F | 13-3F | 14-3F | 15-3F | 16-3F | 17-3F |

TABLE F-3

| Layer Constitution | | Gases employed | Flow rate (SCCM) | Flow rate ratio | Discharging power (W/cm$^2$) | Layer formation rate (Å/sec) | Layer thickness (μ) |
|---|---|---|---|---|---|---|---|
| Layer(I) | First layer | $SiH_4$/He = 0.5<br>$GeH_4$/He = 0.5 | $SiH_4 + GeH_4 = 200$ | $\frac{GeH_4}{SiH_4 + GeH_4} = *$ | 0.18 | 15 | 3 |
| | region (G) | $C_2H_4$<br>$B_2H_6$/He = 10 | | $\frac{C_2H_4}{SiH_4 + C_2H_4} = **$<br>$\frac{B_2H_6}{SiH_4 + GeH_4} = 3 \times 10^{-3}$ | | | |
| | Second layer | $SiH_4$/He = 0.5<br>$C_2H_5$ | $SiH_4 = 200$ | $\frac{C_2H_4}{SiH_4 + C_2H_4} = **$ | 0.18 | 15 | 25 |
| | region (S) | | | | | | |
| Layer(II) | NO | $SiH_4$/He = 0.5 | $SiH_4 = 100$ | $SiH_4$/NO= 3/7 | 0.18 | 10 | 0.5 |

*,**Flow rate ratio was changed with regard to each sample according to the flow rate ratio change rate curve previously designed by controlling automatically the opening of the corresponding valve.

TABLE F-4

| Depth profile of Ge / Depth profile of C | Sample No. | 1501F | 1502F | 1503F | 1504F | 1505F | 1506F | 1507F |
|---|---|---|---|---|---|---|---|---|
| 1601F | | 21-1F | 22-1F | 23-1F | 24-1F | 25-1F | 26-1F | 27-1F |
| 1602F | | 21-2F | 22-2F | 23-2F | 24-2F | 25-2F | 26-2F | 27-2F |
| 1603F | | 21-3F | 22-3F | 23-3F | 24-3F | 25-3F | 26-3F | 27-3F |

TABLE F-5

| Conditions | Gases employed | Flow rate (SCCM) | Flow rate ratio or Area ratio | Discharging power (W/cm$^2$) | Layer thickness (μ) |
|---|---|---|---|---|---|
| 5-1F | Ar | 200 | Si wafer:$SiO_2$ = 1:30 | 0.3 | 0.5 |
| 5-2F | Ar | 200 | Si wafer:$SiO_2$ = 1:60 | 0.3 | 0.3 |
| 5-3F | Ar | 200 | Si wafer:$SiO_2$ = 6:4 | 0.3 | 1.0 |
| 5-4F | $SiH_4$/He = 1<br>NO | $SiH_4 = 15$ | $SiH_4$:NO = 5:1 | 0.18 | 0.3 |
| 5-5F | $SiH_4$/He = 0.5<br>NO | $SiH_4 = 100$ | $SiH_4$:NO = 1:1 | 0.18 | 1.5 |
| 5-6F | $SiH_4$/He = 0.5<br>$SiF_4$/He = 0.5<br>NO | $SiH_4 + SiF_4 = 150$ | $SiH_4$:$SiF_4$:NO = 1:1:1 | 0.18 | 0.5 |
| 5-7F | $SiH_4$/He = 0.5<br>$SiF_4$/He = 0.5<br>NO | $SiH_4 + SiF_4 = 15$ | $SiH_4$:$SiF_4$:NO = 2:1:4 | 0.18 | 0.3 |
| 5-8F | $SiH_4$/He = 0.5<br>$SiF_4$/He = 0.5<br>NO | $SiH_4 + SiF_4 = 150$ | $SiH_4$:$SiF_4$:NO = 1:1:3 | 0.18 | 1.5 |

TABLE F-6

| Layer (II) forming conditions | Sample No./Evaluation | | |
|---|---|---|---|
| 5-1F | 11-1-1F<br>○ ○ | 12-1-1F<br>○ ○ | 13-1-1F<br>○ ○ |
| 5-2F | 11-1-2F<br>○ ○ | 12-1-2F<br>○ ○ | 13-1-2F<br>○ ○ |
| 5-3F | 11-1-3F<br>○ ○ | 12-1-3F<br>○ ○ | 13-1-3F<br>○ ○ |

TABLE F-6-continued

| | | | |
|---|---|---|---|
| 5-4F | 11-1-4F<br>◎ ◎ | 12-1-4F<br>◎ ◎ | 13-1-4F<br>◎ ◎ |
| 5-5F | 11-1-5F<br>◎ ◎ | 12-1-5F<br>◎ ◎ | 13-1-5F<br>◎ ◎ |
| 5-6F | 11-1-6F<br>◎ ◎ | 12-1-6F<br>◎ ◎ | 13-1-6F<br>◎ ◎ |
| 5-7F | 11-1-7F<br>○ ○ | 12-1-7F<br>○ ○ | 13-1-7F<br>○ ○ |
| 5-8F | 11-1-8F<br>○ ○ | 12-1-8F<br>○ ○ | 13-1-8F<br>○ ○ |

TABLE F-6-continued

| Sample No. | Overall image quality evaluation | Durability evaluation |
|---|---|---|

Evaluation standards:
◎. . . Excellent
○ . . Good

TABLE F-7

| Sample No. | 1301F | 1302F | 1303F | 1304F | 1305F | 1306F | 1307F |
|---|---|---|---|---|---|---|---|
| $Si:SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○: Good
Δ: Sufficiently practically usable
X: Image defect formed

TABLE F-8

| Sample No. | 1401F | 1402F | 1403F | 1404F | 1405F | 1406F | 1407F |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999: 0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

◎: Very good
○: Good
Δ: Sufficiently practically usable
X: Image defect formed

TABLE F-9

| Sample No. | 1501F | 1502F | 1503F | 1504F | 1505F | 1506F | 1507F |
|---|---|---|---|---|---|---|---|
| $SiH_4$:$SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998: 0.0002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○: Good
Δ: Sufficiently practically usable
X: Image defect formed

TABLE F-10

| Sample | Thickness of layer (II) (μ) | Results |
|---|---|---|
| 1601F | 0.001 | Image defect liable to be formed |
| 1602F | 0.02 | No image defect formed up to successive copying for 20,000 times |
| 1603F | 0.05 | Stable up to successive copying for 50,000 times |
| 1604F | 1 | Stable up to successive copying for 200,000 times |

We claim:

1. A photoconductive member which comprises a substrate for a photoconductive member and a light receiving layer comprising an amorphous material comprising silicon atoms and germanium atoms wherein the content of germanium atoms in the light receiving layer is 1 to $9.5\times10^5$ atomic ppm based on the sum of germanium atoms and silicon atoms, and exhibiting photoconductivity, the light receiving layer containing at least one of hydrogen atoms and halogen atoms and having a layer region (C) containing carbon atoms, and the layer region (C) having a region (X) where the distribution concentration line C(C) in the direction of layer thickness of carbon atoms increases continuously toward the upper surface of the light receiving layer.

2. A photoconductive member according to claim 1 in which the layer region (C) has a region (Y) which is below the region (X) and where the distribution concentration line C(C) increases continuously toward the substrate side.

3. A photoconductive member according to claim 1 in which hydrogen atoms are contained in the light receiving layer.

4. A photoconductive member according to claim 1 in which hydrogen atoms are contained in the light receiving layer.

5. A photoconductive member according to claim 1 in which germanium atoms are distributed ununiformly in the direction of layer thickness in the light receiving layer.

6. A photoconductive member according to claim 1 in which germanium atoms are distributed uniformly in the direction of layer thickness in the light receiving layer.

7. A photoconductive member according to claim 1 in which a substance for controlling conductivity is contained in the light receiving layer.

8. A photoconductive member according to claim 7 in which the substance for controlling conductivity is an atom of Group III of the Periodic Table.

9. A photoconductive member according to claim 7 in which the substance for controlling conductivity is an atom of Group V of the Periodic Table.

10. A photoconductive member which comprises a substrate for a photoconductive member and a light receiving layer comprising a first layer region (G) comprising an amorphous material containing germanium atoms in an amount from 1 to $10\times10^5$ atomic ppm and at least one of hydrogen atoms and halogen atoms and a second layer region (S) comprising an amorphous material and at least one of hydrogen atoms and halogen atoms and exhibiting photoconductivity, the first layer region (G) and the second layer region (S) being provided in the mentioned order on the substrate, the light receiving layer having a layer region (C) containing carbon atoms, and the layer region (C) having a region (X) where the distribution concentration line C(C) in the direction of layer thickness of carbon atoms increases continuously toward the upper surface side of the light receiving layer.

11. A photoconductive member according to claim 10 in which hydrogen atoms are contained in at least one of the first layer region (G) and the second layer region (S).

12. A photoconductive member according to claim 10 in which halogen atoms are contained in at least one of the first layer region (G) and the second layer region (S).

13. A photoconductive member according to claim 10 in which the layer region (C) has a region (Y) which is below the region (X) and where the distribution concentration line C(C) increases continuously toward the substrate side.

14. A photoconductive member according to claim 10 in which germanium atoms are ununiformly distributed in the first layer region (G).

15. A photoconductive member according to claim 10 in which germanium atoms are uniformly distributed in the first layer region (G).

16. A photoconductive member according to claim 10 in which a substance for controlling conductivity is contained in the light receiving layer.

17. A photoconductive member according to claim 16 in which a substance for controlling conductivity is an atom of Group III of the Periodic Table.

18. A photoconductive member according to claim 16 in which the substance for controlling conductivity is an atom of Group V of the Periodic Table.

19. A photoconductive member according to claim 1 in which the light receiving layer contains at least one of oxygen atoms and nitrogen atoms.

20. A photoconductive member which comprises a substrate for a photoconductive member and a light receiving layer comprising a first layer overlying the substrate, comprising an amorphous material containing silicon atoms, germanium atoms and at least one of hydrogen atoms and halogen atoms and exhibiting photoconductivity and a second layer overlying the first layer and comprising an amorphous material containing silicon atoms as the matrix and (i) at least one of nitrogen atoms and oxygen atoms and (ii) at least one of hydrogen atoms and halogen atoms, the first layer having a layer region (C) containing carbon atoms, and the layer region (C) having a region (X) where the distribution concentration line C(C) in the direction of layer thickness of carbon atoms increases continuously from the substrate side toward the upper surface side of the light receiving layer and wherein the content of germanium atoms in the first layer is 1 to $9.5\times10^5$ atomic ppm based on the sum of germanium atoms and silicon atoms.

21. A photoconductive member according to claim 20 in which hydrogen atoms are contained in the first layer.

22. A photoconductive member according to claim 20 in which the halogen atoms are contained in the first layer.

23. A photoconductive member according to claim 20 in which the layer region (C) has a region (Y) which is below the region (X) and where the distribution concentration line C(C) increases continuously toward the substrate side.

24. A photoconductive member according to claim 20 in which the distribution of germanium atoms in the first layer is ununiform in the direction of layer thickness.

25. A photoconductive member according to claim 20 in which the distribution of germanium atoms in the first layer is uniform in the direction of layer thickness.

26. A photoconductive member according to claim 20 in which a substance for controlling conductivity is contained in the first layer.

27. A photoconductive member according to claim 26 in which the substance for controlling conductivity is an atom of Group III of the Periodic Table.

28. A photoconductive member according to claim 26 in which the substance for controlling conductivity is an atom of Group V of the Periodic Table.

29. A photoconductive member which comprises a substrate for a photoconductive member and a light receiving layer comprising a first layer having a first layer region (G) overlying the substrate and comprising an amorphous material containing germanium atoms in an amount from $1-10\times10^5$ atomic ppm and at least one of hydrogen atoms and halogen atoms, and a second layer region (S) overlying the first layer region (G), comprising an amorphous material containing silicon atoms and at least one of hydrogen atoms and halogen atoms and exhibiting photoconductivity, and a second layer overlying the first layer and comprising an amorphous material containing silicon atoms as the matrix and at least one of nitrogen atoms and oxygen atoms and (ii) at least one of hydrogen atoms and halogen atoms, the first layer having a layer region (C) containing carbon atoms, and the layer region (C) having a region (X) where the distribution concentration line C(C) in the direction of layer thickness of carbon atoms increases continuously from the substrate side toward the upper surface side of the light receiving layer.

30. A photoconductive member according to claim 29 in which hydrogen atoms are contained in at least one of the first layer region (G) and the second layer region (S).

31. A photoconductive member according to claim 29 in which halogen atoms are contained in at least one of the first layer region (G) and the second layer region (S).

32. A photoconductive member according to claim 29 in which the layer region (C) has a region (Y) which is below the region (X) and where the distribution concentration line C(C) increases continuously toward the substrate side.

33. A photoconductive member according to claim 29 in which the distribution of germanium atoms in the first layer region (G) is ununiform.

34. A photoconductive member according to claim 29 in which the distribution of germanium atoms in the first layer region (G) is uniform.

35. A photoconductive member according to claim 29 in which a substance for controlling conductivity is contained in the first layer.

36. A photoconductive member according to claim 35 in which the substance for controlling conductivity is an atom of Group III of the Periodic Table.

37. A photoconductive member according to claim 35 in which the substance for controlling conductivity is an atom of Group V of the Periodic Table.

38. A photoconductive member according to claim 20 in which the first layer contains at least one of oxygen atoms and nitrogen atoms.

39. A photoconductive member according to claim 1 in which the content of carbon atoms in the layer region (C) is 0.001–50 atomic %.

40. A photoconductive member according to claim 3 in which the content of hydrogen atoms is 0.01–40 atomic %.

41. A photoconductive member according to claim 4 in which the content of halogen atoms is 0.01–40 atomic %.

42. A photoconductive member according to claim 7 in which the content of the substance for controlling conductivity is $0.01–5\times10^4$ atomic ppm.

43. A photoconductive member according to claim 10 in which the content of carbon atoms contained in the layer region (C) is 0.001–50 atomic %.

44. A photoconductive member according to claim 11 in which the content of hydrogen atoms contained in the first layer region (G) is 0.01–40 atomic %.

45. A photoconductive member according to claim 11 in which the content of hydrogen atoms contained the second layer region (S) is 1–40 atomic %.

46. A photoconductive member according to claim 12 in which the content of halogen atoms in the first layer region (G) is 0.01–40 atomic %.

47. A photoconductive member according to claim 12 in which the content of halogen atoms in the second layer region (S) is 1–40 atomic %.

48. A photoconductive member according to claim 16 in which the content of the substance for controlling conductivity is $0.01–5\times10^4$ atomic ppm.

49. A photoconductive member according to claim 20 in which the content of carbon atoms in the layer region (C) is 0.001–50 atomic %.

50. A photoconductive member according to claim 21 in which the content of hydrogen atoms is 0.01–40 atomic %.

51. A photoconductive member according to claim 22 in which the content of halogen atoms is 0.01–40 atomic %.

52. A photoconductive member according to claim 26 in which the content of the substance for controlling conductivity is $0.01–5\times10^4$ atomic ppm.

53. A photoconductive member according to claim 29 in which the content of carbon atoms in the layer region (C) is 0.001–50 atomic %.

54. A photoconductive member according to claim 30 in which the content of hydrogen atoms in the first layer region (G) is 0.01–40 atomic %.

55. A photoconductive member according to claim 30 in which the content of hydrogen atoms in the second layer region (S) is 1–40 atomic %.

56. A photoconductive member according to claim 31 in which the content of halogen atoms in the first layer region (G) is 0.01–40 atomic %.

57. A photoconductive member according to

58. A photoconductive member according to claim 35 in which the substance for controlling conductivity is contained in an amount of $0.01–5\times10^4$ atomic ppm.

59. A photoconductive member according to claim 1 in which the thickness of the light receiving layer is 1–100μ.

60. A photoconductive member according to claim 10 in which the thickness of the first layer region (G) is 30 Å–50μ.

61. A photoconductive member according to claim 10 in which the thickness of the second layer region (S) is 0.5–90 μ.

62. A photoconductive member according to claim 20 in which the thickness of the first layer is 1–100 μ.

63. A photoconductive member according to claim 20 in which hydrogen atoms are contained in the second layer.

64. A photoconductive member according to claim 20 in which halogen atoms are contained in the second layer.

65. A photoconductive member according to claim 20 in which hydrogen atoms and halogen atoms are contained in the second layer.

66. A photoconductive member according to claim 20 in which the thickness of the second layer is 0.003–30 μ.

67. A photoconductive member according to claim 1 in which the light receiving layer has a layer region (PN) containing a substance for controlling conductivity.

68. A photoconductive member according to claim 20 in which the first layer has a layer region (PN) containing a substance for controlling conductivity.

69. A photoconductive member according to claim 67 in which the content of the substance for controlling conductivity contained in the layer region (PN) is $0.01–5\times10^4$ atomic ppm.

70. A photoconductive member according to claim 7 in which the substance for controlling conductivity is locally present in the substrate side end portion layer region (E).

71. A photoconductive member according to claim 70 in which there is contained in a layer region (Z) other than the layer region (E) a substance for controlling conductivity characteristics which has a polarity of conductivity type opposite to that of the substance for controlling conductivity characteristics contained in the layer region (E).

72. A photoconductive member according to claim 71 in which the amount of the substance for controlling conductivity characteristics contained in the layer region (Z) is less than that of the substance for controlling conductivity characteristics contained in the layer region (E).

73. A photoconductive member according to claim 72 in which the content of the substance for controlling conductivity contained in the layer region (Z) is 0.001–1000 atomic ppm.

74. A photoconductive member according to claim 11 in which halogen atoms are contained in at least one of the first layer region (G) and the second layer region (S).

75. A photoconductive member according to claim 10 in which the light receiving layer contains at least one of oxygen atoms and nitrogen atoms.

76. A photoconductive member according to claim 21 in which halogen atoms are contained in the first layer.

77. A photoconductive member according to claim 30 in which halogen atoms are contained in at least one of the first layer region (G) and the second region (S).

78. A photoconductive member according to claim 29 in which the first layer contains at least one of oxygen atoms and nitrogen atoms.

79. A photoconductive member according to claim 10 in which the thickness of the light receiving layer is 1–100 μ.

80. A photoconductive member according to claim 29 in which the thickness of the first layer region (G) is 30 Å–50 μ.

81. A photoconductive member according to claim 29 in which the thickness of the second layer region (S) is 0.5–90 μ.

82. A photoconductive member according to claim 29 in which the thickness of the first layer is 1–100 μ.

83. A photoconductive member according to claim 29 in which hydrogen atoms are contained in the second layer.

84. A photoconductive member according to claim 29 in which halogen atoms are contained in the second layer.

85. A photoconductive member according to claim 29 in which hydrogen atoms and halogen atoms are contained in the second layer.

86. A photoconductive member according to claim 29 in which the thickness of the second layer is 0.003–30 μ.

87. A photoconductive member according to claim 10 in which the light receiving layer has a layer region (PN) containing a substance for controlling conductivity.

88. A photoconductive member according to claim 29 in which the first layer has a layer region (PN) containing a substance for controlling conductivity.

89. A photoconductive member according to claim 68 in which the content of the substance for controlling conductivity contained in the layer region (PN) is $0.01–5\times10^4$ atomic ppm.

90. A photoconductive member according to claim 16 in which the substance for controlling conductivity is locally present in the substrate side end portion layer region (E).

91. A photoconductive member according to claim 26 in which the substance for controlling conductivity is locally present in the substrate side end portion layer region (E).

92. A photoconductive member according to claim 35 in which the substance for controlling conductivity is locally present in the substrate side end portion layer region (E).

93. A photoconductive member according to claim 3 in which halogen atoms are contained in the light receiving layer.

94. An electrophotographic process comprising:

(a) applying a charging treatment to a photoconductive member which comprises a substrate for a photoconductive member and a light receiving layer comprising an amorphous material comprising silicon atoms and germanium atoms wherein the content of germanium atoms in the light receiving layer is 1 to $9.5\times10^5$ atomic ppm based on the sum of germanium atoms and silicon atoms, and exhibiting photoconductivity, the light receiving layer containing at least one of hydrogen atoms and halogen atoms and having a layer region (C) containing carbon atoms, and the layer region (C) having a region (X) where the distribution concentration line C(C) in the direction of layer thickness of carbon atoms increases continuously toward the upper surface of the light receiving layer; and (b) irradiating the photoconductive member with an electromagnetic wave carrying information, thereby forming an electrostatic image.

95. An electrophotographic process comprising: (a) applying a charging treatment to a photoconductive member which comprises a substrate for a photoconductive member and a light receiving layer comprising a first layer region (G) comprising an amorphous material containing germanium atoms in an amount from 1 to $10\times10^5$ atomic ppm and at least one of hydrogen atoms and halogen atoms and a second layer region (S) comprising an amorphous material and at least one of hydrogen atoms and halogen atoms and exhibiting photoconductivity, the first layer region (G) and the second layer region (S) being provided in the mentioned order on the substrate, the light receiving layer having a layer region (C) containing carbon atoms, and the layer region (C) having a region (X) where the distribution concentration line C(C) in the direction of layer thickness of carbon atoms increases continuously toward the upper surface side of the light receiving layer; and (b) irradiating the photoconductive member with an electromagnetic wave carrying information, thereby forming an electrostatic image.

96. An electrophotographic process comprising:

(a) applying a charging treatment to a photoconductive member which comprises a substrate for a photoconductive member and a light receiving layer comprising a first layer overlying the substrate, comprising an amorphous material containing silicon atoms, germanium atoms and at least one of hydrogen atoms and halogen atoms and exhibiting photoconductivity and a second layer overlying the first layer and comprising an amorphous material containing silicon atoms as the matrix and (i) at least one of nitrogen atoms and oxygen atoms and (ii) at least one of hydrogen atoms and halogen atoms, the first layer having a layer region (C) containing carbon atoms, and the layer region (C) having a region (X) where the distribution concentration C(C) in the direction of layer thickness of carbon atoms increases continuously from the substrate side toward the upper surface side of the light receiving layer and wherein the content of germanium atoms in the first layer is 1 to $9.5\times10^5$ atomic ppm based on the sum of germanium atoms and silicon atoms; and (b) irradiating the photoconductive member with an electromagnetic wave carrying information, thereby forming an electrostatic image.

97. An electrophotographic process comprising:

(a) applying a charging treatment to a photoconductive member which comprises a substrate for a photoconductive member and a light receiving layer comprising a first layer having a first layer region (G) overlying the substrate and comprising an amorphous material containing germanium atoms in an amount from $1\text{–}10\times10^5$ atomic ppm and at least one of hydrogen atoms and halogen atoms, and a second layer region (S) overlying the first layer region (G), comprising an amorphous material containing silicon atoms and at least one of hydrogen atoms and halogen atoms and exhibiting photoconductivity, and a second layer overlying the first layer and comprising an amorphous material containing silicon atoms as the matrix and (i) at least one nitrogen atoms and oxygen atoms and (ii) at least one of hydrogen atoms and halogen atoms, the first layer having a layer region (C) containing carbon atoms, and the layer region (C) having a region (X) where the distribution concentration line C(C) in the direction of layer thickness of carbon atoms increases continuously from the substrate side toward the upper surface side of the light receiving layer; and (b) irradiating the photoconductive member with an electromagnetic wave carrying information, thereby forming an electrostatic image.

* * * * *

UNITED STATES PATENT AND TRADEMARK OFFICE

CERTIFICATE OF CORRECTION

PATENT NO. : 4,585,720

DATED : April 29, 1986

INVENTOR(S) : KEISHI SAITOH, ET AL.

It is certified that error appears in the above-identified patent and that said Letters Patent is hereby corrected as shown below:

SHEET 9 OF 19

FIG. 19, "cabon" should read --carbon--.

COLUMN 56

Lines 21-22, "11-1-4E" should read --11-1-4E--.

COLUMN 57

Line 65, "region" should read --region--.
(S) (S)
NO

Line 65, "$SiH_4$/He = 0.5" should read --$SiH_4$/He = 0.5--.
NO

COLUMN 59

Line 28, "region" should read --region--.
(S) (S)
NO

Line 28, "$SiH_4$/He = 0.5" should read --$SiH_4$/He = 0.5--.
NO

COLUMN 64

Line 61, "and at" should read --and (i) at--.

COLUMN 65

Line 52, "contained" should read contained in--.

UNITED STATES PATENT AND TRADEMARK OFFICE

CERTIFICATE OF CORRECTION

PATENT NO. : 4,585,720

DATED : April 29, 1986

INVENTOR(S) : KEISHI SAITOH, ET AL.

It is certified that error appears in the above-identified patent and that said Letters Patent is hereby corrected as shown below:

COLUMN 66

Line 19, "according to / 58." should read --according to claim 31 in which the content of halogen atoms in the second layer region (S) is 1-40 atomic %. / 58.--.

Signed and Sealed this

Thirty-first Day of March, 1987

*Attest:*

*Attesting Officer*

DONALD J. QUIGG

*Commissioner of Patents and Trademarks*